US005634362A

United States Patent [19]

Tomita

[11] Patent Number: 5,634,362

[45] Date of Patent: Jun. 3, 1997

[54] SUPPLEMENTAL BENDING METHOD FOR CORRECTING ALREADY BENT WORKPIECE, AND APPARATUS FOR DETERMINING INFORMATION FOR SUPPLEMENTAL BENDING ON THE WORKPIECE

[75] Inventor: Yukiharu Tomita, Okazaki, Japan

[73] Assignee: Toyota Jidosha Kabushiki Kaisha, Japan

[21] Appl. No.: 576,212

[22] Filed: Dec. 21, 1995

[30] Foreign Application Priority Data

Dec. 26, 1994 [JP] Japan ..... 6-321965

[51] Int. Cl.[6] ..... B21D 7/12

[52] U.S. Cl. ..... 72/31.05; 72/369

[58] Field of Search ..... 72/17.3, 31.04, 72/31.05, 307, 369

[56] References Cited

U.S. PATENT DOCUMENTS

| | | |
|---|---|---|
| 5,050,089 | 9/1991 | Stelson et al. . |
| 5,275,031 | 1/1994 | Whiteside et al. . |

FOREIGN PATENT DOCUMENTS

| | | |
|---|---|---|
| 0 338 944 | 10/1989 | European Pat. Off. . |
| 0 384 477 | 8/1990 | European Pat. Off. . |
| 0 530 452 | 3/1993 | European Pat. Off. . |
| 59-92120 | 5/1984 | Japan . |
| 62-156026 | 7/1987 | Japan . |
| 63-36928 | 2/1988 | Japan . |
| 5-84521 | 4/1993 | Japan . |

OTHER PUBLICATIONS

Patent Abstracts of Japan, vol. 17, No. 690, (M-1530), Dec. 16, 1993.

European Search Report dated Mar. 27, 1996 (2 pages).

Communication dated Apr. 12, 1996 (1 page).

Opton Catalog – "Pipe Bender" (10 pages).

Opton Catalog – "Tooling Bend" (20 pages).

Opton Catalog – "CNC Slim Bender & Opto-reader System" (5 pages).

*Primary Examiner*—Lowell A. Larson

[57] ABSTRACT

Method of effecting a supplemental bending operation on an initially bent workpiece which has been subjected to an initial bending operation at an initial bending position selected along the centerline of the workpiece, the method including a step of determining an actual relative position between the opposite ends of the initially bent workpiece, and determining, on the basis of the determined actual relative position, at least one of a supplemental bending position and a supplemental bending amount which are used for effecting the supplemental bending operation for reducing an error between the actual relative position and a nominal relative position between opposite ends of a product to be obtained by the supplemental bending operation, the supplemental bending position being different from the initial bending position, and a step of performing the supplemental bending operation at the determined supplemental bending position, so as to achieve the determined supplemental bending amount. Also disclosed is an apparatus for determining the supplemental bending position and amount.

19 Claims, 31 Drawing Sheets

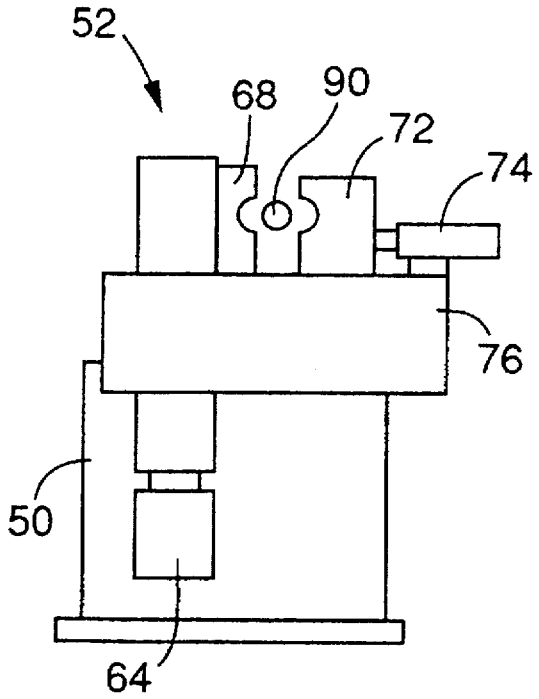
FIG. 3
FIG. 4
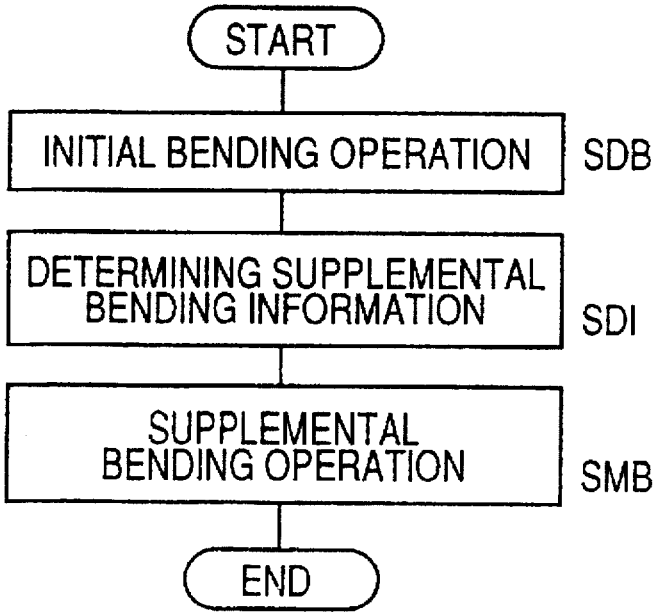

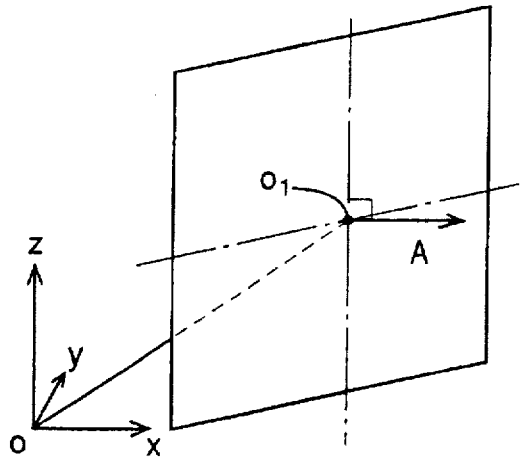
FIG. 12
FIG. 13
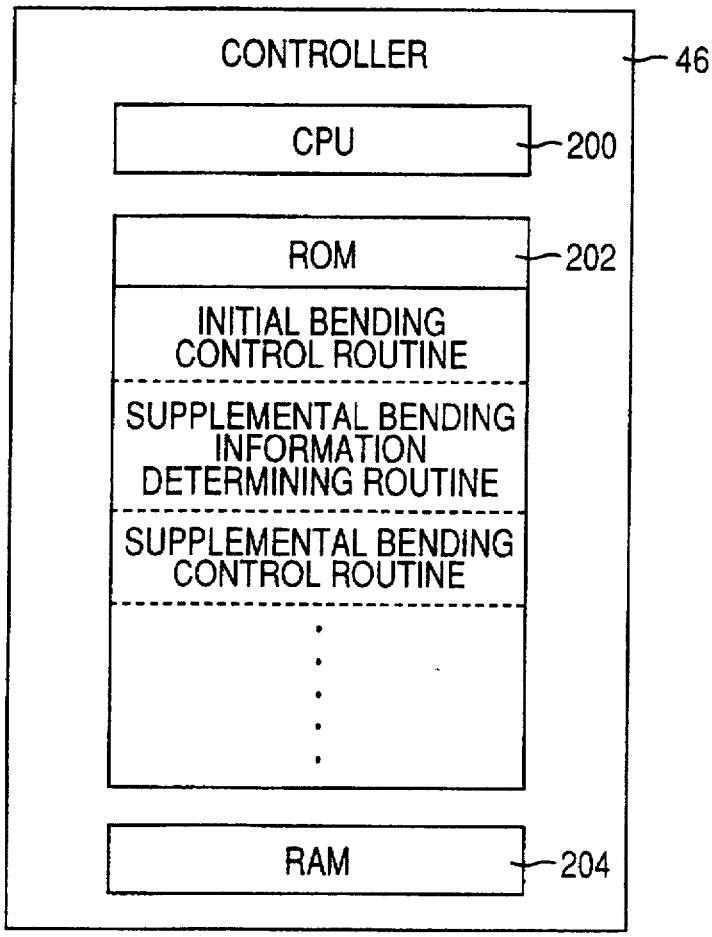

PRIOR TO WORKPIECE FEEDING

AFTER WORKPIECE FEEDING

PRIOR TO SUPPLEMENTAL BENDING

AFTER SUPPLEMENTAL BENDING

PRIOR TO WORKPIECE ROTATION

AFTER WORKPIECE ROTATION

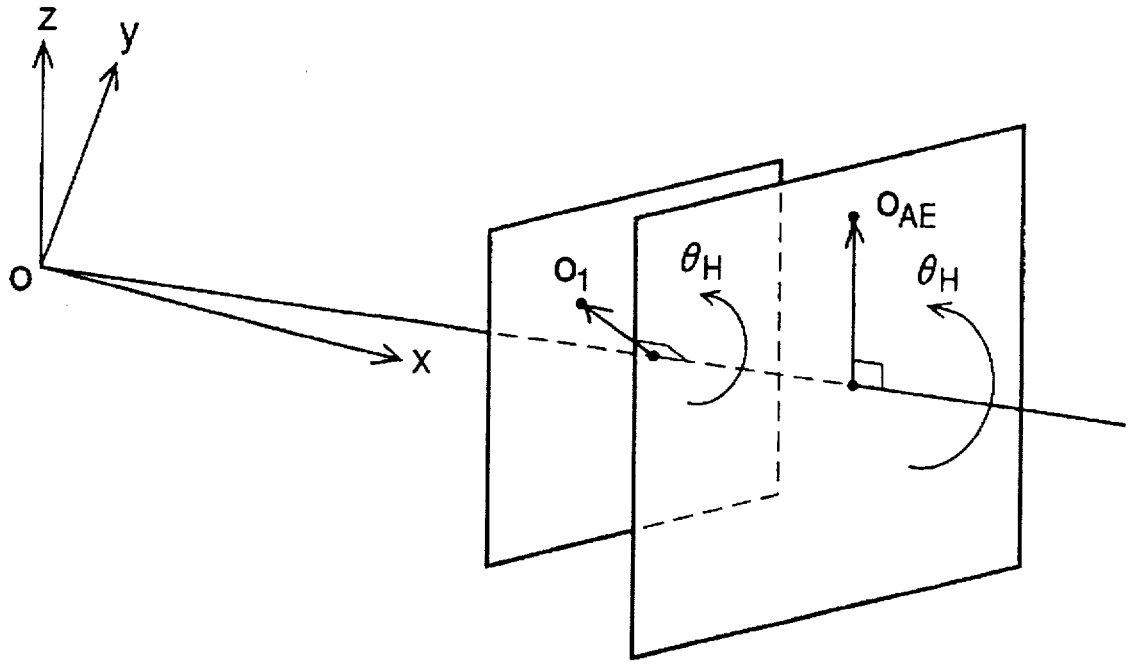
FIG. 21
FIG. 22
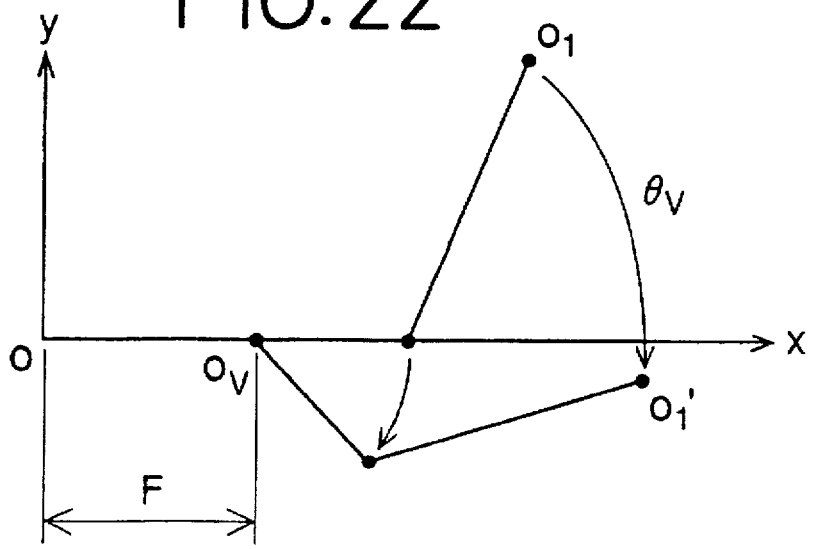

1

SELECTING PROVISIONAL VALUE N1(i) OF WORKPIECE FEEDING DISTANCE (N1 = 0 ..... f)
S140
SELECTING PROVISIONAL VALUE N2(j) OF WORKPIECE ROTATION ANGLE (N2 = 0 ..... φ)
S150
CALCULATING CORRECTED OUTLET END CENTER VECTOR AND CORRECTED NORMAL LINE VECTOR
S160
PROVISIONAL VALUES N1(i) AND N2(j) ACCEPTABLE ?
S170
NO
YES
END
N2< φ ?
S180
YES
NO
N1<f ?
S190
YES
NO
2

ND = 3

ND = 5

ND = 6

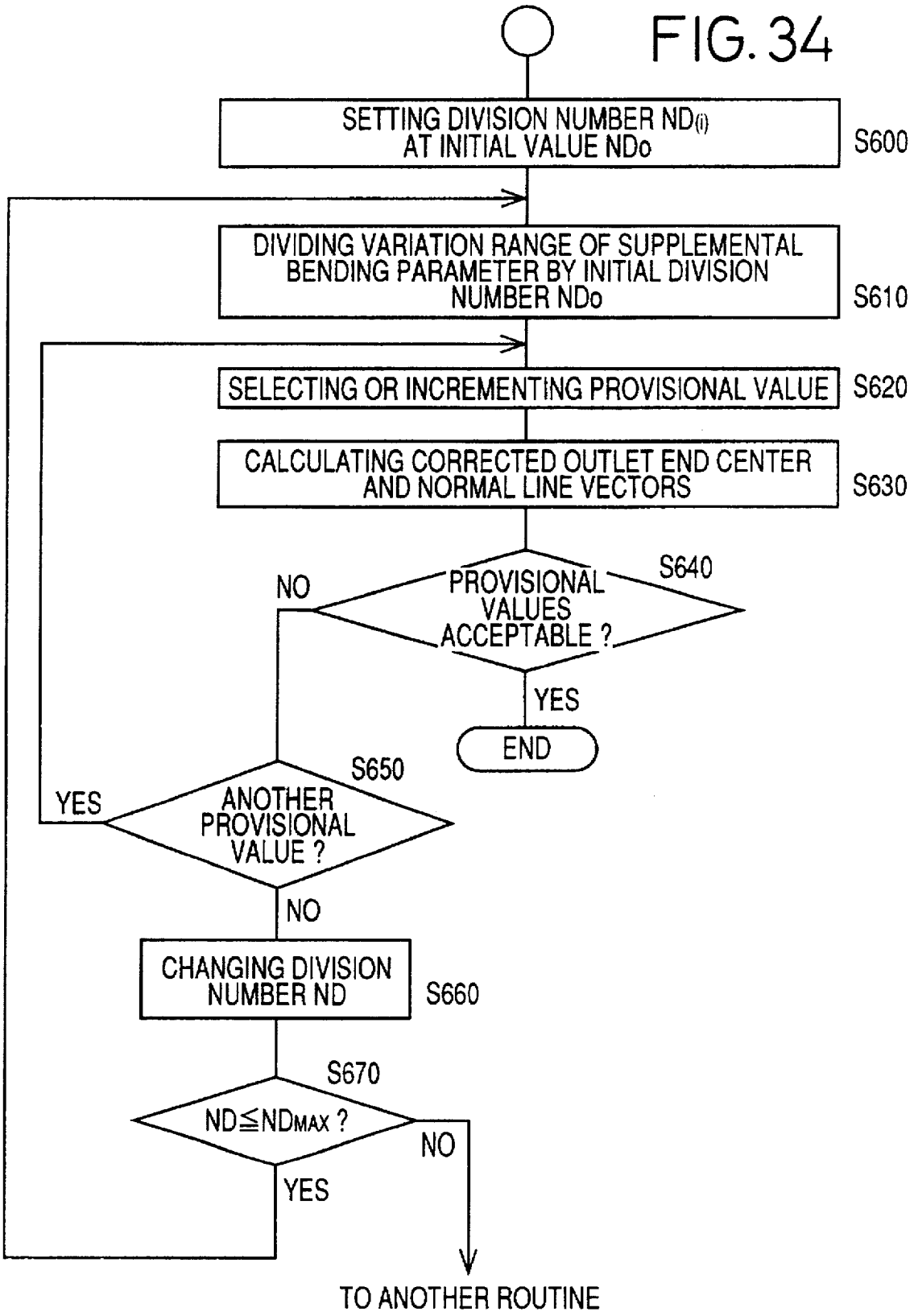
FIG. 34
SETTING DIVISION NUMBER ND(i) AT INITIAL VALUE NDo
S600
DIVIDING VARIATION RANGE OF SUPPLEMENTAL BENDING PARAMETER BY INITIAL DIVISION NUMBER NDo
S610
SELECTING OR INCREMENTING PROVISIONAL VALUE
S620
CALCULATING CORRECTED OUTLET END CENTER AND NORMAL LINE VECTORS
S630
PROVISIONAL VALUES ACCEPTABLE ?
S640
NO
YES
END
ANOTHER PROVISIONAL VALUE ?
S650
YES
NO
CHANGING DIVISION NUMBER ND
S660
ND≦NDMAX ?
S670
NO
YES
TO ANOTHER ROUTINE

ND = 3

ND = 5

ND = 6

SUPPLEMENTAL BENDING METHOD FOR CORRECTING ALREADY BENT WORKPIECE, AND APPARATUS FOR DETERMINING INFORMATION FOR SUPPLEMENTAL BENDING ON THE WORKPIECE

BACKGROUND OF THE INVENTION

1. Field of the Invention

The present invention relates generally to a method of effecting supplemental bending of an already bent workpiece to achieve a desired overall bending of the workpiece, and an apparatus for determining information required for effecting the supplemental bending, and more particularly to technologies for improving the accuracy of the supplemental bending.

2. Discussion of the Related Art

A product such as a pipe or tube having a centerline extending between the opposite ends is manufactured by bending the appropriate blank or workpiece at a certain position along its centerline between the opposite ends of the workpiece. An example of such a product is each of a plurality of branches of an intake or exhaust manifold attached to an engine of a motor vehicle. This type of product has a bend or bends formed so that an actual relative position (positional relationship) between the opposite ends of the product coincides with a desired or nominal relative position (positional relationship). In the case of a manifold branch, for example, the opposite ends are the inlet and outlet ends.

However, a bending operation on the workpiece so as to achieve the nominal relative position of the opposite ends of the product to be manufactured will not necessarily result in satisfactory coincidence or alignment of the actual relative position of the product with the nominal relative position. There are several causes for failure to achieve the satisfactory coincidence, which include a spring-back phenomenon of the workpiece itself due to its elasticity or resiliency. In the light of this drawback, the assignee of the present invention proposed the following technique as disclosed in JP-A-63-36928 (published in 1988). This technique includes a step of measuring the amount of spring-back of the workpiece (product) upon removal of a bending force from the workpiece at the end of an initial bending operation on the workpiece, and a step of effecting a secondary bending operation on the initially bent workpiece (intermediate product) so as to bend the workpiece by an amount corresponding to the measured spring-back amount. This secondary bending operation may be considered to be a supplemental bending operation to correct the initial bending such that the initial bending error is reflected on the supplemental bending operation so as to improve the overall bending accuracy.

However, the supplemental bending technique indicated above has a problem. That is, the supplemental bending takes place at the same position as the initial bending, and the same portion of the workpiece is subjected to the initial and supplemental bending operations. The two bending operations on the same portion of the workpiece may more or less cause work hardening of the workpiece, which tends to damage the workpiece at the bending position. Where the workpiece takes the form of a pipe, in particular, the pipe tends to also suffer from reduction in the wall thickness and consequent damage at the bending position.

The above supplemental bending technique has another problem. Namely, the technique includes the measurement of the spring-back amount of the initially bent workpiece at the initial bending position, and the supplemental bending operation to achieve the desired overall bending angle or amount with the measured spring-back amount taken into account. However, the error in the actual relative position between the opposite ends of the product increases with an increase in the error in the overall bending angle or amount. Where the relative position of the opposite ends of the product is important, even a small amount of error in the overall bending angle tends to have a significant effect on the actual relative position. In this respect, it is noted that the error in the actual relative position due to the error in the overall bending angle increases as the longitudinal dimension of the workpiece between the opposite ends increases. Therefore, the proposed supplemental bending technique which does not directly rely on the actual relative position of the initially bent workpiece suffers from difficulty to correct or rectify the initial bending with a sufficiently high degree of accuracy so as to achieve the desired or nominal relative position between the opposite ends of the product.

SUMMARY OF THE INVENTION

It is therefore a first object of the present invention to provide a method of effecting supplemental bending of an already or initially bend workpiece, at a position different from the initial bending position, on the basis of the actual relative position between the opposite ends of the workpiece or intermediate product, to thereby improve the supplemental bending accuracy while avoiding damaging of the product due to the supplemental bending.

It is a second object of the invention to provide an apparatus for determining supplemental bending parameters for effecting a supplemental bending operation on an already or initially bent workpiece, at a position different from the initial bending position.

The first object may be achieved according to a first aspect of this invention, which provides a method of effecting a supplemental bending operation on an initially bent workpiece which has a centerline extending between opposite ends thereof and which has been subjected to an initial bending operation at an initial bending position selected along the centerline, the supplemental bending operation being effected for correcting a relative position between the opposite ends of the initially bent workpiece, the method comprising the steps of: (a) determining an actual relative position between the opposite ends of the initially bent workpiece, and determining, on the basis of the determined actual relative position, a value of each of at least one supplemental bending parameter used for effecting the supplemental bending operation on the initially bent workpiece for reducing an error between the actual relative position and a nominal relative position between opposite ends of a product to be obtained by the supplemental bending operation, the at least one supplemental bending parameter consisting of at least one of a supplemental bending position and a supplemental bending amount which has not been determined yet, the supplemental bending position being different from the initial bending position, and the supplemental bending amount being an amount of bending of the workpiece by the supplemental bending operation at the supplemental bending position; and (b) performing the supplemental bending operation at the determined supplemental bending position, so as to achieve the determined supplemental bending amount.

The workpiece may take the form of a bar or a wire as well as a tubular member such as a pipe, and may have any cross sectional shape such as a triangular, rectangular or polygonal shape, as well as a circular shape.

The workpiece may be bent into a desired final or end product, such as not only a branch of an intake or exhaust manifold of an engine, but also a surge tank of an engine, any other component of a motor vehicle, and any component of any machine other than the motor vehicle.

The term "supplemental bending position" is interpreted to mean (i) only the position in a linear direction parallel to the centerline of the workpiece, where the supplemental bending operation is effected by changing only a relative position between the workpiece and a bending apparatus in the above-identified linear direction, without changing the relative position in a rotational direction about the centerline of the workpiece, (ii) only the position in the rotational direction, where the supplemental bending operation is effected by changing only the relative position in the rotational direction, without changing the relative position in the above-identified linear direction, or (iii) both the position in the above-indicated linear direction and the position in the rotational direction, where the supplemental bending operation is effected by changing the relative positions in the linear and rotational directions.

The phrase "at least one of a supplemental bending position and a supplemental bending amount which has not been determined yet" is interpreted to mean (i) that both the supplemental bending position and the supplemental bending amount are determined, where both of these two parameters have not been determined as known supplemental bending parameters, (ii) that only the supplemental bending amount is determined, where the supplemental bending position has already been determined as a known supplemental bending parameter, or (iii) that only the supplemental bending position is determined, where the supplemental bending amount has already been determined as a known supplemental bending parameter.

The term "supplemental bending operation" may be selected from among press bending, tension bending, push bending, roll bending, and pull bending, for example. The "press bending" generally means an operation in which the workpiece is supported by two spaced-apart stationary dies and is bent by a movable die which is moved in between the stationary dies while pressing a portion of the workpiece between the two stationary dies. The "tension bending" generally means an operation in which the workpiece is forced against a shaped bending die and is thus bent while a tensile force is applied to the workpiece in the direction of the centerline. The "push bending" generally means an operation in which the workpiece is forced against a stationary shaped bending die by a movable pressure die and is thus bent. The "roll bending" generally means an operation in which the workpiece is bent while it is nipped by three driven rolls. The "pull bending" generally means an operation in which the workpiece is clamped by and between a shaped bending die and a clamping die and is bent by rotation of the bending and clamping die while the workpiece is held between the bending die and a pressure die, as in a bending machine constructed according to a preferred embodiment of the invention described later.

In the supplemental bending method of the present invention, the value of each of the supplemental bending position and/or the supplemental bending amount which has/have not been determined is first determined as the information necessary to effect the supplemental bending operation, on the basis of the determined actual relative position between the opposite ends of the initially bent workpiece. Then, the supplemental bending operation is performed on the initially bent workpiece at the determined supplemental bending position, so as to achieve the determined supplemental bending amount.

Thus, the present supplemental bending method is formulated to correct the initially bent workpiece by directly considering the actual positional relationship of the opposite ends of the initially bent workpiece, whereby the accuracy of the supplemental bending operation is easily improved. Further, the supplemental bending operation is effected at the supplemental bending position which is different from the initial bending position, that is, which is spaced from the initial bending position in at least one of the linear direction parallel to the workpiece centerline and the rotational direction about the centerline. Therefore, the present method prevents damaging of the initially bent workpiece or end product due to the supplemental bending operation.

In a preferred form of the present method, the step of determining a value of each of at least one supplemental bending parameter comprises: determining a plurality of provisional values of each of the supplemental bending position and the supplemental bending amount; and obtaining an estimated relative position between the opposite ends of the product to be obtained by the supplemental bending operation, for each of a plurality of combinations of the provisional values of the supplemental bending position and amount, and selecting, as supplemental bending parameters, one of the plurality of combinations of the provisional values of the supplemental bending position and amount, which one combination permits an error between the estimated relative position and the nominal relative position to be smaller than a predetermined threshold.

According to a first advantageous feature of the above preferred form of the invention, a difference between the adjacent provisional values of the supplemental bending position and/or amount is changed on the basis of an amount of the error between the estimated and nominal relative positions. For example, the difference between the adjacent provisional values (namely, an amount of change or increment or decrement of the provisional value) is made larger when the error amount is relatively large than when the error amount is relatively small. Generally, it is desirable to change the provisional value of the supplemental bending parameter by a large amount when the error amount is relatively large. If the difference between the adjacent provisional values or the amount of change of the provisional value was constant, a relatively large number of combinations of the provisional values of the supplemental bending position and amount should be considered to check the error amount before the error amount is reduced to a value smaller than the predetermined threshold. To reduce the time required for determining the value of each supplemental bending parameter, the amount of change of the provisional value is desirably larger when the error amount is relatively large than when the error amount is relatively small.

According to a second advantageous feature of the above preferred form of the invention, the step of determining a plurality of provisional values of each of the supplemental bending position and amount comprises: determining a plurality of first provisional values of each of the supplemental bending position and amount, which first provisional values are different from each other by a predetermined value; determining whether none of a plurality of first combinations of the first provisional values of the supplemental bending position and amount permits the error to be smaller than the predetermined threshold; and if none of the plurality of first combinations permits the error to be smaller than the predetermined threshold, selecting two values of the first provisional values of each of the supplemental bending position and amount which two values define an area which is expected to include a value that permits the error to be smaller than the predetermined threshold, and dividing the area into equal divisions to determine a plurality of second provisional values which are then considered to check if the error is smaller than the predetermined threshold.

The "predetermined value" of the first provisional values may be directly determined and set by the operator of the bending apparatus adapted to effect the initial and supplemental bending operations, or may alternatively be determined indirectly by determining the number of divisions of an initial or first variation range in which the first provisional value is incremented or decremented. In the latter case, the first provisional values are automatically determined by dividing the initial variation range by the predetermined number of divisions.

If none of the first combinations of the first provisional values of the supplemental bending position and amount permits the error to be smaller than the predetermined threshold, the second variation range is determined by the two values of the first provisional values of each of the supplemental bending position and amount which define an area which is expected to include a value that permits the error to be smaller than the predetermined threshold. The determined second variation range is divided into equal divisions to determine a plurality of second provisional values. The thus determined second provisional values are then considered to check if the error is smaller than the predetermined threshold. In the present second advantageous feature of the first preferred form of the invention, the range in which the provisional value is incremented or decremented is narrowed if any one of the first combinations of the first provisional values of the supplemental bending position and amount does not permit the error between the estimated and nominal relative positions to be smaller than the predetermined threshold. This arrangement is advantageous over the arrangement in which the provisional values are repeatedly changed within the predetermined constant range. The present arrangement is adapted to increment or decrement the provisional value within the narrowed range when the determination of the optimum supplemental bending position and amount is repeated after the failure to determine the optimum values with the initial range. Thus, the present arrangement is effective to reduce the number of the provisional values that should be examined before the error is reduced to the value smaller than the threshold, and is therefore effective to further reduce the time required for determining the optimum supplemental bending position and amount as the supplemental bending parameters.

The second object indicated above may be achieved according to a second aspect of this invention, which provides an apparatus for determining supplemental bending information for effecting a supplemental bending operation on an initially bent workpiece which has a centerline extending between opposite ends thereof and which has been subjected to an initial bending operation at an initial bending position selected along the centerline, the supplemental bending operation being effected for correcting a relative position between the opposite ends of the initially bent workpiece, the apparatus comprising: (a) relative position obtaining means for obtaining an actual relative position between the opposite ends of the initially bent workpiece; and (b) supplemental bending information determining means for determining, on the basis of the actual relative position, a value of each of at least one of a supplemental bending position and a supplemental bending amount which has not been determined yet, the supplemental bending position being different from the initial bending position, and the supplemental bending amount being an amount of bending of the workpiece by the supplemental bending operation at the supplemental bending position.

The terms "workpiece" and "supplemental bending position" and the phrase "at least one of a supplemental bending position and and a supplemental bending amount which has not been determined yet" should be interpreted to have the meaning which has been described above with respect to the method according to the first aspect of the present invention.

In the present bending apparatus according to the second aspect of this invention, the actual relative position between the opposite ends of the initially bent workpiece is directly taken into account in determining the supplemental bending information, that is, supplemental bending position and/or amount which has or have not been determined yet. Further, the supplemental bending position to be determined by the present apparatus is different from the initial bending position at which the blank is bent to produce the initially bent workpiece. Therefore, the present apparatus permits the supplemental bending operation to be performed with improved accuracy while avoiding damaging of the workpiece or product.

BRIEF DESCRIPTION OF TEE DRAWINGS

The above and optional objects, features, advantages, and technical significance of the present invention will be better understood by reading the following detailed description of presently preferred embodiments of the invention, when considered in connection with the accompanying drawings, in which:

FIG. 3 is a side elevational view of the bending system of FIG. 1;

FIG. 4 is a flow chart schematically indicating a supplemental bending operation to be performed on an already bent workpiece;

FIG. 12 is a view indicating a normal line vector A used for defining the outlet end of the pipe of FIG. 10;

FIG. 13 is a block diagram schematically illustrating an arrangement of a controller provided in the bending system of FIG. 1;

Figure 10:
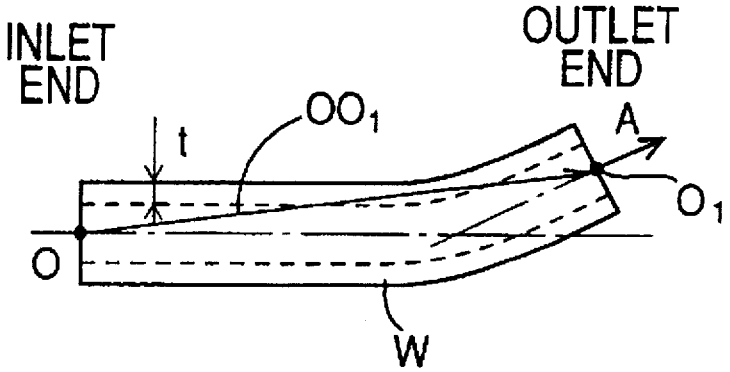
FIG. 10 is a front elevational view of the workpiece in the form of a pipe, indicating a method of defining the position of an outlet end of the pipe.
Figure 14:
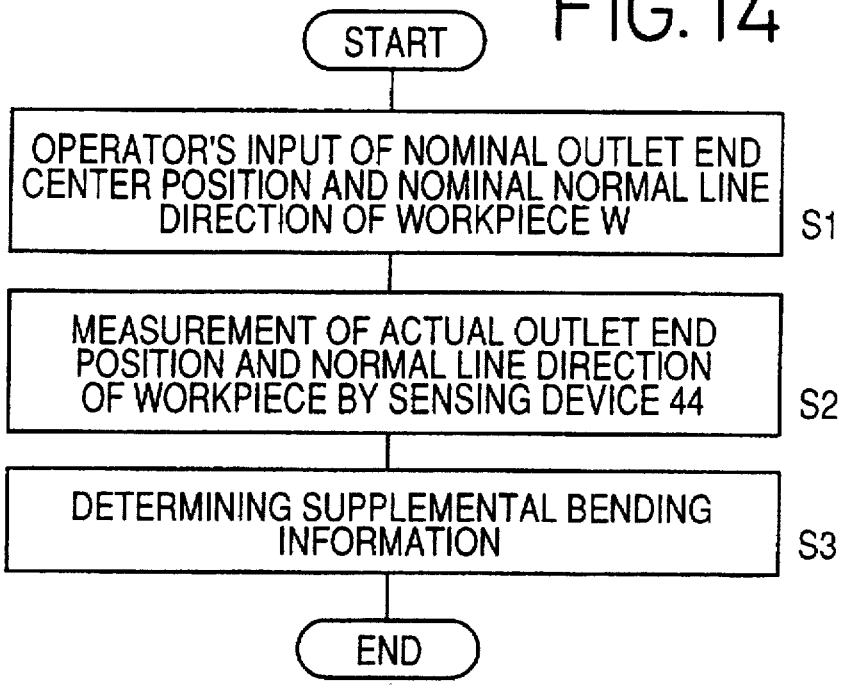
FIG. 14 is a flow chart schematically indicating a supplemental bending information determining routine whose program is stored in a read-only memory of the controller of FIG. 13.
Figure 15:
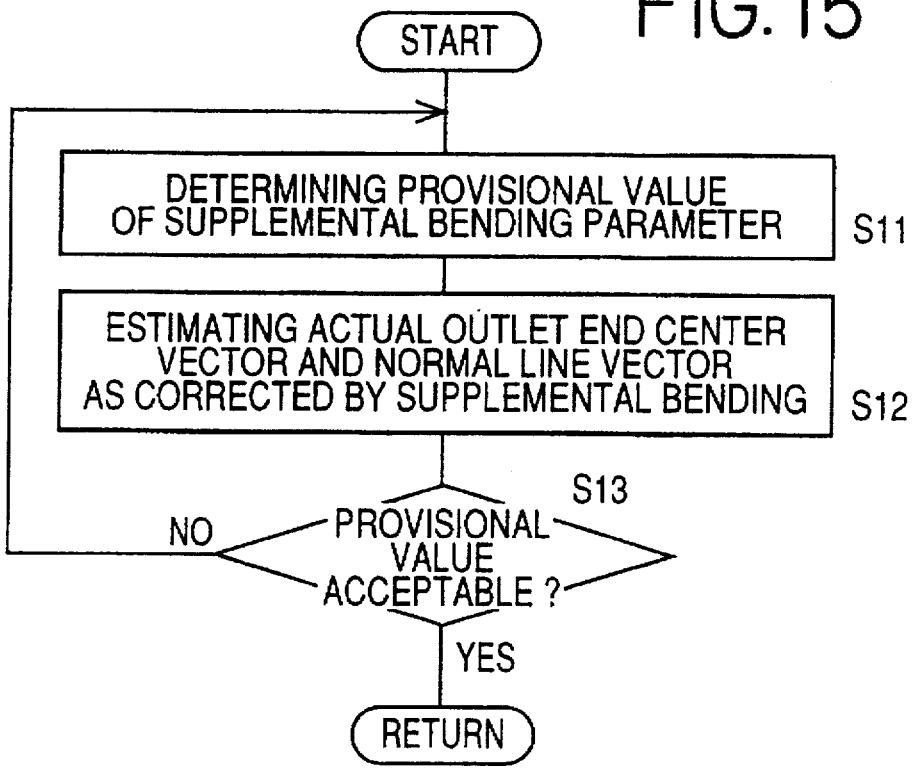
FIG. 15 is a flow chart indicating details of step S3 of the routine of FIG. 14.
Figure 16:
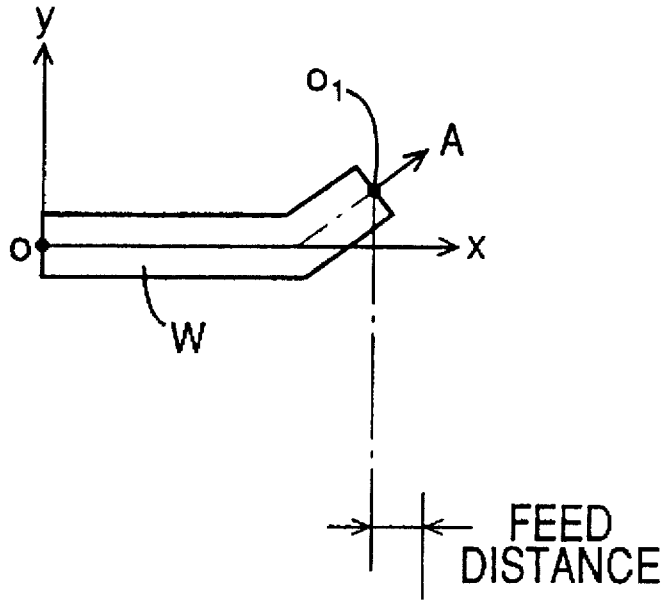
Figure 16:
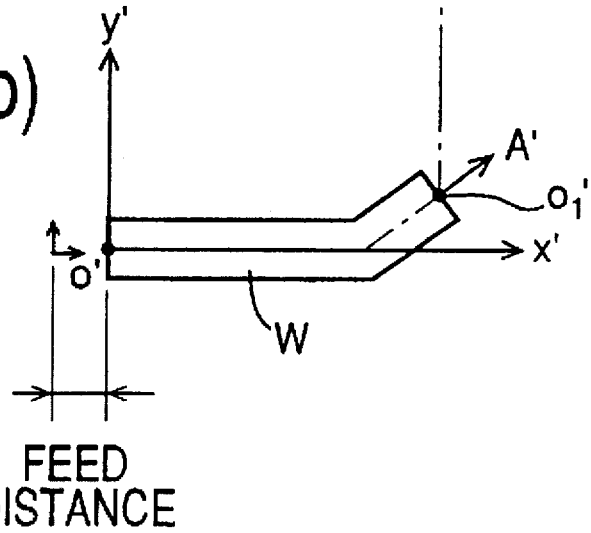
Figure 17A:
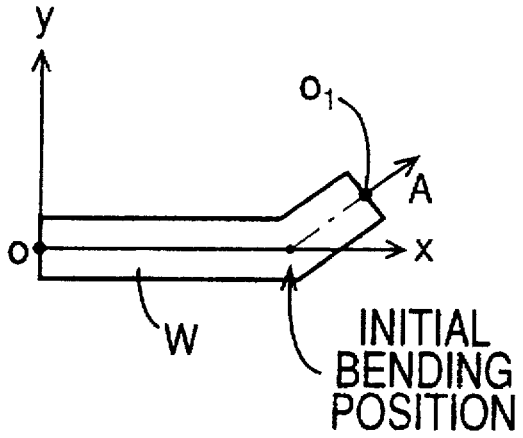
Figure 17B:
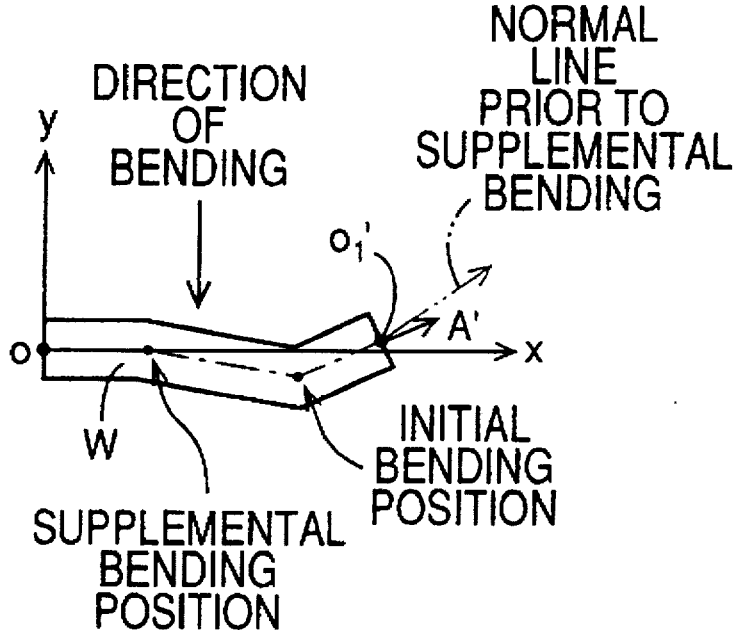
Figure 18A:
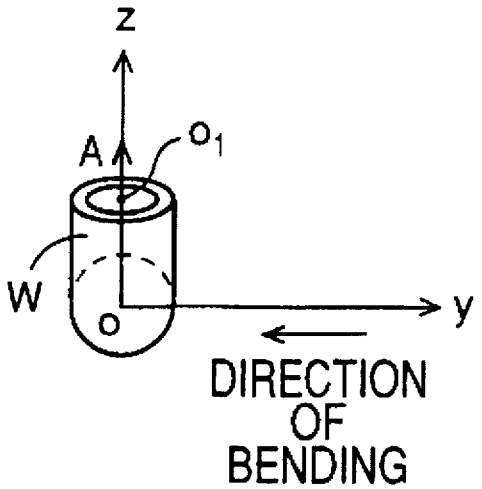
Figure 18B:
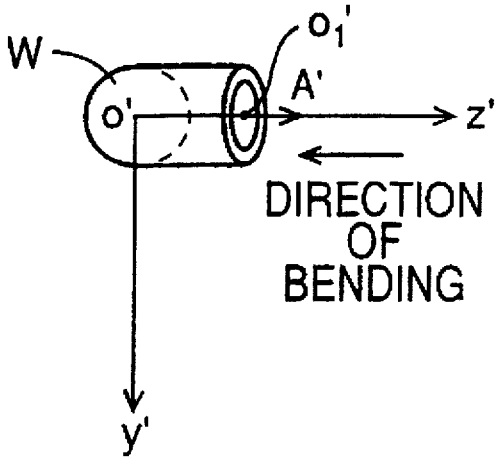
Figure 19:
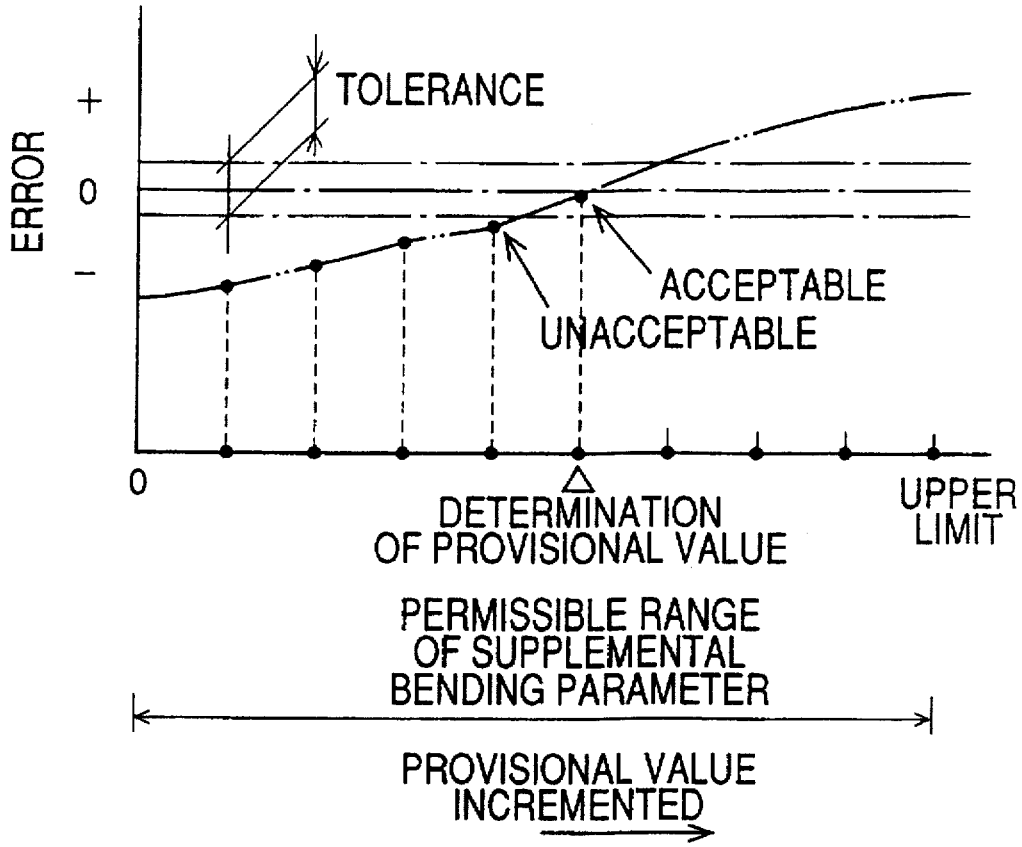
Figure 20:
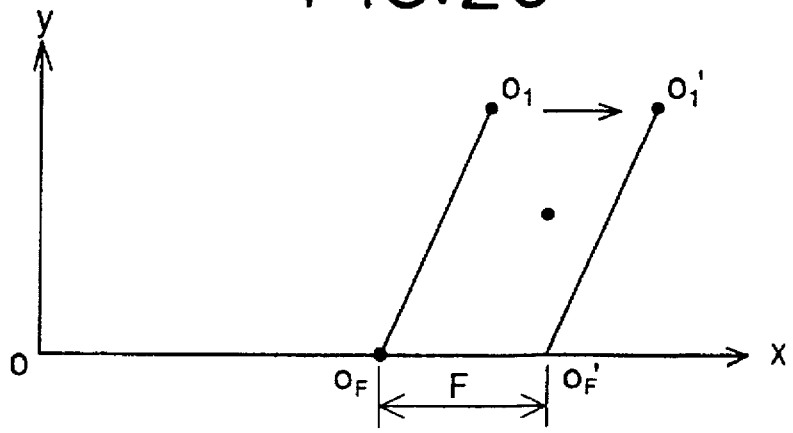
Figure 23:
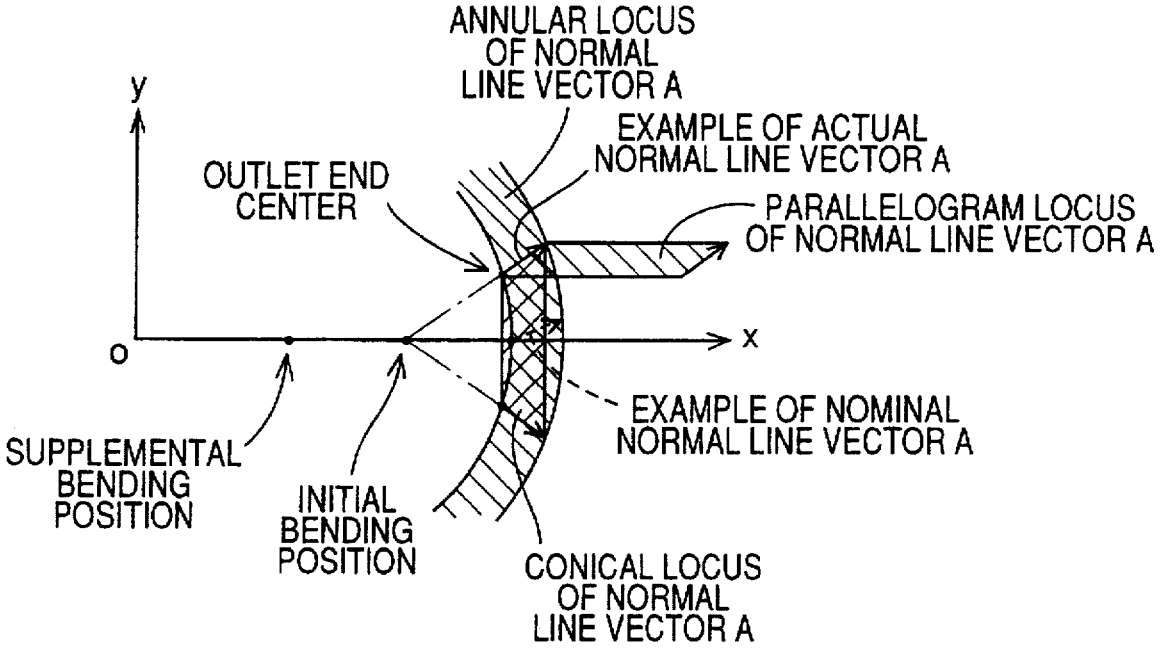
Figure 24:
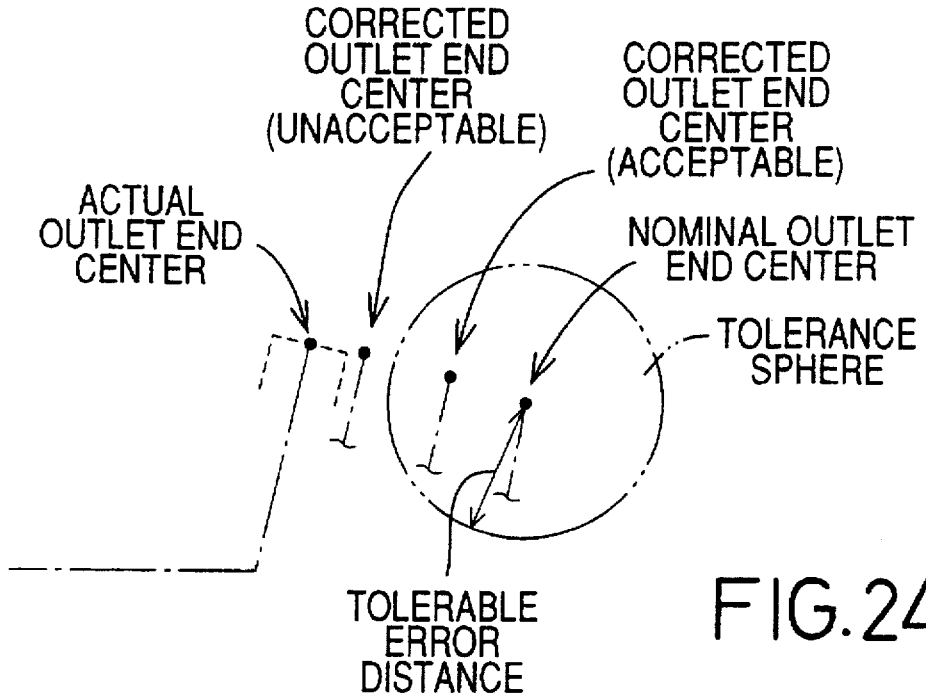
Figure 25:
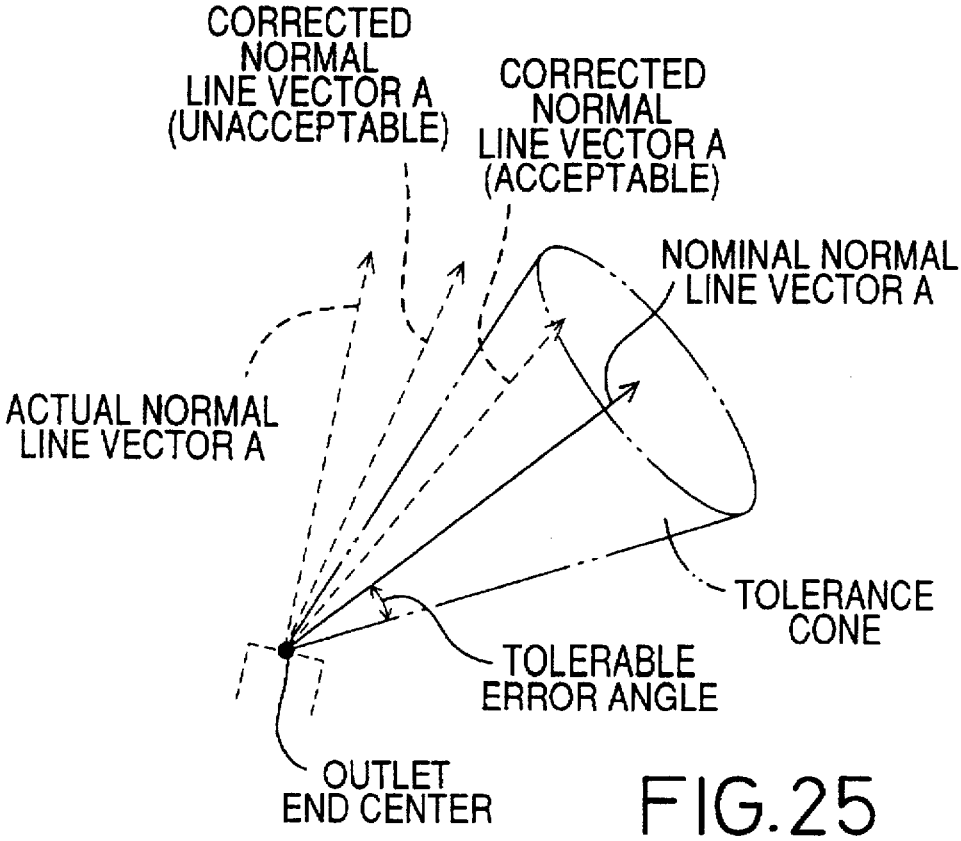
Figure 26:
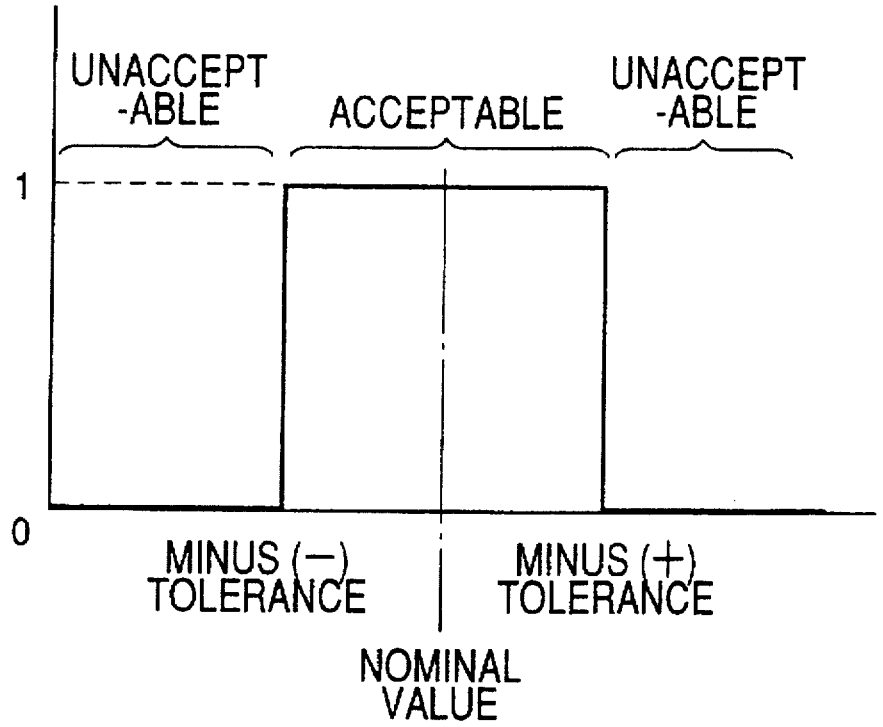
Figure 27:
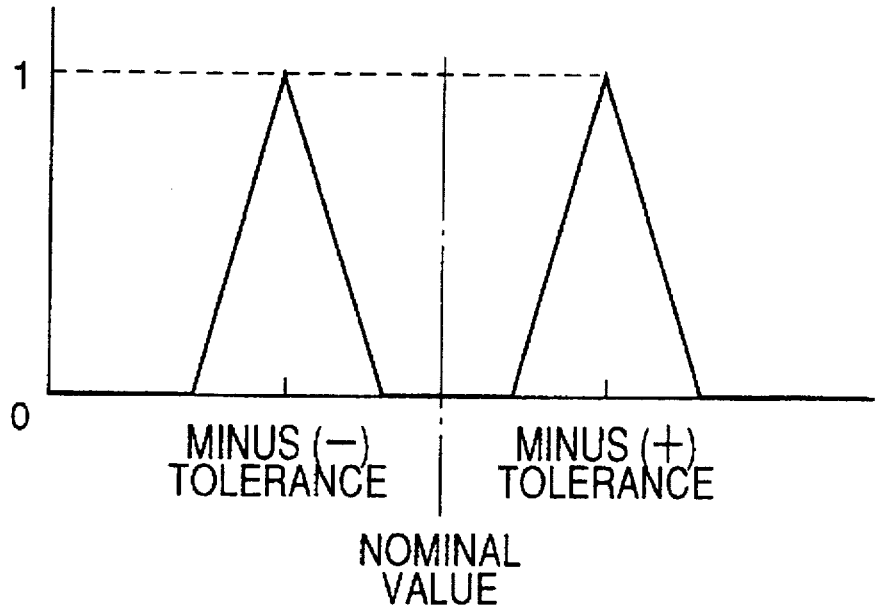
Figure 28:
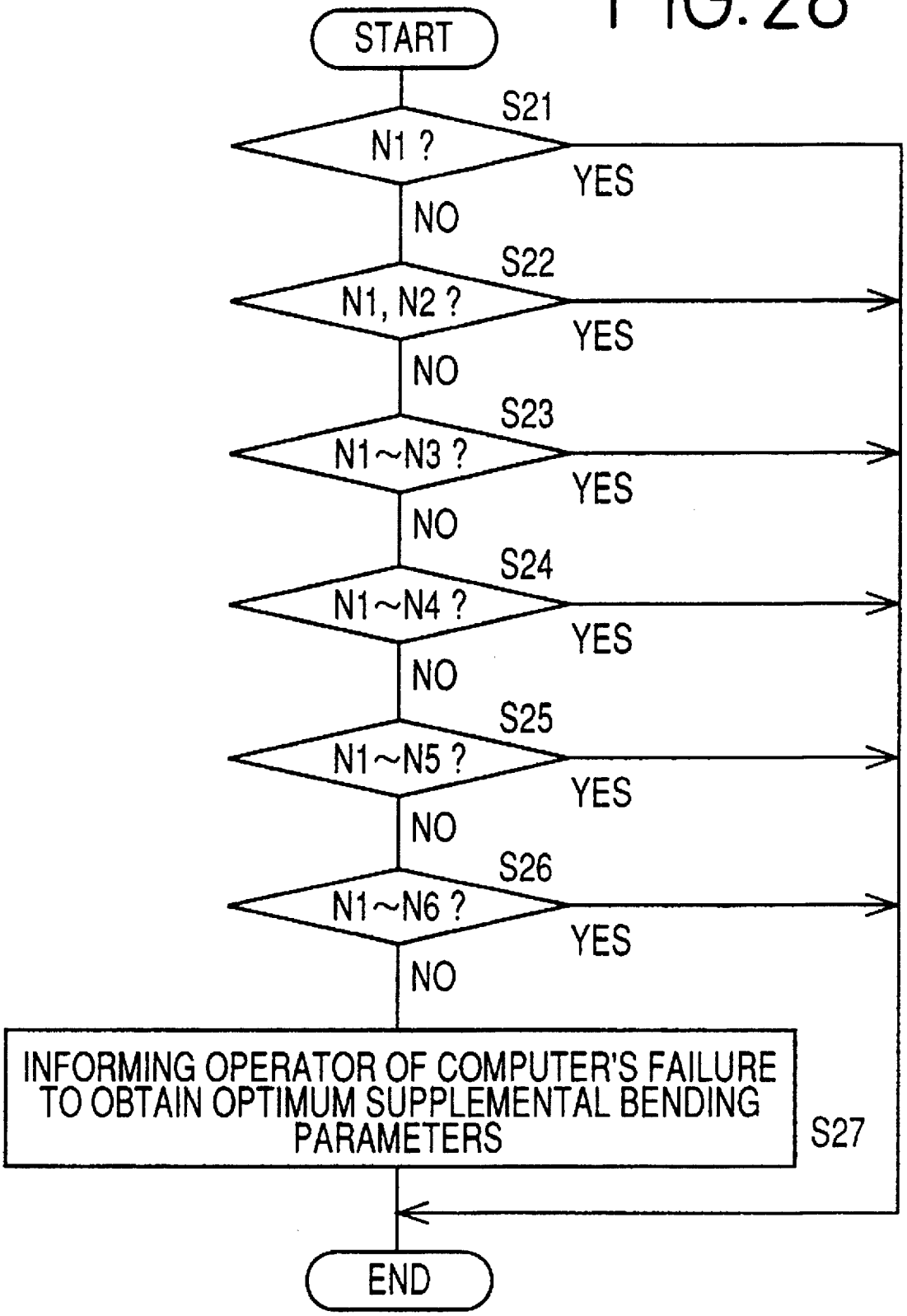
Figure 29:
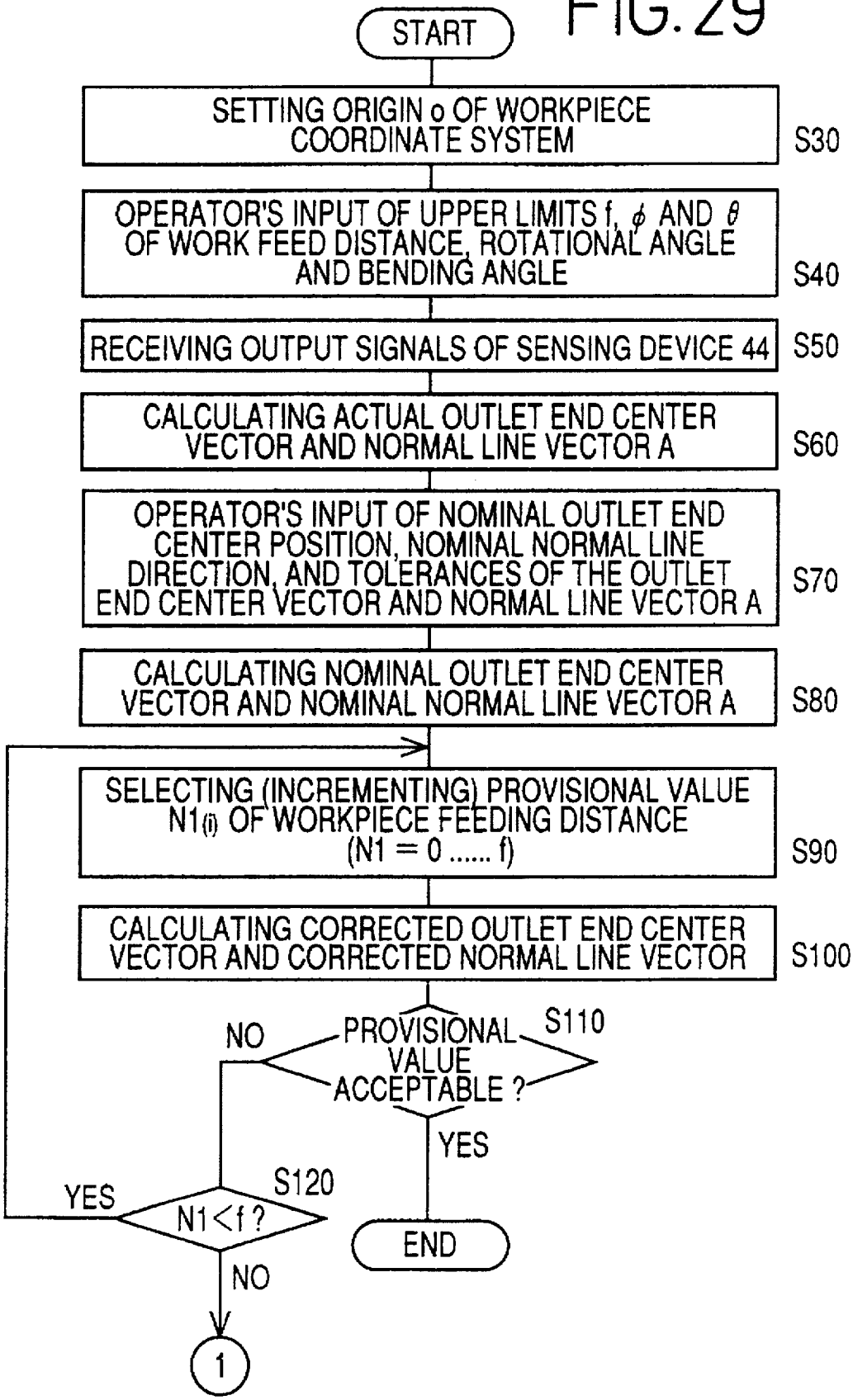
Figure 30:
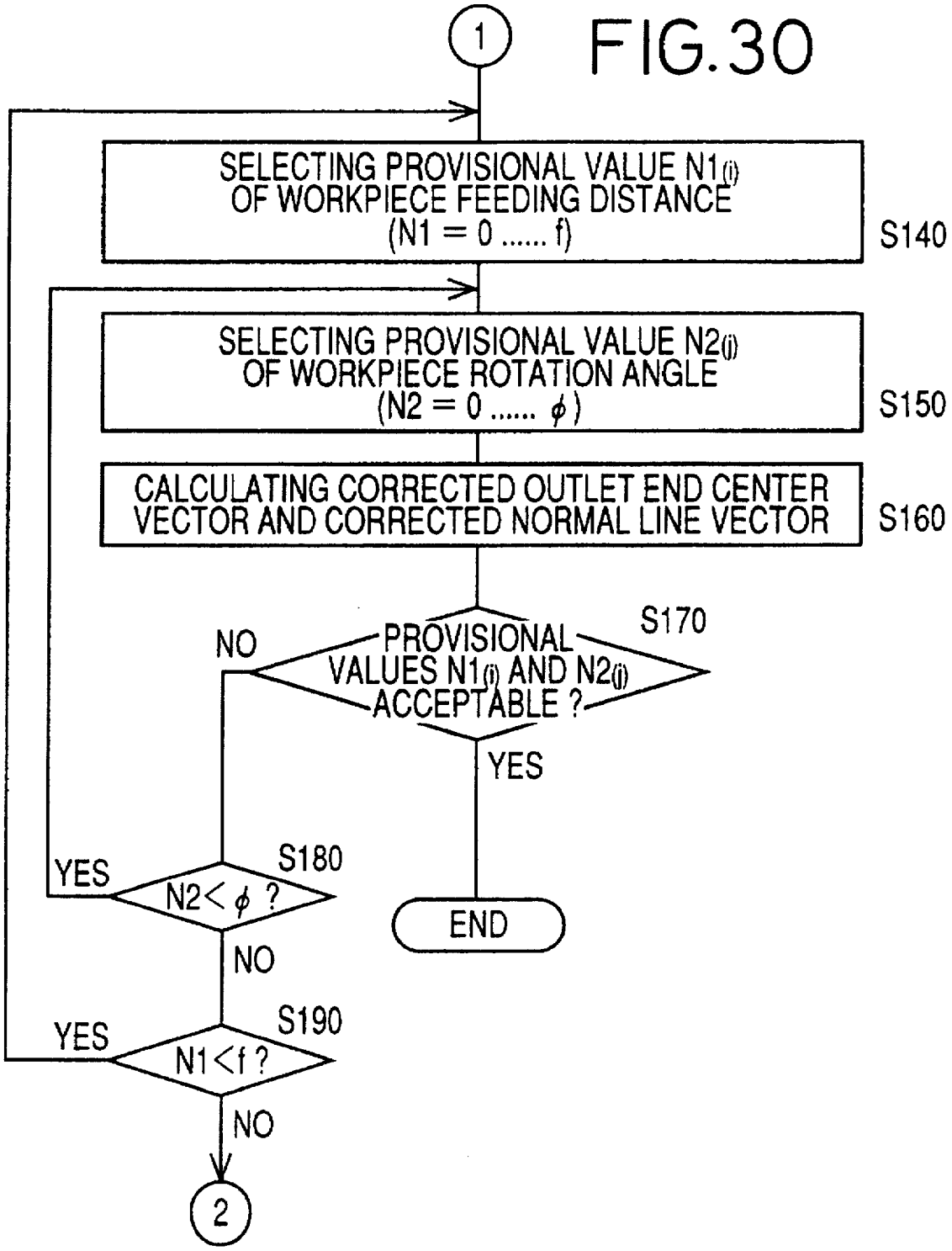
Figure 31:
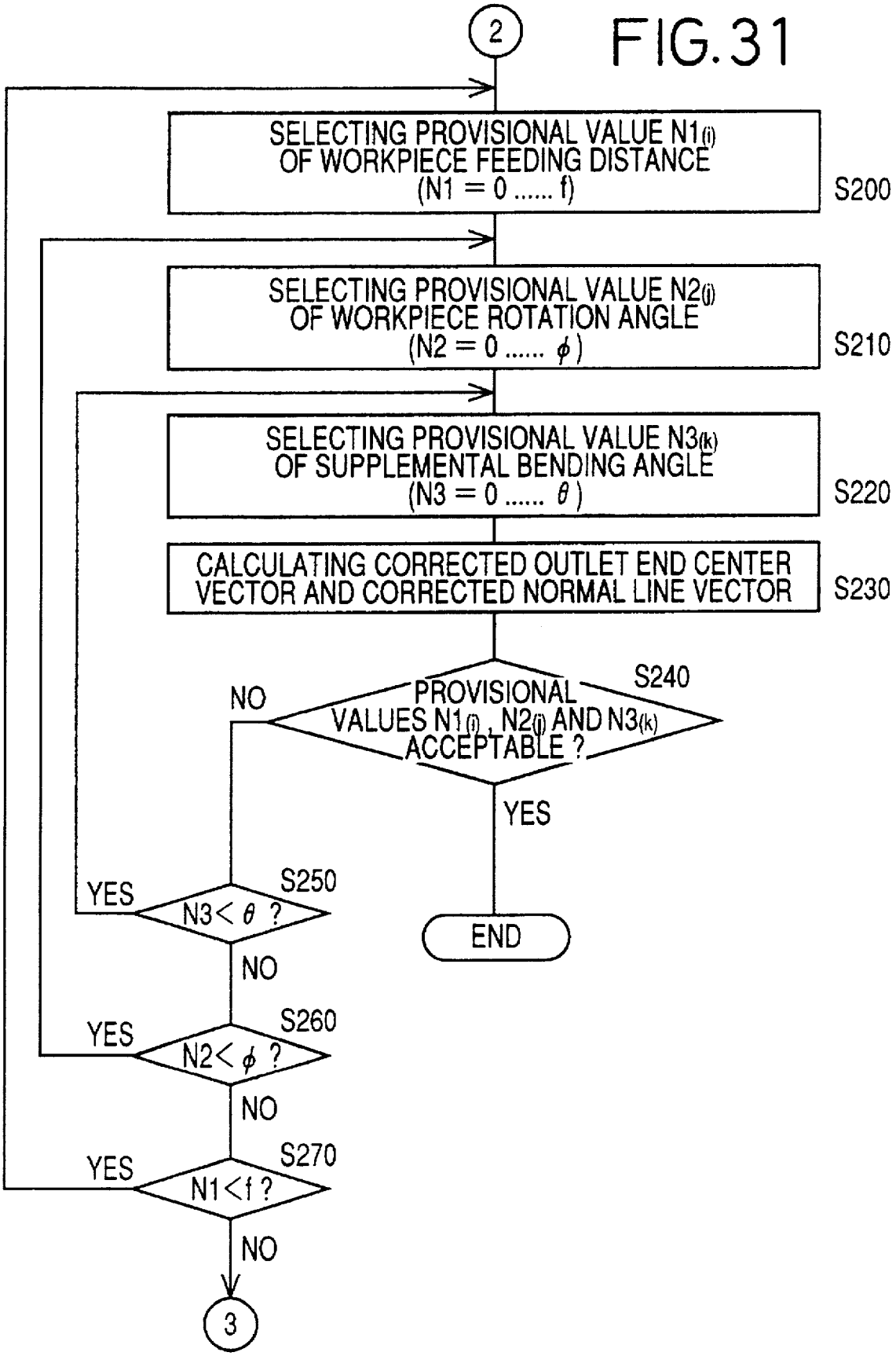
Figure 32:
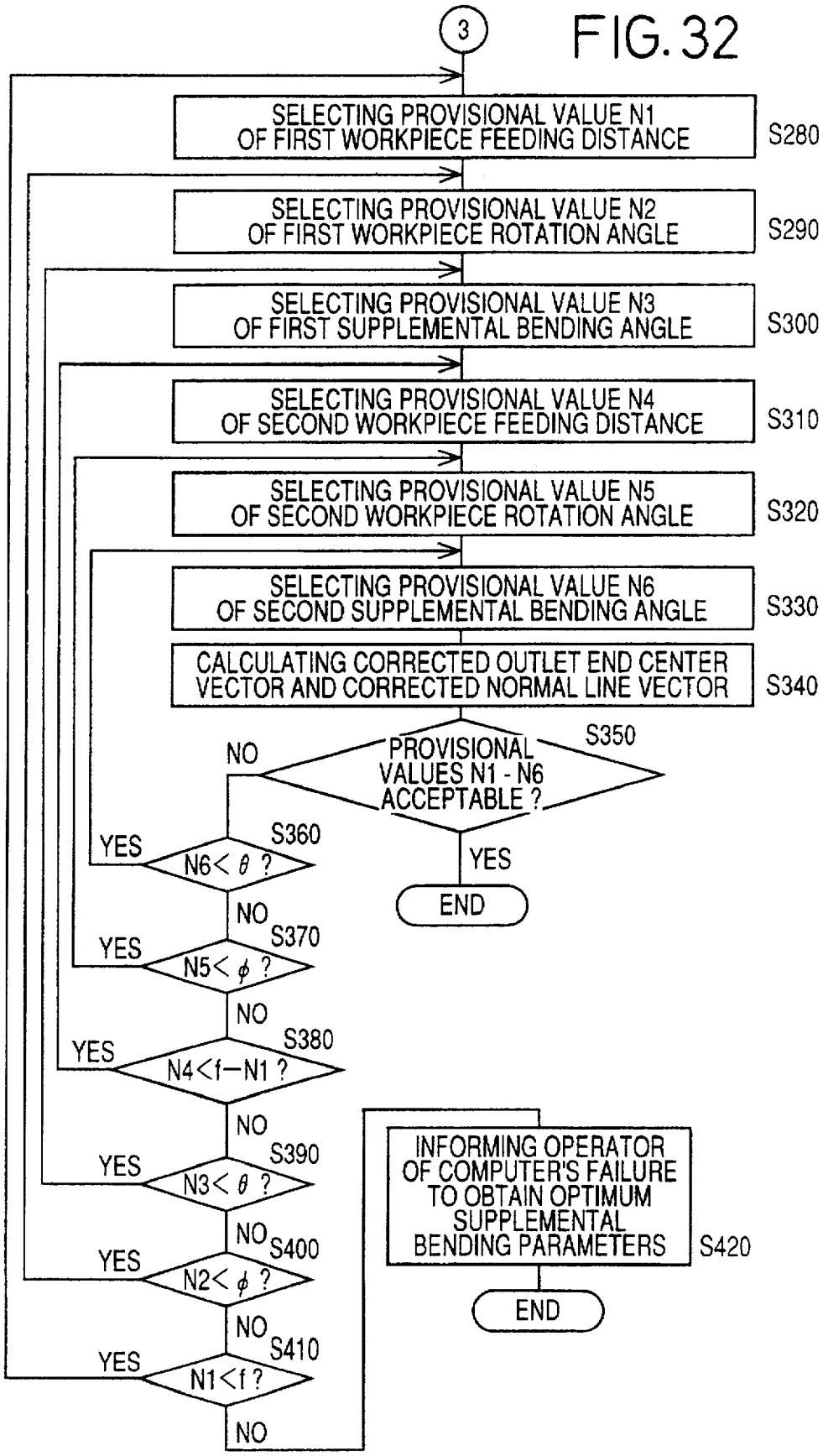
Figure 33:
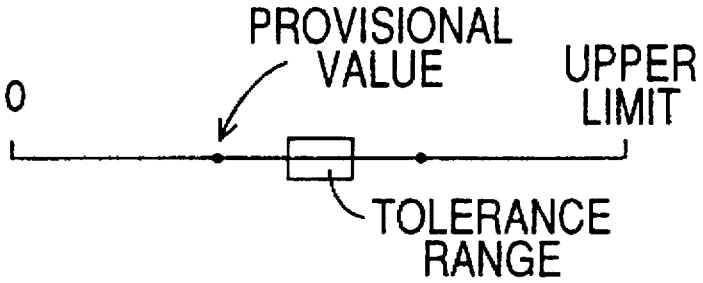
Figure 33:
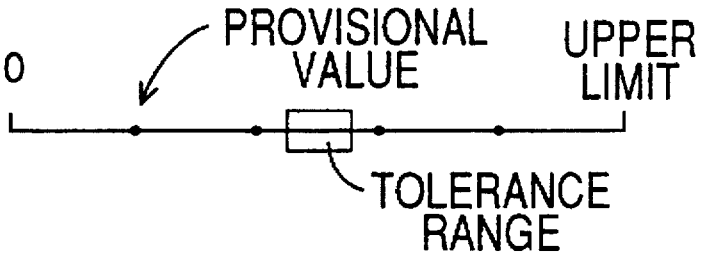
Figure 33:
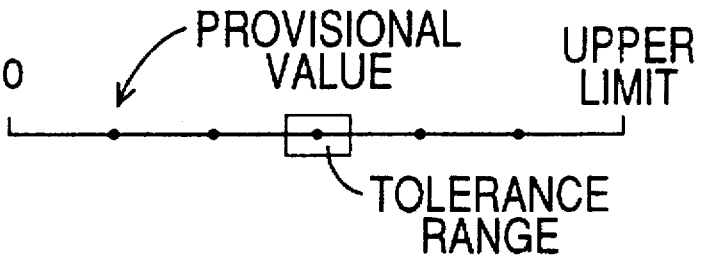
Figure 35A:
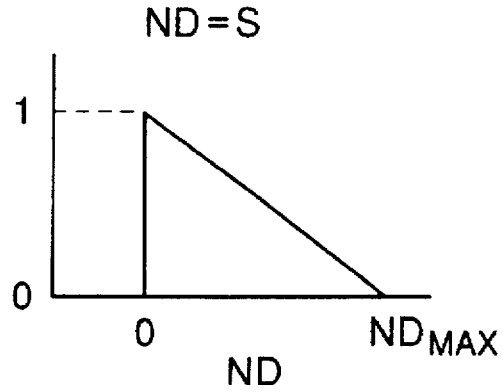
Figure 35B:
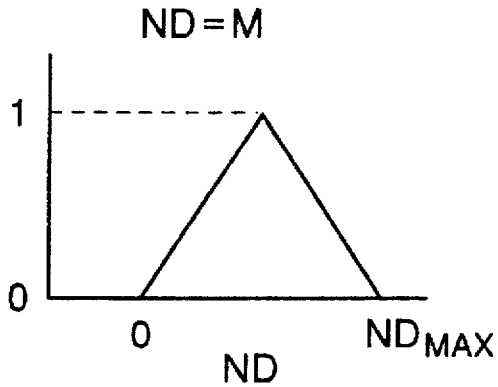
Figure 35C:
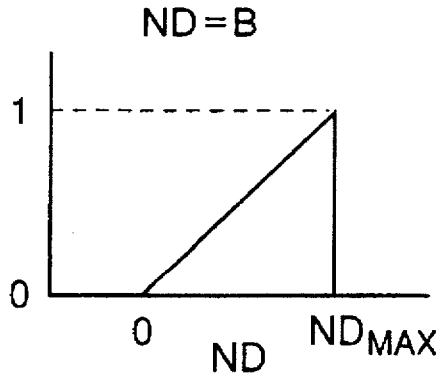
Figure 36:
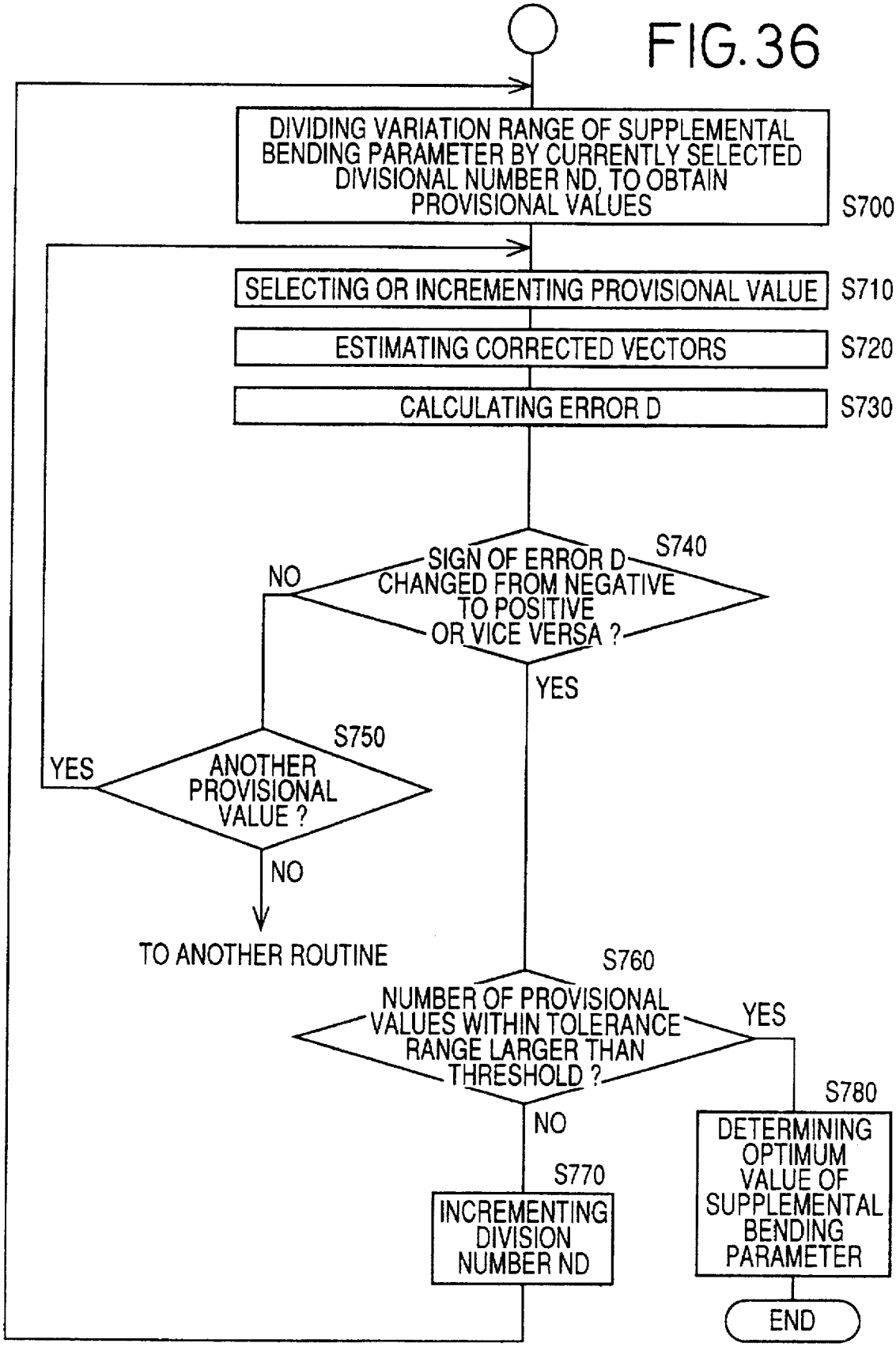
Figure 37A:
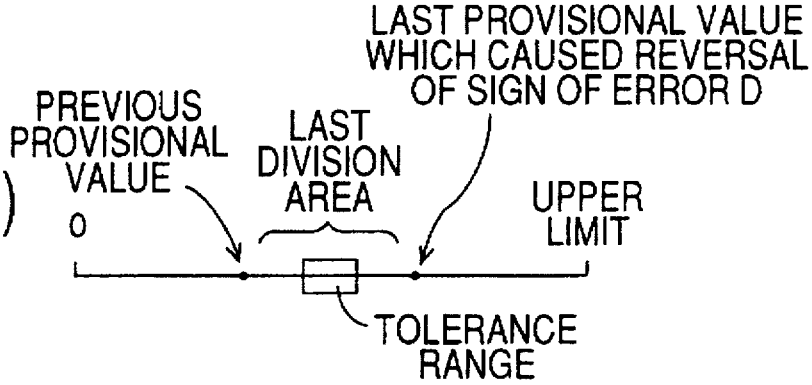
Figure 37B:
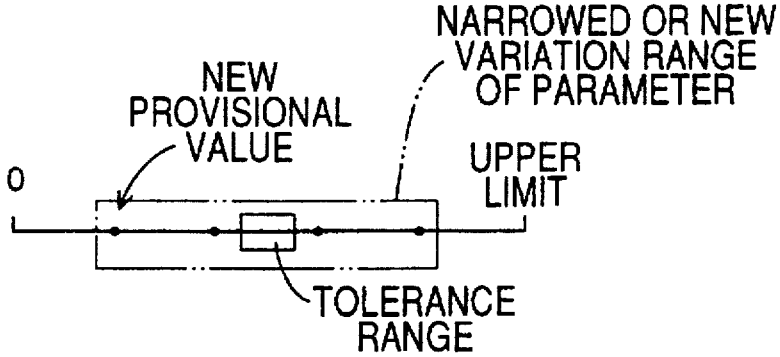
Figure 37C:
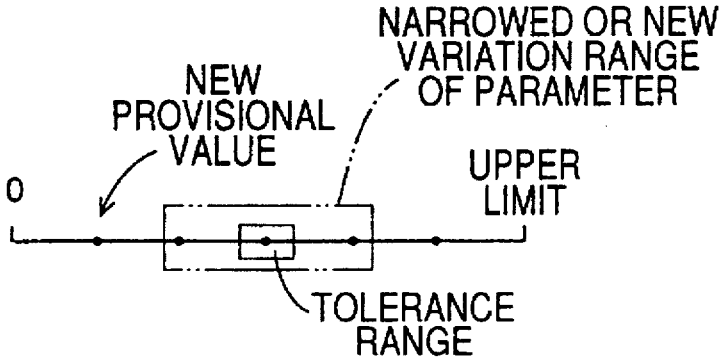
Figure 38:
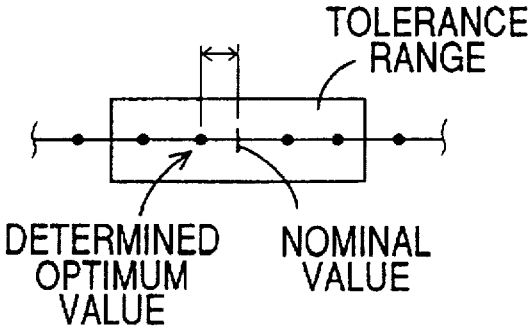
Figure 39:
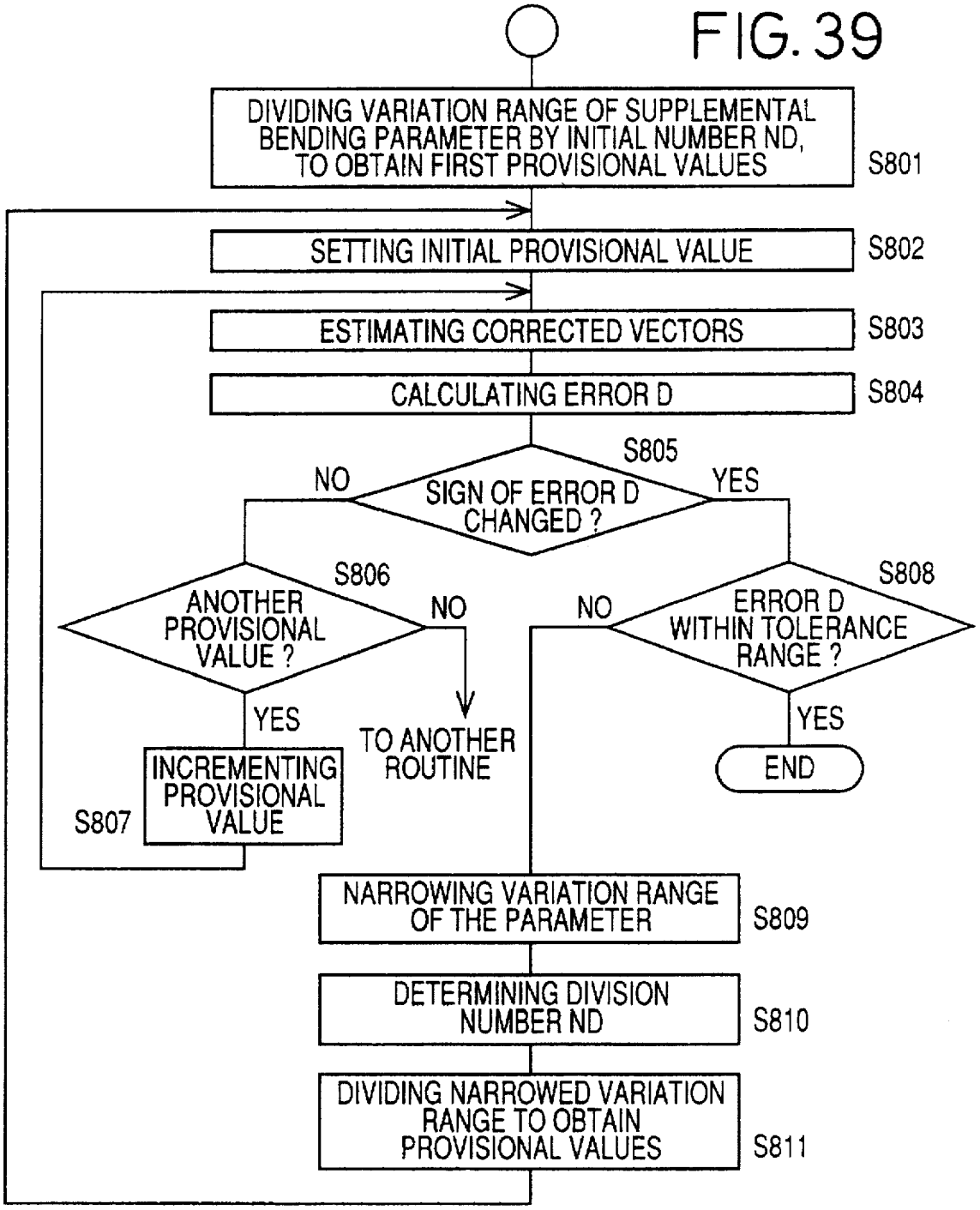
Figure 40:
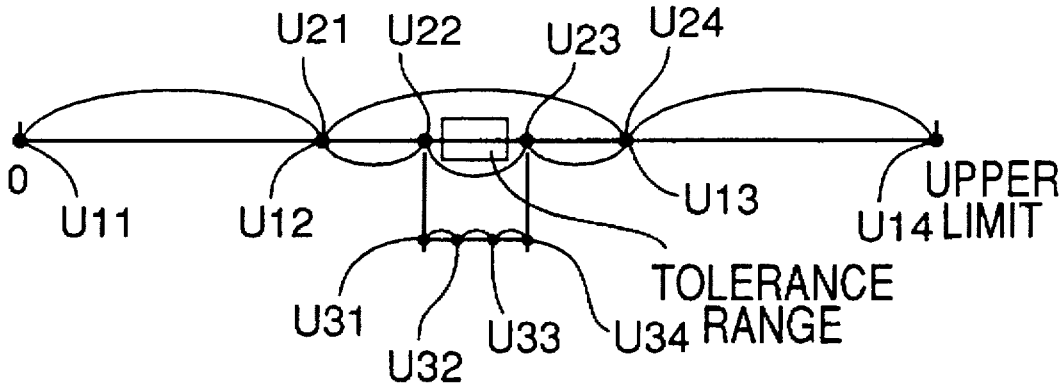
Figure 41:
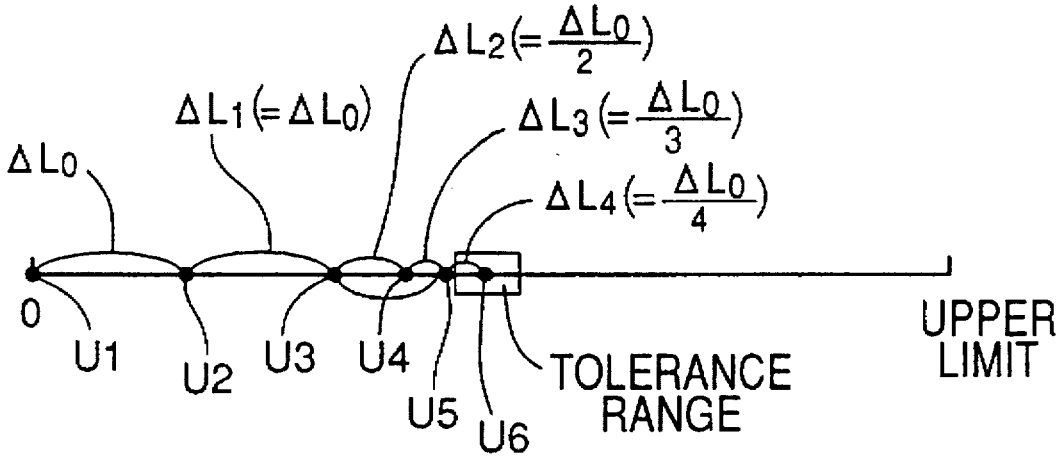
Figure 42:
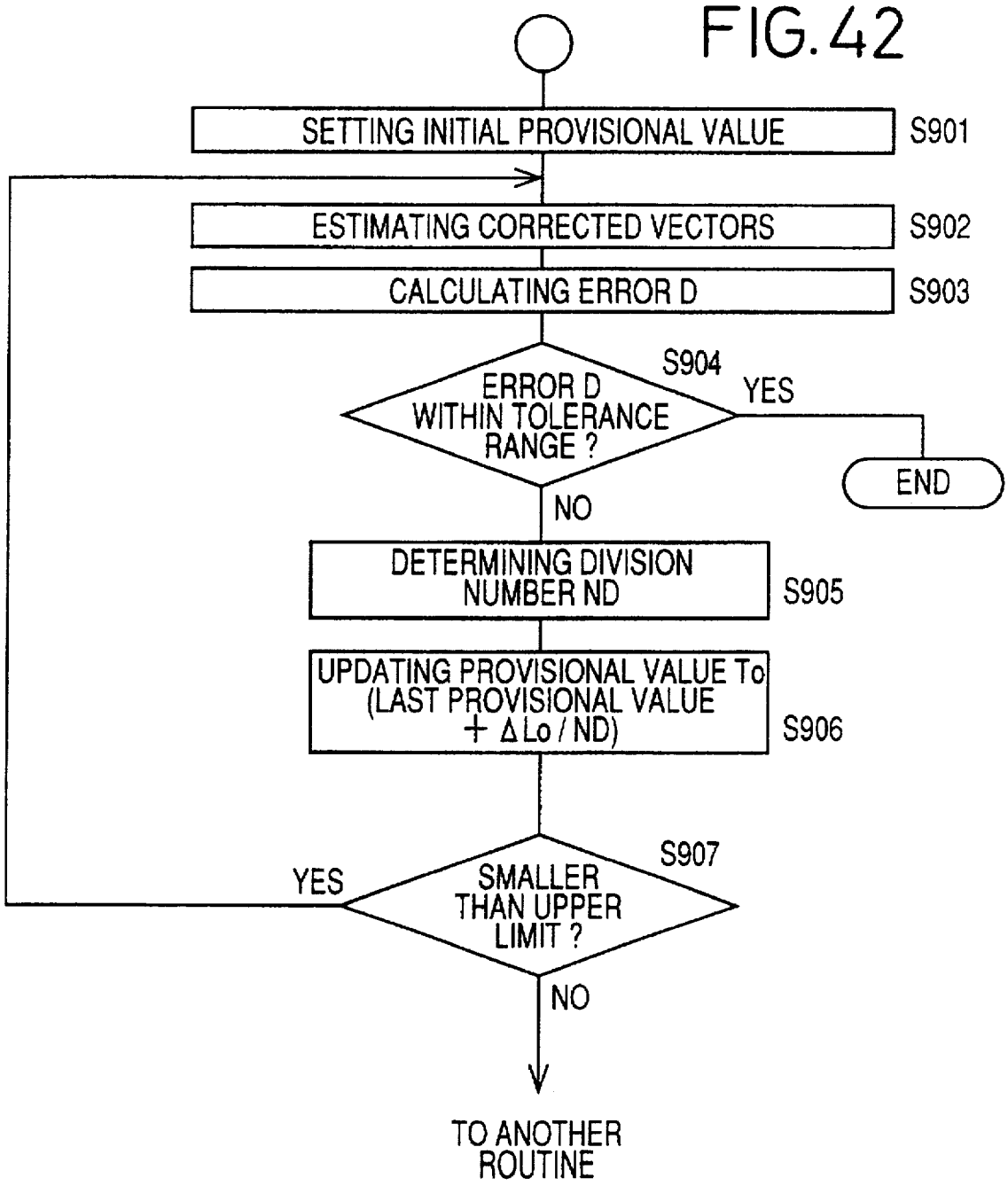
Figure 43:
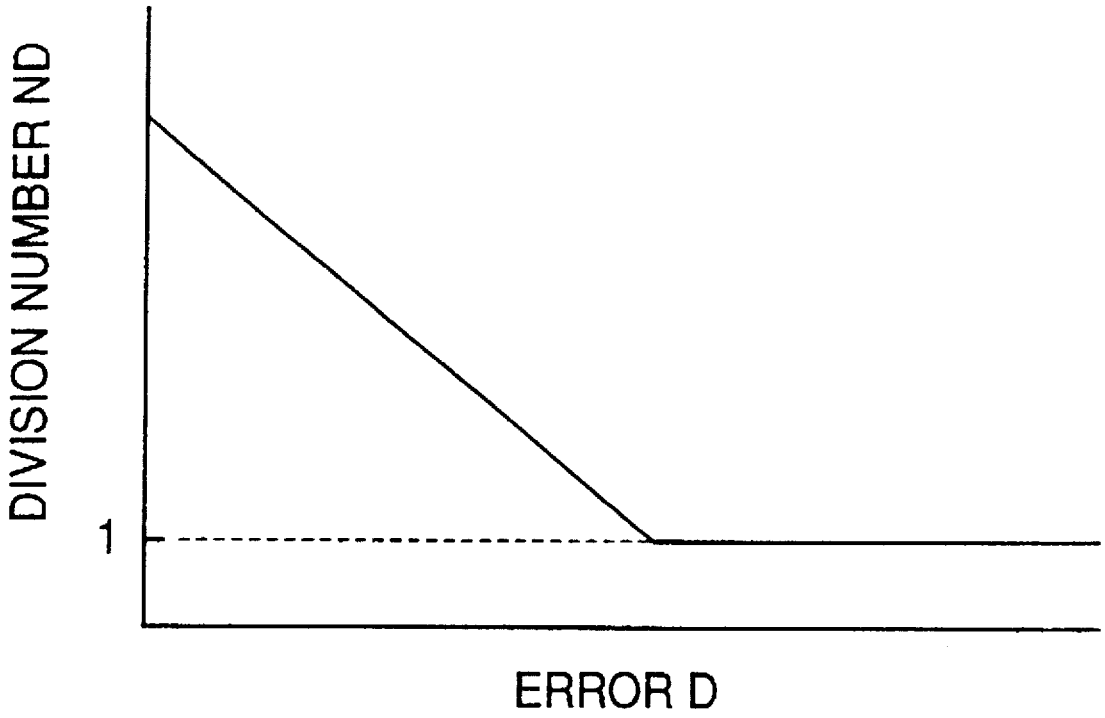

FIGS. 16(*a*) and 16(*b*) are elevational views of the pipe of FIG. 10, for explaining a feeding movement of the pipe to a supplemental bending position;

FIGS. 17(*a*) and 17(*b*) are plan views of the pipe, for explaining supplemental bending of the pipe effected after initial bending;

FIGS. 18(*a*) and 18(*b*) are elevational views of the pipe, for explaining rotation of the pipe about its centerline;

FIG. 19 is a graph for schematically explaining a concept of step S13 of the flow chart of FIG. 15;

FIG. 20 is a view for explaining the feeding of the pipe in the workpiece coordinate system;

FIG. 21 is a view for explaining the rotation about its centerline of the pipe in the workpiece coordinate system;

FIG. 22 is a view for explaining the bending of the pipe in the workpiece coordinate system;

FIG. 23 is a view for explaining a reason why the supplemental bending is possible at two different positions of the workpiece;

FIG. 24 is a view indicating an example of a method of determining whether a corrected position of the outlet end center of the pipe of FIG. 10 to be obtained by supplemental bending is tolerably close to a nominal position;

FIG. 25 is a view indicating an example of a method of determining whether a corrected normal line vector at the outlet end of the pipe to be obtained by supplemental bending is tolerably close to a nominal normal line vector;

FIG. 26 is a graph for explaining an example of a method of determining whether a corrected value to be obtained by supplemental bending is tolerably close to a nominal value;

FIG. 27 is a graph for explaining another example alternative of that of FIG. 26;

FIG. 28 is a flow chart showing details of the supplemental bending information determining routine of FIG. 14 according to a first embodiment of this invention;

FIG. 29 is a flow chart showing details of step S21 of FIG. 28;

FIG. 30 is a flow chart showing details of step S22 of FIG. 28;

FIG. 31 is a flow chart showing details of step S23 of FIG. 28;

FIG. 32 is a flow chart showing details of steps S26 and S27 of FIG. 28;

FIGS. 33(*a*), 33(*b*) and 33(*c*) are views for explaining a principle of determining whether a supplemental bending parameter is acceptable or not, according to a second embodiment of the invention;

FIG. 34 is a flow chart illustrating a supplemental bending information determining routine used in the embodiment of FIG. 33;

FIGS. 35(*a*), 35(*b*) and 35(*c*) are graphs indicating membership functions for determining by fuzzy inference the number of divisions to obtain provisional values of a supplemental bending parameter, in the second embodiment of FIGS. 33 and 34;

FIG. 36 is a flow chart illustrating a supplemental bending information determining routine used in a third embodiment of the present invention;

FIGS. 37(*a*), 37(*b*) and 37(*c*) and FIG. 38 are views for explaining a principle of determining an optimum value of a supplemental bending parameter in the third embodiment of FIG. 36;

FIG. 39 is a flow chart illustrating a supplemental bending information determining routine used in a fourth embodiment of this invention;

FIG. 40 is a view for explaining an example of a method of determining an optimum value of a supplemental bending parameter in the fourth embodiment of FIG. 39;

FIG. 41 is a view for explaining an example of a method of determining an optimum value of a supplemental bending parameter in a fifth embodiment of the invention;

FIG. 42 is a flow chart illustrating a supplemental bending information determining routine used in the fifth embodiment of FIG. 41; and FIG. 43 is a graph indicating a relationship between error D and division number ND used in the fifth embodiment of FIGS. 41 and 42.

DETAILED DESCRIPTION OF THE PREFERRED EMBODIMENTS

Figure 1:
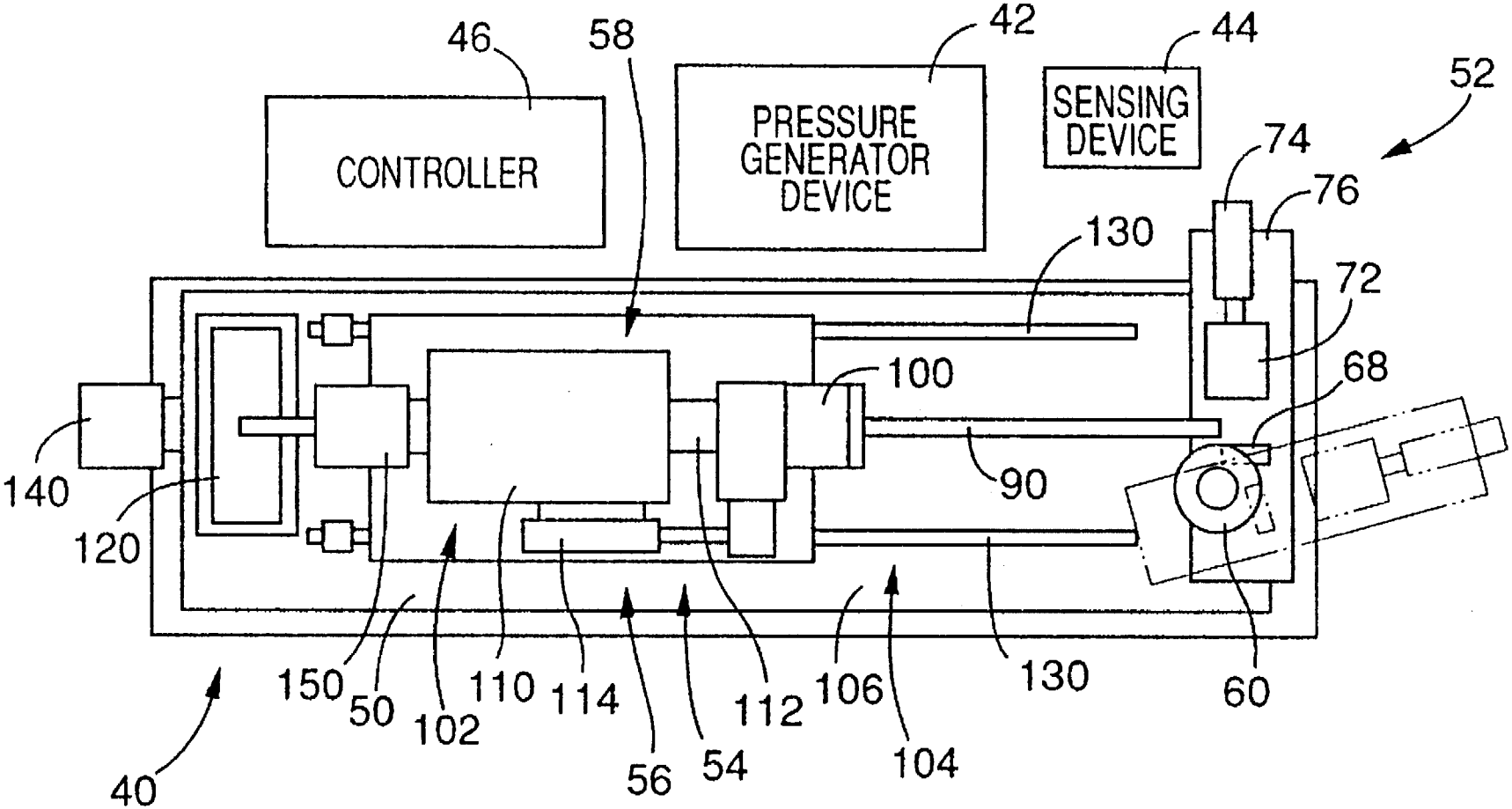
FIG. 1 is a plan view of a bending system incorporating an apparatus embodying this invention and adapted to practice a method of effecting a supplemental bending operation according to one embodiment of the invention.
Figure 2:
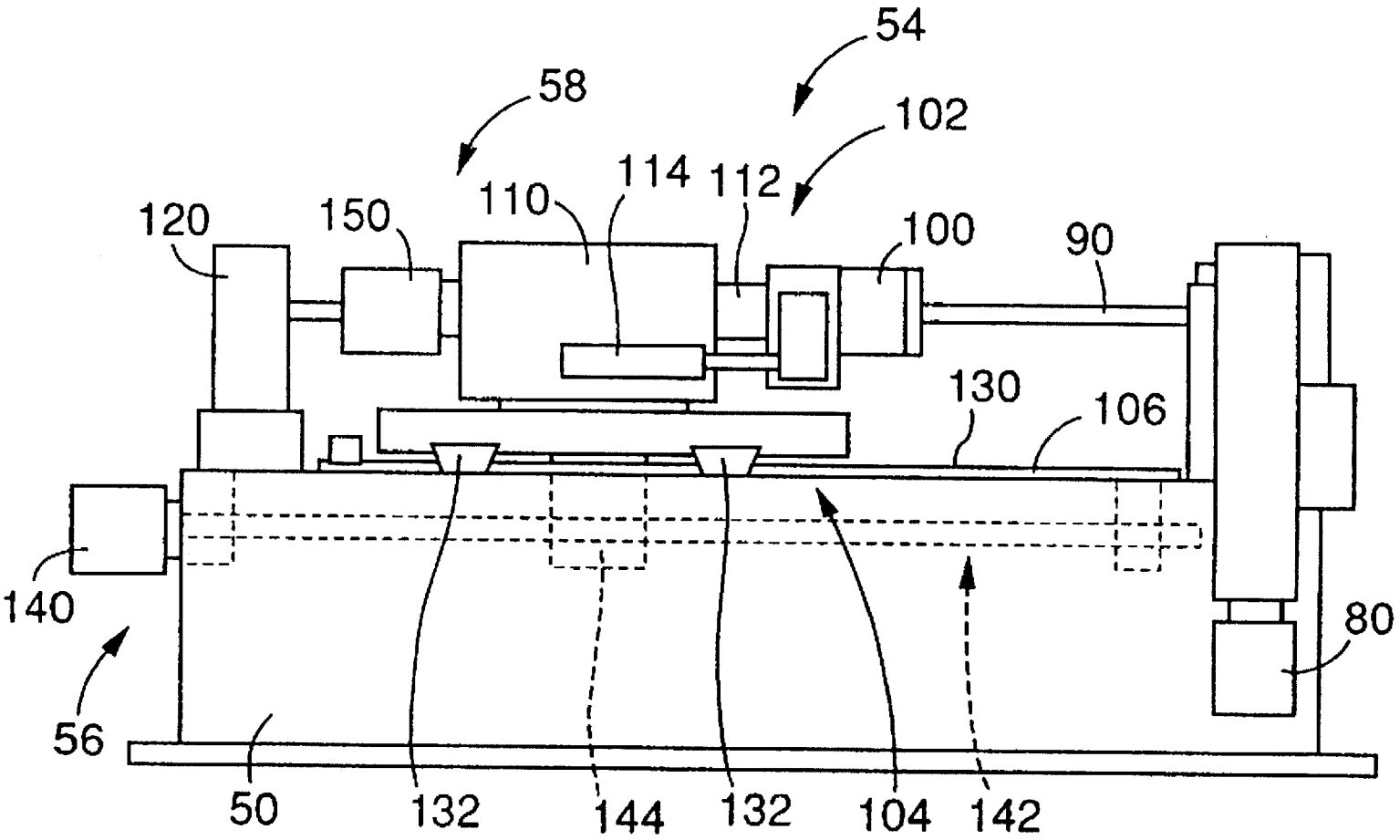
FIG. 2 is a front elevational view of the bending system of FIG. 1.

Referring first to the plan and elevational views of FIGS. 1–3, there is shown a bending system adapted to effect a bending operation on a workpiece. The bending system incorporates one embodiment of an apparatus for effecting a supplemental bending operation on an already or initially bent workpiece as schematically illustrated in the flow chart of FIG. 4.

For example, the bending system is used to bend a straight pipe (one example of the workpiece) to manufacture each of a plurality of branches of an exhaust manifold of an engine of a motor vehicle. Each branch of such an exhaust manifold is one example of a product to be manufactured by the present bending system.

Figure 5:
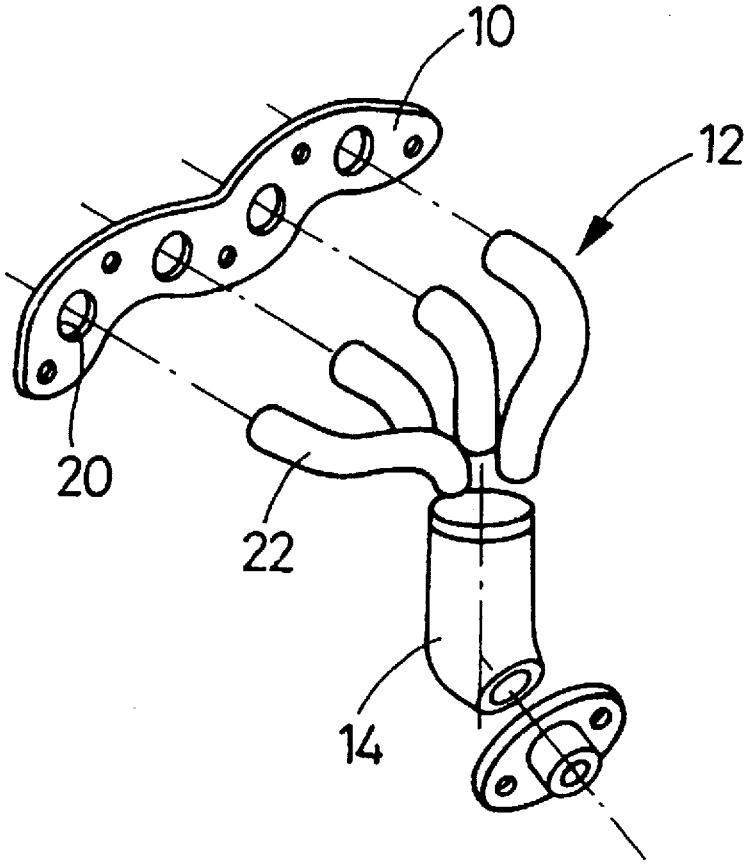
FIG. 5 is an exploded perspective view showing an exhaust manifold of an engine, which include branch portions each of which can be handled by the apparatus and method of the present invention.

One example of the exhaust manifold is illustrated in an exploded view of FIG. 5. For instance, the exhaust manifold is used to carry exhaust emissions away from piston chambers of a 4-cylinder engine into a single common exhaust pipe through respective exhaust ports of the engine. The exhaust manifold includes a flange portion 10 attached to the engine, a branch portion 12 connected at its inlet end to the flange portion 10, and a main portion 14 which is connected at one end thereof to the outlet end of the branch portion 12 and at the other end thereof to an exhaust pipe.

The flange portion 10 takes the form of a plate which has an array of four through-holes 20 corresponding to the four exhaust ports of the engine. The flange portion 10 is fixed to the cylinder block of the engine through a gasket by suitable fastening means such as bolts, such that the four through-holes 20 are aligned with the respective exhaust ports.

Figure 6:
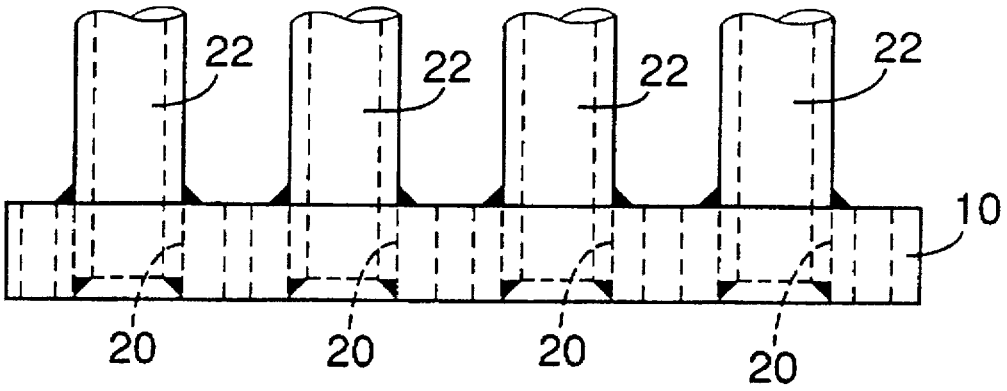
FIG. 6 is a plan view for explaining welding of branch portions of the exhaust manifold of FIG. 5 to a flange portion of the same upon assembling of the manifold.

The branch portion 12 consists of a plurality of branches 22 in the form of four bent stainless steel pipes. In the assembled exhaust manifold, these branch pipes 22 are attached to the flange portion 10 such that one end portion of each branch 22 is fixedly located within the corresponding through-hole 20, as shown in FIG. 6. The branches 22 are bent so as to merge at the other end portion and terminate in the main portion 14.

The main portion 14 consists of a cylindrical conduit which is connected to an exhaust pipe at one of opposite end portions thereof which is remote from the pipes 22. The exhaust pipe functions to routes a flow of exhaust emissions from the exhaust manifold to a discharge outlet at the rear end of a motor vehicle.

The exhaust manifold which includes the four branches 22 that are bent as described above is assembled in the manner described below in detail. Each branch 22 is secured to the main portion 14 at its downstream end portion as viewed in the direction of flow of the exhaust emissions, and to the flange portion 10 at its upstream end portion in alignment with the corresponding through-hole 20.

The upstream end portion of each branch 22 is welded to the flange portion 10, more precisely, to the inner surface of the through-hole 20. For instance, a TIG or MIG welding process may be suitably used for this purpose.

The branches 22 may be welded to the flange portion 10 as illustrated in FIG. 6, by way of example. Initially, the upstream end portion of each branch 22 is located within the corresponding through-hole 20, and the welding is effected with at least one of a first annular bead within the through-hole 20 and a second annular bead outside the through-hole 20. The first annular bead is formed so as to connect the annular end face at the upstream end of the branch 22 and the inner circumferential surface of the through-hole 20, while the second annular bead is formed so as to connect the circumferential surface of the branch 22 at its upstream end portion and the outer surface of the flange portion 10. The outer surface of the flange portion 10 is the upper one of the opposite major surfaces as seen in FIG. 6, which is not to be in contact with the cylinder block of the engine when the exhaust manifold is attached to the engine. The first and second annular beads are indicated by black triangles in FIG. 6.

Figure 7:
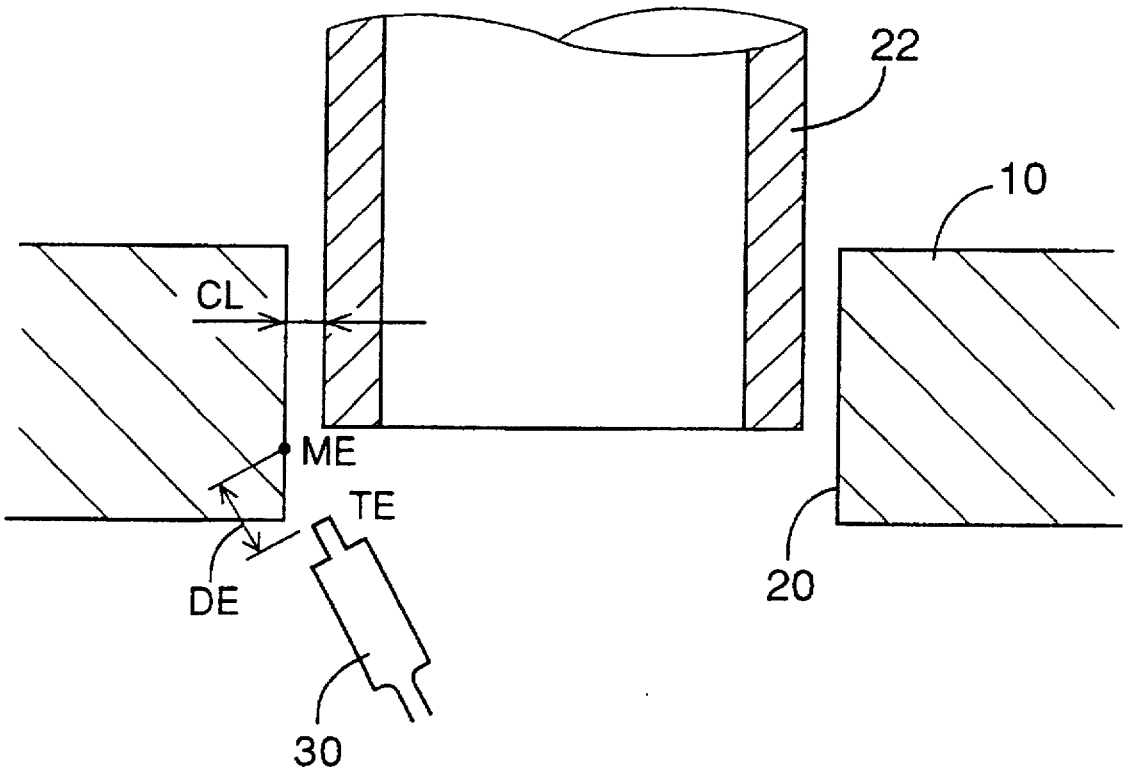
FIG. 7 is a cross sectional view for explaining a positional relationship of a welding torch with respect to the welding interface between the branch and flange portions of the exhaust manifold of FIG. 5.

The first annular bead within the through-hole 20 may be formed by a welding torch 30 whose operating end portion is positioned within the through-hole 20 as indicated in FIG. 7, for instance. Described more specifically, the welding torch 30 is positioned so as to point to a position ME on the inner circumferential surface of the through-hole 20, which portion ME is sufficiently close to the upstream end face of the branch 22. Further, the welding torch 30 is positioned such that a distance DE between the position ME and the end TE of the torch 30 is adjusted to a predetermined value. For optimizing the weld penetration (amount of penetration of a base metal), it is important to precisely control the distance DE. This is particularly important in the case of TIG welding without using a wire. However, an effort to achieve accurate control of the distance DE may result in deterioration of accuracy of control of a radial clearance CL between the outer circumferential surface of the branch 22 and the inner circumferential surface of the through-hole 20. For optimizing the weld penetration, accurate control of the radial clearance CL is also important. To improve the welding accuracy, therefore, it is essentially required that the actual relative position between the upstream and downstream end portions of each branch 22 coincide with the desired or nominal relative position with high accuracy. This requirement also applies to the second annular bead outside the through-hole 20.

The bending system and method according to the present invention are designed in view of the above requirement.

The bending system includes a bending machine 40, a pressure generator device 42, a sensing device 44 and a controller 46, as shown in FIG. 1.

The bending machine 40 has a machine base 50 on which are mounted a bending mechanism 52, a workpiece support mechanism 54, a workpiece feed mechanism 56 and a workpiece rotating mechanism 58. These mechanisms will be described.

(1) Bending Mechanism 52

Figure 8:
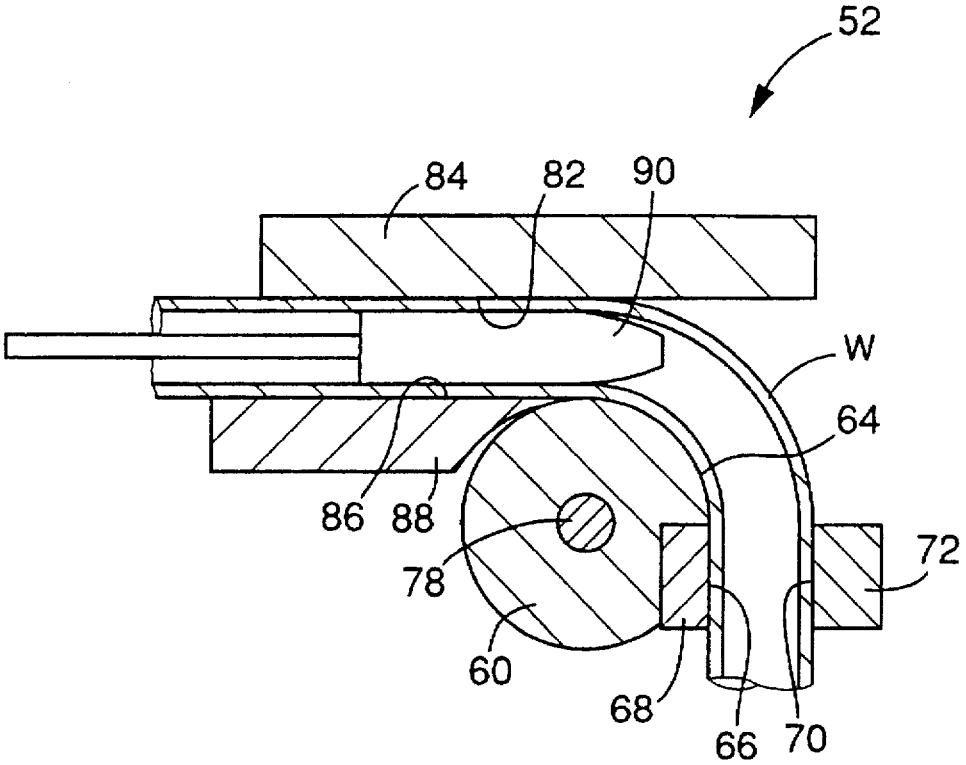
FIG. 8 is a view in horizontal cross section showing a principal part of a bending mechanism of the bending system of FIGS. 1–3.

The bending mechanism 52 is constructed to bend a workpiece W in the form of a pipe by a "pull bending" process. A major portion of the bending mechanism 52 is illustrated in the plan view of FIG. 8. The mechanism 52 includes a circular bending die 60. It is noted that FIG. 8 shows the bending mechanism 52 in its position after the workpiece W has been bent through 90°.

The bending die 60 has a circumferential groove 64 formed in its outer circumferential surface. The groove 64 has a semi-circular cross sectional shape having a radius equal to that of the workpiece W. The bending die 60 is provided with a receiver die 68 fixed thereto. The receiver die 68 has a straight groove 66 extending in a direction tangent to the circumferential groove 64. This straight groove 66 also has a semi-circular cross sectional shape having the same radius as the groove 64.

The receiver die 68 is opposed to a clamping die 72 which has a straight groove 70 identical with the straight groove 66. The clamping die 72 is movable toward and away from the receiver die 68 in the direction perpendicular to the straight grooves 66, 70. As described below, the clamping die 72 is forced against the receiver die 68 and is rotated with the receiver die 68. The clamping die 72 is driven by a clamping cylinder 74 shown in FIGS. 1 and 3, and cooperates with the receiver die 68 to clamp a portion of the workpiece W which is adjacent to a portion to be bent. The clamping cylinder 74 is operated by a pressurized fluid (compressed air or pressurized oil) supplied from the pressure generator device 42.

As shown in FIGS. 1 and 3, the bending die 60, receiver die 68 and clamping die 72 are all mounted on a base 76, which in turn is mounted on the machine base 50 such that the base 76 is rotatable in a horizontal plane about an axis 78 of the circular bending die 60. The base 76 is rotated by a motor 80 provided on the machine base 50. With the base 76 rotated relative to the machine base 50, the bending die 60 is rotated about the axis 78 together with the receiver die 68 and clamping die 72.

A pressure die 84 is disposed on the machine base 50, in the vicinity of the circular bending die 60. The pressure die 84 has a straight groove 82 having a semi-circular cross sectional shape having the same radius as the circumferential groove 64 of the bending die 60. The pressure die 84 is movable on the base 50 in a direction perpendicular to the direction of extension of the straight groove 82. A wiper 88 is fixed on the machine base 50 such that the wiper 88 is opposed to the pressure die 84. The wiper 88 has a straight groove 86 having a semi-circular cross sectional shape corresponding to that of the straight groove 82. The wiper 88 has a shaped end portion following the configuration of the circumferential groove 64 of the circular bending die 60. This shaped end portion is located within a corresponding circumferential portion of the groove 64, and is adapted to hold the workpiece W at its outer surface during bending of the workpiece, on the inner side of a bend to be formed on the workpiece by a rotating movement of the bending die 64 together with the receiver and clamping dies 68, 72. The wiper 88 is provided to protect the workpiece against creasing during bending thereof.

In operation of the bending mechanism 52, a mandrel 90 is inserted through the workpiece W in the form of a pipe such that a front end portion (right end portion as seen in FIG. 8) of the mandrel 90 is slidable in close contact with the inner surface of the workpiece W. A portion of the workpiece W with the front end portion of the mandrel 90 inserted therein is interposed between the pressure die 84 and the bending die 60 and wiper 88. During a bending operation on the workpiece W, the front end of the mandrel 90 contacts an inner surface of the workpiece W, on the outer side of a bend to be formed, and thus functions to prevent flattening of the cylindrical wall of the workpiece W.

In the bending mechanism 52 constructed as described above, the clamping die 72 is moved toward the receiver die 68 to clamp the workpiece W, and the base 76 is rotated by the motor 80 to rotate the bending die 60 together with the receiver and clamping dies 68, 72, whereby the workpiece W is bent between the bending and pressure dies 60, 84.

(2) Workpiece Support Mechanism 54

The workpiece support mechanism 54 functions to support the workpiece W when it is bent by the bending mechanism 52. As most clearly shown in FIG. 2, the workpiece support mechanism 54 includes (a) a chuck 100, (b) a rotary support device 102 for supporting the chuck 100 such that the chuck 100 is rotatable about its axis (chuck axis) and is not movable in the direction parallel to the chuck axis, and (c) a carriage 104 on which the rotary support device 102 is mounted such that the rotary support device 102 is movable in the direction parallel to the chuck axis. The workpiece support mechanism 54 holds the workpiece W at a predetermined position relative to the bending mechanism 52 during bending of the workpiece W, so as to assure an intended bending operation on the workpiece W by the bending mechanism 52. While the bending mechanism 52 is not in operation, the chuck 100 may be moved to any desired position along its axis and rotated about its axis.

The length of the workpiece W to be supported by the workpiece support mechanism 54 is determined so that a product to be obtained by bending of the workpiece W has a desired length. That is, the bent workpiece or product need not be cut to a desired length.

The rotary support device 102 has a column 110 mounted on the carriage 104. The column 110 carries a cylindrical portion 112 extending from one of its opposite surfaces toward the bending mechanism 52 in the direction parallel to the chuck axis. The cylindrical portion 112 is supported rotatably about the chuck axis relative to the column 110 and non-removably from the column 110. The cylindrical portion 112 supports the chuck 100 at its free end.

The chuck 100 is a well-known leaf-collet type adapted to chuck the workpiece W at its outside diameter. The chuck 100 has a plurality of gripper jaws each held in a cantilever fashion at the free end of the cylindrical portion. These gripper jaws extend parallel to the chuck axis, and the free end portion of each gripper jaw has a shaped inner surface for contacting the outer circumferential surface of the workpiece W when the free end portions of the gripper jaws are radially moved. The gripper jaws are accommodated in a cylindrical chuck casing which is supported by the cylindrical portion 112 such that the chuck casing is movable relative to the gripper jaws in the direction parallel to the chuck axis. The chuck casing has a tapered inner circumferential surface, while the gripper jaws have tapered outer surfaces which generally define a tapered outer circumferential surface contacting the tapered inner circumferential surface of the chuck casing. These tapered inner and outer circumferential surfaces permit a movement of the chuck casing relative to the gripper jaws in the direction parallel to the chuck axis to be converted into a radial movement of the free end portions of the gripper jaws relative to the chuck casing in the radial direction of the chuck casing, whereby the workpiece W is gripped by the gripper jaws moved in the radially inward direction. The chuck casing is moved in the axis direction by a chuck actuating cylinder 114, to cause radially inward and outward movements of the gripper jaws to clamp and unclamp the workpiece W. The cylinder 114 is also actuated by a pressurized fluid (compressed air or pressurized oil) supplied from the pressure generator device 42.

The mandrel 90 described above is inserted also through the chuck 100 and the column 110, in concentric or coaxial relationship with the chuck 100. The rear end portion (left end portion as seen in FIG. 1) of the mandrel 90 extends from the column 110 and is supported at its end by a mandrel support block 120.

The carriage 104 which carries the column 110 is slidably mounted on the machine base 50, so that the column 110 (chuck 100) is movable in the direction parallel to the chuck axis. The machine base 50 has a pair of guide rails 130 provided on the top surface 106, while the carriage 104 has a plurality of sliding members 132 fixed to its bottom surface. The sliding members 132 are slidably engaged with the guide rails 130 for guiding the carriage 104 in the direction parallel to the chuck axis.

(3) Workpiece Feed Mechanism 56

The workpiece feed mechanism 56 is provided to feed the chuck 100 in the direction parallel to the chuck axis. The mechanism 56 includes a drive source in the form of a feed motor 140, and a ballscrew mechanism 142 adapted to convert a rotary motion of the motor 140 into a linear motion. That is, the ballscrew mechanism 142 has a ballscrew connected to the motor 140, and a linkage 144 including a nut which connects the ballscrew to the carriage 104, so that the carriage 104 is moved by the feed motor 140 through the ballscrew mechanism 142.

(4) Workpiece Rotating Mechanism 58

The workpiece rotating mechanism 58 includes a drive source in the form of a motor 150 for rotating the chuck 100 about the chuck axis.

Figure 9:
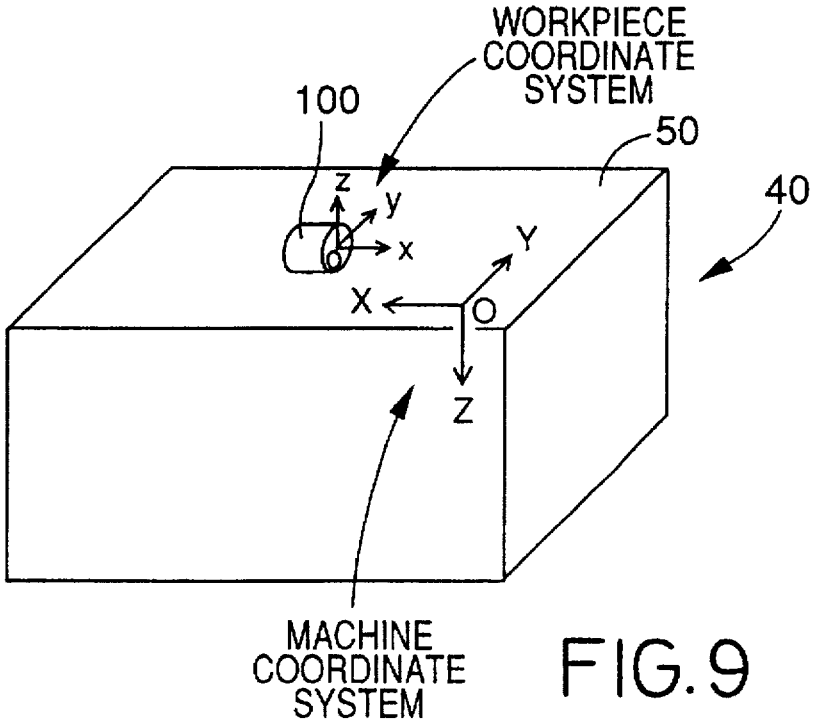
FIG. 9 is a perspective view indicating a coordinate system in the bending system of FIGS. 1–3 and a coordinate system for the workpiece to be bent by the bending system.

In the bending machine 40 constructed as described above, a rectangular coordinate system O-XYZ (hereinafter referred to as "machine coordinate system") is established as indicated in FIG. 9. This machine coordinate system is a fixed coordinate system which is independent of the axial movement and rotation of the chuck 100. The X axis of this three-dimensional machine coordinate system O-XYZ is aligned with the chuck axis of the bending machine 40. For the pipe as the workpiece W, a rectangular coordinate system o-xyz (hereinafter referred to as "workpiece coordinate system") is established with the origin "o" selected at a reference position on the chuck 100, as also indicated in FIG. 9. The reference position is placed at the center of the chuck 100. The x axis of the three-dimensional workpiece coordinate system o-xyz is aligned with the chuck axis of the machine 40. This workpiece coordinate system is a movable coordinate system which is moved in the x-axis direction and rotated about the chuck axis when the chuck 100 is axially moved and rotated.

The sensing device 44 is provided to actually measure the relative position between the opposite ends of a workpiece W (hereinafter referred to as "initially bent workpiece") which has been initially bent by the bending machine 40. For measurement of the above-indicated relative position of the initially bent workpiece by the sensing device 44, the initially bent workpiece is removed from the chuck 100, and is placed on a suitable measuring station spaced from the bending machine 40. The sensing device 44 may be of a contact type adapted to contact the outer or inner circumferential surface of the initially bent workpiece, at each of the opposite ends of the workpiece, for determining the position of the center of each end face of the workpiece and the normal line which extends from that center in the direction normal to the end face. The sensing device 44 may be of a non-contact type adapted to take an optical image of each end face of the workpiece, for obtaining similar information (e.g., end face center position and normal line), for example.

While the sensing device 44 used in the present embodiment is adapted to measure the initially bent pipe removed from the chuck 100, it is possible to use a sensing device adapted to measure the above-indicated relative position of the initially bent workpiece while the workpiece is held by the chuck 100. In this case, the initially bent workpiece need not be removed from the chuck 100 before the workpiece is subjected to a supplemental bending operation to be performed according to the principle of the present invention as described below in detail.

If the measurement of the initially bent workpiece by the sensing device 44 after removal of the workpiece from the chuck 100 indicates that the initially bent workpiece should be subjected to a supplemental bending operation, the workpiece is again held by the chuck 100. At this time, the bending mechanism 52 (base 76) is placed in its non-operated position as indicated by solid line in FIG. 1. Therefore, if the initially bent workpiece held by the chuck 100 is placed at the initial bending position at which the initial bending was performed, the initially bent workpiece will interfere with the bending mechanism 52 placed in the non-operated position. To avoid this interference, the chuck 100 is axially moved by a suitable distance toward the bending mechanism 52, so that the initially bent workpiece held by the chuck 100 is shifted by the corresponding distance from the initial bending position in the direction parallel to the chuck axis. Namely, the supplemental bending position of the workpiece is shifted from the initial bending position along the chuck axis. In this respect, it is noted that the initially bent workpiece has at least one bent portion and a plurality of straight portions. The initially bent workpiece is held by the chuck 100 at one of the straight portions, such that the straight portion held by the chuck 100 passes the bending mechanism 52, so that the bent portion or portions will not interfere with the bending mechanism 52 in the non-operated position.

The initially bent workpiece is held by the chuck 100 in a predetermined positional relationship with the chuck 100. This means that a change in the axial position of the chuck 100 by the workpiece feed mechanism 56 will change the original "o" of the workpiece coordinate system o-xyz relative to the original "O" of the machine coordinate system O-XYZ. Information on the distance of the axial movement of the chuck 100 prior to the supplemental bending operation is inputted by the operator of the bending system into the controller 46, as described below with respect to step S30 of the flow chart of FIG. 29.

The controller 46 is adapted to define the outlet end of the initially bent workpiece W in the workpiece coordinate system whose original "o" is located at the predetermined chucking position on the chuck 100. The outlet end of the initially bent workpiece W is one of the opposite ends of the workpiece W which is nearer to the bending mechanism 52 when the workpiece W is chucked or installed in position on the bending machine 40 for the supplemental bending operation. Thus, the controller 46 is not adapted to directly define the opposite end or inlet end of the initially bent workpiece W, but is adapted to indirectly handle the outlet end of the workpiece W as the origin "o" of the workpiece coordinate system.

The outlet end of the initially bent workpiece W is defined by an outlet end center vector $oo_1$ and an outlet end normal line vector A of the workpiece W in the workpiece coordinate system o-xyz wherein the inlet end center of the workpiece is aligned with the origin "o", as indicated in FIG. 10.

Figure 11:
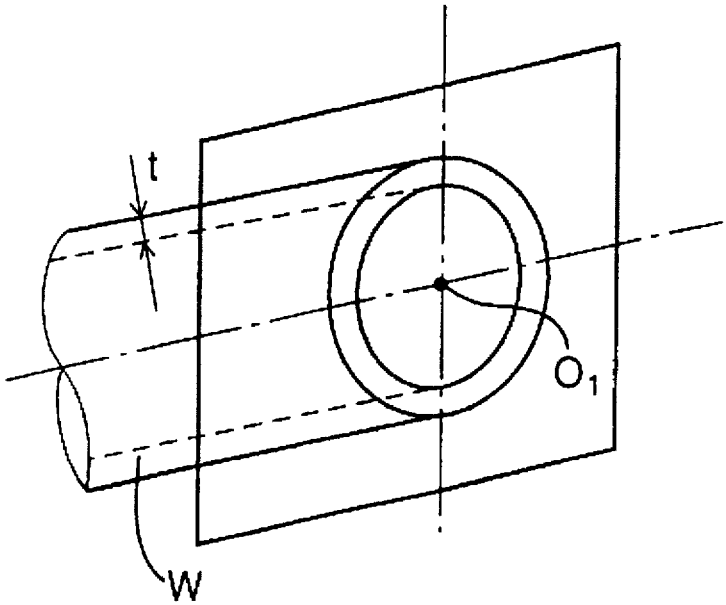
FIG. 11 is a perspective view indicating a center of the pipe of FIG. 10 at its outlet end.

The outlet end center vector $oo_1$ is a vector having a start point positioned at the origin "o" of the workpiece coordinate system o-xyz and an end point positioned at the center $o_1$ of the outlet end of the workpiece W. The outlet end center $o_1$ is a center of the outer or inner circumference of the outlet end face of the workpiece W, as indicated in FIG. 11. The outlet end normal line vector A is a vector representative of a normal line which extends from the outlet end center $o_1$ in a direction normal to the plane of the outlet end face of the workpiece, as indicated in FIG. 12. The outlet end normal line vector A has a start point positioned at the outlet end center $o_1$ and a predetermined length along the above-identified normal line.

The controller 46 is principally constituted by a computer which incorporates a central processing unit (CPU) 200, a read-only memory (ROM) 202 and a random-access memory (RAM) 204, as indicated in FIG. 13. The computer has an input interface connected to the sensing device 44, and an output interface connected to the various actuators such as the motors 80, 140, 150 of the bending machine 40 and the pressure generator device 42. The ROM 202 stores various control routines and data tables, such as an initial bending control routine, a supplemental bending information determining routine and a supplemental bending control routine, as indicated in FIG. 13. The CPU 200 operates to execute those routines while utilizing a temporary data storage function of the RAM 204, for manufacturing a desired product in the form of the branch 22 of the exhaust manifold from the workpiece W in the form of a pipe. These routines will be described.

The initial bending control routine is formulated to control the bending system to effect an initial bending operation on a straight pipe, so as to form a bend at a predetermined initial bending position of the pipe as the workpiece, with a predetermined amount of initial bending of the pipe. Information on the predetermined initial bending position and amount is inputted by the operator into the controller 46 through suitable data input means such as a keyboard with numeric keys ("ten keys"). With the initial bending operation performed under the control of the controller 46 according to the initial bending control routine, the straight pipe is bent with the predetermined amount of bending at the predetermined initial bending position in the workpiece coordinate system o-xyz. This initial bending operation is indicated as step SDB in the flow chart of FIG. 4.

The initial bending control routine (step SDB of FIG. 4) is followed by the supplemental bending information determining routine (step SDI of FIG. 4).

This supplemental bending information determining routine is schematically illustrated in the flow chart of FIG. 14. The routine is initiated with step S1 in which the operator manipulates the data input means to specify the desired or nominal outlet end center position and normal line as indicated above. The operation in this step S1 will be described in detail with respect to step S70 in the flow chart of FIG. 29.

Step S1 is followed by step S2 in which the initially bent workpiece is actually measured by the sensing device 44 as described above.

Then, the control flow goes to step S3 to determine or obtain supplemental bending information necessary to effect a supplemental bending operation on the initially bent workpiece so that the actually measured position of the outlet end of the initially bent workpiece coincides with the nominal position. Thus, one cycle of execution of the supplemental bending information determining routine of FIG. 14 is completed. This routine is indicated as step SDI in the flow chart of FIG. 4.

The supplemental bending information determining routine is followed by the supplemental bending control routine, which is executed to effect the supplemental bending operation on the initially bent workpiece according to the supplemental bending information determined in the supplemental bending information determining routine, so as to bend the workpiece by the predetermined supplemental bending amount at the predetermined supplemental bending position in the workpiece coordinate system o-xyz. In this respect, it is noted that the bending position on the bending machine 40 (at the bending mechanism 52) in the supplemental bending operation is the same as the bending position in the initial bending operation. However, since the chuck 100 is axially moved from the initial bending position to the supplemental bending position after the initial bending operation and before the supplemental bending operation, the initial and supplemental bending positions on the workpiece W are different and spaced apart from each other in the axial direction of the chuck 100 (in the axial direction of the originally straight pipe). With the initially bent workpiece being subjected to the supplemental bending operation according to the supplemental bending control routine, the initially bent workpiece is again bent into the desired product, namely, branch 22 of the exhaust manifold, for example. This supplemental bending control routine is indicated as step SMB in the flow chart of FIG. 4.

The operation in step S3 of the supplemental bending information determining routine of FIG. 14 will be described in detail by reference to the flow chart of FIG. 15.

In the present embodiment, the supplemental bending information includes three supplemental bending parameters which control a supplemental bending operation. These three supplemental bending parameters consist of: a distance of feeding of the initially bent workpiece W; an amount of supplemental bending; and an angle of rotation of the workpiece about the chuck axis. It will be understood that the supplemental bending position of the initially bent workpiece is determined by the feeding distance and rotation angle of the initially bent workpiece (namely, axial and rotational or circumferential positions of the workpiece. Before explaining the step S3 by reference to the flow chart of FIG. 15, there will be described the concepts of the above three parameters (workpiece feeding, rotation and bending amount) in the workpiece coordinate system o-xyz.

The "feeding of the workpiece" is achieved by moving the chuck 100 for holding and positioning the workpiece in the X-axis direction of the machine coordinate system O-XYZ. The movement of the chuck 100 means a movement of the workpiece coordinate system o-xyz in its x-axis direction and a movement of the outlet end of the workpiece in the x-axis direction, as indicated in FIGS. 16(*a*) and 16(*b*). In the bending machine 40 according to the present embodiment, the position in the machine coordinate system O-XYZ at which the workpiece is bent by the bending mechanism 52 is fixed. Therefore, a movement of the chuck 100 in the x-axis direction means a movement of the bending position on the workpiece in the x-axis direction. Since the outlet end of the workpiece is defined with the inlet end of the workpiece is positioned at the origin "o" of the original work coordinate system o-xyz, a movement of the original workpiece coordinate system o-xyz to a moved workpiece coordinate system o'-x'y'z' means a movement of the bending position on the workpiece in the direction opposite to the direction of movement of the workpiece (chuck 100) along the x-axis. That is, a movement of the chuck 100 results in the movement of the bending position from the initial bending position to the supplemental bending position.

Theoretically, the supplemental bending may be effected at any position of the initially bend workpiece in the x-axis direction, provided the supplemental bending position is different or spaced from the initial bending position in the x-axis direction. However, the present embodiment is adapted such that the supplemental bending position is selectable within only one of the straight portions of the initially bent workpiece at which the workpiece is held by the chuck 100, namely, within the straight portion whose one end is the inlet end of the workpiece and will be hereinafter referred to as "inlet end straight portion" of the workpiece. On the other hand, the bending position of the bending mechanism 52 in the machine coordinate system is fixed and is not movable. As described above, a feeding movement of the workpiece in the x-axis direction means not only a movement of the outlet end of the workpiece in the x-axis direction but also a movement of the supplemental bending position, which is selectable only within the inlet end straight portion of the workpiece. In theory, therefore, an upper limit of the feeding distance of the chuck 100 or workpiece is equal to the length of the inlet end straight portion of the initially bent workpiece.

The "amount of supplemental bending" means an amount of bending of the initially bent workpiece held by the chuck 100, in the Y-axis direction of the machine coordinate system O-XYZ perpendicular to the chuck axis, and at the supplemental bending position spaced from the initial bending position in the x-axis direction of the workpiece coordinate system o-xyz, as indicated in FIG. 17.

The "angle of rotation of the workpiece" is an angle of the plane x'-y' plane of the workpiece coordinate system o-xyz in which the supplemental bending operation is effected on the initially bent workpiece, with respect to the original plane x-y parallel to the X-Y plane of the machine coordinate system O-XYZ. Since the X-Y plane in which the bending on the workpiece is effected by the bending mechanism 52 is fixed, the chuck 100 is rotated about the chuck axis to rotate workpiece, whereby the x-y plane of the workpiece coordinate system o-xyz is rotated about the x-axis. With the chuck 100 rotated to rotate the original workpiece coordinate system o-xyz to the rotated workpiece coordinate system o'-x'y'z' as indicated in FIGS. 18(*a*) and 18(*b*), the rotational or circumferential position of the initially bent workpiece at which the supplemental bending takes place is changed in the rotational or circumferential direction opposite to the direction of rotation of the chuck 100.

The term "supplemental bending position" is broadly interpreted to encompass both the position of the workpiece in the direction parallel to the chuck axis and the position of the workpiece about the chuck axis. Namely, the term "supplemental bending position" broadly means not only the position of the workpiece in the X-axis direction, but also the position of the workpiece about the X-axis.

As described above, the feeding and rotation of the chuck 100 result in the movement in the x-axis direction and rotation about the x-axis of the workpiece coordinate system o-xyz. In the following description, the term "workpiece coordinate system" should be interpreted to mean the original workpiece coordinate system which has not been rotated and whose x-y plane is parallel with the fixed X-Y plane of the machine coordinate system O-XYZ. The outlet end center position $o_1$ and outlet end normal line vector A of the workpiece should be interpreted to mean those position and vector A in the original workpiece coordinate system o-xyz before the chuck 100 is fed and/or rotated.

The feeding distance of the workpiece is variable from 0 to an upper limit f, and the rotation angle of the workpiece is variable from 0 to an upper limit $\phi$, while the supplemental bending angle is variable from 0 to an upper limit $\theta$. These ranges will be referred to as "variation ranges" of the supplemental bending parameters: feeding distance; rotation angle; and supplemental bending angle. The upper limits f, $\phi$ and $\theta$ of these variation ranges are determined and inputted into the controller 46 by the operator of the bending system.

Referring back to the flow chart of FIG. 15, step S11 is initially implemented to determine a provisional value of the supplemental bending parameter in question (e.g., workpiece feeding distance). More specifically, a plurality of provisional values are first determined by dividing a variation range of the supplemental bending parameter by a predetermined number ND of divisions, as schematically indicated in FIG. 19. In the first cycle of execution of the routine of FIG. 15, the smallest provisional value is selected. Thereafter, the provisional value is incremented each time the routine is repeatedly executed.

Step S11 is followed by step S12 to estimate outlet end center vector and outlet end normal line vector as corrected by the supplemental bending operation under the provisional value which has been selected in step S11. This estimation is effected on the basis of the outlet end center position and normal line which have been measured by the sensing device 44 in step S1 of the flow chart of FIG. 14. These estimated outlet end center vector and normal line vector will be hereinafter referred to as "corrected outlet end center vector" and "corrected outlet end normal line vector". The principle of the estimation to obtain the corrected outlet end center vector and normal line vector will be described below.

Where the supplemental bending parameter in question is the workpiece feeding distance, a movement of the initially bent workpiece by a distance equal to the provisional value F will cause a movement of the initial bending position $o_F$ to $o_F'$, and a movement of the outlet end center position $o_1$ to $o_1'$, both in the x-axis direction of the workpiece coordinate system o-xyz, as indicated in FIG. 20. Therefore, the corrected outlet end center vector $oo_1'$ is expressed by the following equation (1):

$$oo_1\alpha=00_1+o_Fo_F' \tag{1}$$

Where the supplemental bending parameter is the workpiece rotation angle, rotation of the initially bent workpiece about the x-axis by an angle equal to the provisional value $\theta_H$ will cause rotation of the outlet end center $o_1$ (start point $o_{AS}$ of the outlet end normal line vector A) and rotation of the end point $o_{AE}$ of the outlet end normal line vector A, about the x-axis by the angle $\theta_H$ in the y-z plane perpendicular to the x-axis, as indicated in FIG. 21. Therefore, the corrected outlet end normal line vector $oo_1'$ is expressed by the following equation (2):

$$oo_1'=[MTX_1(\theta_H)]\cdot oo_1 \tag{2}$$

A vector $oo_{AE}'$ having a start point at the origin "o" and an end point at the end point $o_{AE}'$ of the corrected outlet end normal line vector A is expressed by the following equation (3):

$$oo_{AE}'=[MTX_1(\theta_H)]\cdot oo_{AE} \tag{3}$$

In the above vector equations (2) and (3), $[MTX_1]$ is a 2×2 figure-transformation matrix for rotating a given point in the workpiece coordinate system, by the angle $\theta_V$ in the y-z plane perpendicular to the x-axis. This matrix is represented by the following equation (4):

$$[MTX_1]=\begin{bmatrix} \cos\theta_H & -\sin\theta_H \\ \sin\theta_H & \cos\theta_H \end{bmatrix} \tag{4}$$

Where the supplemental bending parameter is the supplemental bending amount or angle of the initially bent workpiece, a supplemental bending operation effected on the initially bent workpiece under the provisional value F of the workpiece feeding distance and the provisional value $\theta_V$ of the supplemental bending angle will cause bending of the initially bent workpiece at the supplemental bending position, in the X-Y plane of the machine coordinate system (parallel to the plane of FIG. 22), and in a x'-y' plane of the workpiece coordinate system, which plane x'-y' is rotated about the x-axis with respect to the x-y plane by the angle equal to the provisional value $\theta_H$ of the workpiece rotation angle, as indicated in FIG. 22. As a result, the outlet end center position $o_1$ is moved to $o_1'$. The corrected outlet end center vector $oo_1'$ is expressed by the following equation (5):

$$oo_1'=oo_V+[MTX_2(\theta_V)]o_Vo_1' \tag{5}$$

In the above vector equation (5), $[MTX_2]$ is a 2-2 figure-transformation matrix for rotating a given point in the workpiece coordinate system, by the angle $\theta_V$ in the x-y plane which has been rotated about the x-axis by an angle equal to the provisional value $\theta_H$ of the workpiece rotation angle. This matrix is represented by the following equation (6):

$$[MTX_2]=\begin{bmatrix} \cos\theta_V & -\sin\theta_V \\ \sin\theta_V & \cos\theta_V \end{bmatrix} \tag{6}$$

A continuous change of the feeding distance of the initially bent workpiece means a continuous movement of the outlet end normal line vector A as indicated by a parallelogram locus taken by the vector A, as shown in FIG. 23. This parallelogram of the locus is parallel to the x-axis of the workpiece coordinate system. A continuous change of the workpiece rotation angle about the x-axis, that is, continuous rotation of the plane in which the supplemental bending operation takes place, means continuous rotation of the outlet end normal line vector A as indicated by a conical locus taken by the vector A, as shown in FIG. 23. The cone of the locus has a centerline aligned with the x-axis of the workpiece coordinate system. Further, a continuous change of the supplemental bending angle means a continuous movement of the outlet end normal line vector A as indicated by an annular locus taken by the vector A, as also shown in FIG. 23. The annulus of the locus has a center at the supplemental bending position selected along the x-axis. If the bending system was adapted to be able to effect only one supplemental bending action at a predetermined supplemental bending position, the supplemental bending would not permit the vector A to be rotated about its start point, and would not permit the actual outlet end normal line vector to be aligned with the nominal vector (one example of which is indicated by dashed line in FIG. 23). On the other hand, any vector in a three-dimensional coordinate system can be defined as a sum of two reference vectors which intersect each other. This means that the outlet end normal line vector A can be displaced to any position in any direction by effecting two supplemental bending actions on the initially bent workpiece at respective two different supplemental bending positions which are selected on the inlet end straight portion of the initially bent workpiece. Based on this analysis, the present bending system is adapted to be able to effect two supplemental bending actions at the respective supplemental bending positions. The second supplemental bending action is performed if the desired product cannot be obtained by the first supplemental bending action on the initially bent workpiece.

The desired product may not be obtained even if the two supplemental bending actions are performed under any combinations of the provisional values available within the variation ranges of the supplemental bending parameters. In the light of this possibility, it is possible to formulate the supplemental bending information determining routine so that three or more supplemental bending actions can be effected at the respective supplemental bending positions.

Referring back to FIG. 15, step S12 to obtain the corrected outlet end center vector and normal line vector is followed by step S13 to determine whether the currently selected provisional value of the supplemental bending parameter in question (e.g., workpiece feeding distance) is acceptable or not. The currently selected provisional value is determined to be acceptable if the corrected outlet end center vector and the corrected outlet end normal line vector which are obtained under the provisional value in question sufficiently coincide with the nominal vectors which have been inputted in step S1 of FIG. 14.

The determination as to whether the corrected vectors "sufficiently coincide with" the nominal vectors is effected by utilizing a concept of "tolerances" generally used in the manufacturing engineering. In the present embodiment, the tolerances consist of a tolerance for an error distance between the corrected outlet end center position under the currently selected provisional value and the nominal outlet end center position, and a tolerance for an error angle between the corrected outlet end normal line vector under the provisional value in question and the nominal outlet end normal line vector. Information on these tolerances for the error distance and error angle is inputted in the controller 46 by the operator, as described below in detail with respect to step S70 of the flow chart of FIG. 29. Generally, a tolerance range is defined by an upper limit and a lower limit, with its center being equal to the nominal value, as indicated in FIG. 26. The absolute value of the tolerance is a difference between the upper or lower limit and the nominal value.

The determination as to whether the error distance falls within a predetermined tolerance range can be made by determining whether the absolute value of the error distance is not larger than the absolute value of a tolerable error distance. If the absolute value of the error distance is not larger than that of the tolerable error distance, the error distance is determined to fall within the tolerance range. Similarly, the determination as to whether the error angle falls within a predetermined tolerance range can be made by determining whether the absolute value of the error angle is not larger than the absolute value of a tolerable error angle. If the absolute value of the error angle is not larger than that of the tolerable error angle, the error angle is determined to fall within the predetermined tolerance range.

The determination as to whether the absolute value of the error distance is not larger than that of the tolerable error distance can be made by using a tolerance sphere as shown in FIG. 24. The tolerance sphere has a center at the nominal outlet end center position, and a radius equal to the tolerable error distance. If the corrected outlet end center position is located within the tolerance sphere, it is determined that the currently selected provisional value is acceptable.

The determination as to whether the absolute value of the error angle is not larger than that of the tolerable error angle can be made by using a tolerance cone as shown in FIG. 25. The tolerance cone has a centerline aligned with the nominal outlet end normal line vector, and an apex angle a half of which is equal to the tolerable angle. In this case, a determination is made as to whether the tolerance cone includes the corrected outlet end normal line vector which has been translated such that the start point of the translated normal line vector is aligned with the start point of the nominal normal line vector. For example, an inner product of the corrected outlet end normal line vector and the nominal outlet end normal line vector is obtained, and a determination is made as to whether the obtained inner product is equal to or larger than the tolerable error angle. If so, the currently selected provisional value is determined to be acceptable.

The determination as to whether the corrected outlet end center is located within the tolerance sphere and the determination as to whether the corrected outlet end normal line vector is encompassed within the tolerance cone are both effected to determine that the currently selected provisional value is unacceptable if the error distance or error angle (hereinafter referred to as "error" in general) does not exceed the tolerable limit, and acceptable if the error does not exceed the tolerable limit, as indicated in FIG. 26. In this sense, the above determinations may be conceptually considered to be "crisp" determination as distinguished from a fuzzy inference determination.

However, the determinations in step S13 may be made by fuzzy inference well known in the art.

For example, the fuzzy inference determination uses two membership functions, one for a negative error tolerance and the other for a positive error tolerance, as indicated in the graph of FIG. 27. The negative error membership function is formulated such that the fuzzy inference value is equal to "1" when the corrected outlet end center position or corrected outlet end normal line vector (hereinafter referred to as "corrected value" where appropriate) is equal to the lower limit (negative value) of the tolerance range. The fuzzy inference value decreases from "1" to "0" as the corrected value deviates from the lower limit in the negative and position directions. Similarly, the positive error membership function is formulated such that the fuzzy inference value is equal to "1" when the corrected value is equal to the upper limit (positive value) of the tolerance range. The fuzzy inference value decreases from "1" to "0" as the corrected value deviates from the upper limit in the negative and positive directions.

If the currently selected provisional value of the supplemental bending parameter (e.g., workpiece feeding distance) is determined to be acceptable, that is, if an affirmative decision (YES) is obtained in step S13, one cycle of the routine of FIG. 15 is completed. If a negative decision (NO) is obtained in step S13, the control flow goes back to step S11 in which the next provisional value is selected, and steps S12 and S13 are repeatedly implemented. Thus, as indicated in FIG. 19, the provisional value is incremented in step S11 each time the error (error distance or error angle) corresponding to the last selected provisional value is determined to be outside the tolerance range, namely, each time the selected provisional value is determined to be unacceptable. The routine of FIG. 15 (step S3 of FIG. 14) to determine the supplemental bending information is terminated when the error corresponding to the currently selected provisional value of the supplemental bending parameter in question is found to fall within the tolerance range, namely, when the currently selected provisional value is found to be acceptable.

As described above, the present embodiment is adapted to be able to effect two supplemental bending actions on the workpiece at respective two different supplemental bending positions. For example, the first supplemental bending action is effected with the workpiece feeding distance N1, workpiece rotation angle N2 and supplemental bending angle N3, while the second supplemental bending action is effected with the workpiece feeding distance N4, workpiece rotation angle N5 and supplemental bending angle N6. The two workpiece feeding distance values N1 and N4 are selected such that a sum of these two values (N1+N4) does not exceed the upper limit f, and the two workpiece rotation angles N2 and N5 are selected such that a sum of these two values (N2+N5) does not exceed the upper limit $\phi$. Similarly, the two supplemental bending angles N3 and N6 are selected such that a sum of these two values (N3+N6) does not exceed the upper limit $\theta$. The workpiece rotation angles N2 and N5 may be selected such that these angles N2 and N5 do not exceed respective upper limits $\phi 2$ and $\phi 5$, and the supplemental bending angles N3 and N6 may be selected such that these angles N3 and N6 do not exceed respective upper limits $\theta 3$ and $\theta 6$.

There will be described in detail the operations to determine the supplemental bending information, i.e., three parameters (workpiece feeding distance, workpiece rotation angle and supplemental bending angle) each of which may take two different values as described above if the two supplemental bending actions should be performed to obtain the desired product from the initially bent workpiece.

Referring to the flow chart of FIG. 28 schematically illustrating the operations to determine the supplemental bending parameters, the routine is initiated with step S21 to determine whether only the first supplemental bending action at the supplemental bending position defined by the first workpiece feeding distance N1 permits the corrected outlet end center vector and normal line vectors to coincide with the nominal vectors, that is, permits the manufacture of the desired product. If an affirmative decision (YES) is obtained in step S21, one cycle of execution of the routine is terminated. If a negative decision (NO) is obtained in step S21, the control flow goes to step S22.

Step S22 is provided to determine whether only the first supplemental bending action at the supplemental bending position defined by the first workpiece feeding distance N1 and with the workpiece rotation by the first rotation angle N2 permits the manufacture of the desired product. If an affirmative decision (YES) is obtained in step S22, one cycle of execution of the routine is terminated. If a negative decision (NO) is obtained in step S22, the control flow goes to step S23.

Step S23 is provided to determine whether only the first supplemental bending action under the first workpiece feeding distance N1, workpiece rotation angle N2 and supplemental bending angle N3 permits the manufacture of the desired product. If an affirmative decision (YES) is obtained in step S23, one cycle of execution of the routine is terminated. If a negative decision (NO) is obtained in step S23, the control flow goes to step S24.

Step S24 is provided to determine whether the first supplemental bending action under the first workpiece feeding distance N1, workpiece rotation angle N2 and supplemental bending angle N3, and the second supplemental bending action under the second workpiece feeding distance N4 permit the manufacture of the desired product. If an affirmative decision (YES) is obtained in step S24, one cycle of execution of the routine is terminated. If a negative decision (NO) is obtained in step S24, the control flow goes to step S25.

Step S25 is provided to determine whether the first supplemental bending action under the first workpiece feeding distance N1, workpiece rotation angle N2 and supplemental bending angle N3, and the second supplemental bending action under the second workpiece feeding distance N4 and workpiece rotation angle N5 permit the manufacture of the desired product. If an affirmative decision (YES) is obtained in step S25, one cycle of execution of the routine is terminated. If a negative decision (NO) is obtained in step S25, the control flow goes to step S26.

Step S26 is provided to determine whether the first supplemental bending action under the first workpiece feeding distance N1, workpiece rotation angle N2 and supplemental bending angle N3, and the second supplemental bending action under the second workpiece feeding distance N4, workpiece rotation angle N5 and supplemental bending angle N6 permit the manufacture of the desired product. If an affirmative decision (YES) is obtained in step S26, one cycle of execution of the routine is terminated. If a negative decision (NO) is obtained in step S26, the control flow goes to step S27.

Step S27 is provided to inform the operator that the computer of the controller 46 is not able to determine the supplemental bending parameters that permit the manufacture of the desired product by the supplemental bending action or actions under any combinations of values of the three supplemental bending parameters. In this case, the supplemental bending information is determined by the operator and inputted into the controller 46 through the data input means.

It is noted that in the case of an affirmative decision (YES) obtained in step S21 or S22, the first supplemental bending angle is "0", and therefore a supplemental bending operation (first supplemental bending action) is not actually performed. That is, the initially bent workpiece is acceptable as the desired product. Therefore, the routine of FIG. 28 may be modified to be initiated with step S23, with steps S21 and S22 being eliminated. Step S23 will be described later in detail by reference to FIG. 31.

In the above modified routine which is initiated with step S23, however, a supplemental bending action may possibly be performed even when it is not actually required. That is, the optimum supplemental bending angle (which is not zero) is obtained in the first step S23, irrespective of the workpiece feeding distance, for example. It is possible that the acceptable provisional value of the workpiece feeding distance is found in step S21, if step S21 were implemented. According to the modified routine initiated with step S23, however, the acceptable provisional value of the supplemental bending angle is found in step S23 even in the above case, since the workpiece feeding distance (i.e., supplemental bending position) is not taken into account.

It is also noted that the product as the branch pipe 22 can be displaced at its inlet end portion when the pipe 22 is welded to the flange portion 10, even though the pipe 22 is positioned in place by a suitable jig relative to the flange portion 10 and the main portion 14 of the exhaust manifold. Described more specifically, the straight inlet end portion of the pipe 22 is inserted into the through-hole 20 in the flange portion 10 prior to the welding to the flange portion 10, with the outlet end portion being fixed by the jig relative to the main portion 14. In this condition, the straight inlet end portion of the pipe 22 may be moved by a small distance along the centerline and may be rotated by a small angle about the centerline, relative to the flange portion 10. Therefore, the upper limits f and $\phi$ of the workpiece feeding distance and rotation angle may be suitably determined by taking into account the expected maximum movement distance and rotation angle of the pipe 22 upon welding of the pipe 22 to the flange and main portions 10, 14. In this case, the supplemental bending information determining routine determines that no supplemental bending operation is necessary, even in the case where the actual outlet end center vector and normal line vector are intolerably different from the nominal vectors. Namely, the pipe 22 can be welded to the flange and main portions 10, 14 in the desired or nominal positional relationship, owing to the forced movement and rotation of the pipe 22 at its inlet end portion. Consequently, the steps S21 and S22 together with the above manner of determination of the upper limits f and $\phi$ make it possible to eliminate an unnecessary supplemental bending operation.

In the light of the above, the supplemental bending information determining routine according to the present embodiment includes steps S21 and S22 for minimizing the actually unnecessary supplemental bending operation. That is, steps S21 and S22 function to determine whether the relative position of the opposite ends of the initially bent workpiece without the supplemental bending operation effected thereon falls within a tolerable range which is broadened to an extent corresponding to the expected maximum movement distance and rotation angle of the pipe 22 as the end product upon welding thereof to the flange and main portions 10, 14.

While the supplemental bending information determining routine (step SD1 of FIG. 4) has been briefly described by reference to the flow charts of FIGS. 14, 15 and 28, the routine will be described in greater detail by reference to the flow charts of FIGS. 29–32.

The routine is initiated with step S30 of FIG. 29 in which the operator inputs data on the origin "o" of the workpiece coordinate system in the machine coordinate system. Step S30 is followed by step S40 in which the operator inputs the upper limits f, $\phi$ and $\theta$ of the workpiece feeding distance, workpiece rotation angle and supplemental bending angle. Then, the control flow goes to step S50 to receive the output signals of the sensing device 44 indicative of the actual outlet end center position and the direction of the actual outlet end normal line of the initially bent workpiece in the machine coordinate system. Step S50 is followed by step S60 to calculate the actual outlet end center vector and the actual outlet end normal line vector in the workpiece coordinate system, on the basis of the output signals received from the sensing device 44.

The control flow then goes to step S70 in which the operator inputs the nominal outlet end center position and the direction of the nominal outlet end normal line in the workpiece coordinate system, and the tolerances for the error distance of the outlet end center vector and the error angle of the outlet end normal line vector. Step S70 is followed by step S80 to calculate the nominal outlet end center vector and the nominal outlet end normal line vector, on the basis of the nominal outlet end center and the direction of the nominal outlet end normal line which have been inputted in step S70.

Step S90 is then implemented to select a provisional value $N1_{(i)}$ of the first workpiece feeding distance N1. Namely, a plurality of provisional values $N1_{(i)}$ ($i=1, 2, \ldots i_{MAX}$) are determined by dividing the variation range of the first workpiece feeding distance by a predetermined division number NDo stored in the ROM 202. In the first cycle of execution of the routine, the provisional value $N1_{(1)}$ which is equal to "0" is selected.

Step S90 is followed by step S100 to calculate the corrected outlet end center vector and normal line vector according to the vector equations indicated above, and on the basis of the currently selected provisional value $N1_{(i)}$ of the first workpiece feeding distance N1. The vector equations include the actual outlet end center vector and normal line vector calculated in step S60.

The control flow then goes to step S110 to determine whether the currently selected provisional value $N1_{(i)}$ is acceptable, by comparing the corrected outlet end center vector and normal line vector (hereinafter referred to as "corrected vectors") with the respective nominal outlet end center vector and normal line vector (hereinafter referred to as "nominal vectors"). Explained more particularly, the error distance and the error angle described above are calculated for the calculated corrected vectors, and determinations are made as to whether the calculated error distance is held within a predetermined range of the tolerable error distance, and as to whether the calculated error angle is held with a predetermined range of the tolerable error angle. If an affirmative decision is obtained in both of these two determinations, an affirmative decision (YES) is obtained in step S110, and one cycle of execution of the routine is terminated.

If a negative decision (NO) is obtained in either of the two determinations indicated just above, a negative decision (NO) is obtained in step S110, and the control flow goes to step S120 to determine whether the currently selected provisional value $N1_{(i)}$ is smaller than the upper limit f, namely, to determine whether there is left the next provisional value $N1_{(i+1)}$ which is larger than the currently selected one $N1_{(i)}$. If an affirmative decision (YES) is obtained in step S120, the control flow goes back to step S90 to increment the provisional value $N1_{(i)}$, that is, to obtain the current provisional value $N1_{(i)}$ by adding the predetermined increment f/NDo to the last provisional value $N1_{(i-1)}$. Namely, the provisional value $N1_{(i)}$ to be selected in step S90 is calculated according to the following equation:

$$N1_{(i)}=N1_{(i-1)}+f/NDo.$$

Steps S90–S120 are repeatedly implemented as described above. When the currently selected provisional value $N1_{(i)}$ reaches the upper limit f during repeated implementation of steps S90–S120, a negative decision (NO) is obtained in step S120. This means that the provisional values N1 within the variation range do not include the next provisional value $N1_{(i+1)}$ which is larger than the current provisional value $N1_{(i)}$. In other words, any supplemental bending position selected along the x-axis for a first supplemental bending action does not permits the manufacture of the desired products, without suitably selecting the workpiece rotation angle and the supplemental bending angle, and/or effecting a second supplemental bending action. In this case, the control flow goes to step S140 and subsequent steps of FIG. 30, which include steps substantially the same as the steps S90–S120 which have been described. Those substantially same steps will be briefly described.

Step S140 is provided to select or increment the provisional value $N1_{(i)}$ of the first workpiece feeding distance N1. Step S140 is followed by step S150 to select or increment a provisional value $N2_{(j)}$ of the first workpiece rotation angle $N2_{(j)}$ ($j=1, 2, \ldots j_{MAX}$), as in step S140 (step S90). Step S160 is then implemented to calculate the corrected vectors according to the above-indicated vector equations and on the basis of the currently selected provisional values $N1_{(i)}$ and $N2_{(j)}$. Step S160 is followed by step S170 similar to step S110, to determine whether a currently selected combination of the provisional values $N1_{(i)}$ and $N2_{(j)}$ is acceptable. If an affirmative decision (YES) is obtained in step S170, one cycle of execution of the routine is terminated. If a negative decision (NO) is obtained in step S170, the control flow goes to step S180 to determine whether the currently selected provisional value $N2_{(j)}$ is smaller than the upper limit $\phi$. If an affirmative decision (YES) is obtained in step S180, the control flow goes back to step S150 to increment the provisional value $N2_{(j)}$. Steps S150–180 are repeatedly implemented until the affirmative decision is obtained in step S170 or until a negative decision (NO) is obtained in step S180.

If the negative decision (NO) is obtained in step S180 during repeated implementation of steps S150–180, the control flow goes to step S190 to determine whether the currently selected provisional value $N1_{(i)}$ is smaller than the upper limit f. If an affirmative decision (YES) is obtained in step S190, the control flow goes to step S140 to increment the provisional value $N1_{(i)}$. This means that any provisional value $N2_{(j)}$ of the first workpiece rotation angle in combination with the last provisional value $N1_{(i-1)}$ of the first workpiece feeding distance permits the manufacture of the desired product. Consequently, the provisional value $N1_{(i)}$ is incremented in step S140 to seek an optimum combination of the next provisional value $N1_{(i)}$ with any provisional value $N2_{(j)}$.

If any combination of the provisional values $N1_{(i)}$ and $N2_{(j)}$ of the first workpiece feeding distance and rotation angle is found acceptable during repeated implementation of steps S140–S190, that is, a negative decision (NO) is eventually obtained in step S190, the control flow goes to step S200 and subsequent steps of FIG. 31.

Step S200 is provided to select the provisional value $N1_{(i)}$ of the first workpiece feeding distance N1. Step S200 is followed by step S210 to select the provisional value $N2_{(j)}$ of the first workpiece rotation angle N2. Then, step S220 is implemented to select a provisional value $N3_{(k)}$ (k=1, 2, . . . $k_{MAX}$) of the first supplemental bending angle N3. Step S220 is followed by step S230 to calculate the corrected vectors according to the above-indicated vector equations and on the basis of the currently selected provisional values $N1_{(i)}$, $N2_{(j)}$ and $N3_{(k)}$. Then, the control flow goes to step S240 to determine whether a currently selected combination of the provisional values $N1_{(i)}$, $N2_{(j)}$ and $N3_{(k)}$ is acceptable. If an affirmative decision (YES) is obtained in step S240, one cycle of execution of the routine is terminated.

If a negative decision (NO) is obtained in step S240, step S250 is implemented to determine whether the currently selected provisional value $N3_{(k)}$ is smaller than the upper limit $\theta$. If an affirmative decision (YES) is obtained in step S250, the control flow goes to step S220 to increment the provisional value $N1_{(k)}$. Steps S220–S250 are repeatedly implemented until an affirmative decision (YES) is obtained in step S240 or until a negative decision (NO) is obtained in step S250. If the affirmative decision (YES) is not obtained in step S240 during repeated implementation of steps S220–S250, it means that none of the combinations of the currently selected provisional values $N1_{(i)}$ and $N2_{(j)}$ with any provisional value N3(k) are acceptable. In this case, the negative decision (NO) is obtained in step S250, and the control flow goes to step S260 to determine whether the currently selected provisional value $N2_{(j)}$ is smaller than the upper limit $\phi$. If an affirmative decision (YES) is obtained in step S260, the control flow goes back to step S210 to increment the provisional value $N2_{(j)}$. Steps S210–S260 are repeatedly implemented until the affirmative decision (YES) is obtained in step S240 or until a negative decision (NO) is obtained in step S260. If the affirmative decision (YES) is not obtained in step S240 during repeated implementation of steps S210–S260, it means that none of the combinations of the currently selected provisional values $N1_{(i)}$ and $N3_{(k)}$ with any provisional value N2(j) are acceptable. In this case, the negative decision (NO) is obtained in step S260, and the control flow goes to step S270 to determine whether the currently selected provisional value $N1_{(i)}$ is smaller than the upper limit f. If an affirmative decision (YES) is obtained in step S270, the control flow goes back to step S210 to increment the provisional value $N1_{(i)}$. Steps S200–S270 are repeatedly implemented until the affirmative decision is obtained in step S240 or until a negative decision (NO) is obtained in step S270.

If none of the combinations of the currently selected provisional values $N2_{(j)}$ and $N3_{(k)}$ with any provisional value $N1_{(i)}$ are found during repeated implementation of steps S200–S270, namely, if the negative decision (NO) is eventually obtained in step S270, the control flow goes to step S280 of FIG. 32.

It will be understood that steps S90–S120 of FIG. 29 correspond to step S21 of FIG. 28, and steps S140–S190 of FIG. 20 correspond to step S22 of FIG. 28, while steps S200–S270 of FIG. 31 correspond to step S23 of FIG. 28. It will also be understood that steps S280–S410 of FIG. 32 correspond to steps S24–S26 of FIG. 28, and step S420 of FIG. 32 corresponds to step S27 of FIG. 28.

In the flow chart of FIG. 32, steps S280, S290 and S300 are sequentially implemented to select the provisional values N1, N2, N3 of the first workpiece feeding distance, workpiece rotation angle and supplemental bending angle, respectively. Then, steps S310, S320 and S330 are sequentially implemented to select the provisional values N4, N5, N6 of the second workpiece feeding distance, workpiece rotation angle and supplemental bending angle, respectively.

The control flow then goes to step S340 to calculate the corrected vectors (corrected outlet end center vector and corrected outlet end normal line vector) according to the above-indicated vector equations and on the basis of the currently selected combination of the provisional values N1–N6. Step S350 is then implemented to determine whether the currently selected combination of the provisional values N1–N6 is acceptable. If an affirmative decision (YES) is obtained in step S350, one cycle of execution of the routine is terminated.

If a negative decision (NO) is obtained in step S350, the control flow goes to step S360 to determine whether the currently selected provisional value N6 is smaller than the upper limit $\theta$. If an affirmative decision (YES) is obtained in step S360, the control flow goes back to step S330 to increment the provisional value N6. Steps S330–S360 are repeatedly implemented until the affirmative decision is obtained in step S350 or until a negative decision (NO) is obtained in step S360. If the affirmative decision is not obtained in step S350 during repeated implementation of steps S330–S360, it means that none of the combinations of the currently selected provisional values N1–N5 with any provisional value N6 are acceptable. In this case, the negative decision (NO) is obtained in step S360, and the control flow goes to step S370 to determine whether the currently selected provisional value N5 is smaller than the upper limit $\phi$. If an affirmative decision (YES) is obtained in step S370, the control flow goes back to step S320 to increment the provisional value N5. Steps S320–S370 are repeatedly implemented until the affirmative decision is obtained in step S350 or until a negative decision (NO) is obtained in step S370. If the affirmative decision is not obtained in step S350 during repeated implementation of steps S320–S370, it means that none of the combinations of the currently selected provisional values N1–N4 and N6 with any provisional value N5 are acceptable. In this case, the negative decision (NO) is obtained in step S370, and the control flow goes to step S380 to determine whether the currently selected provisional value N4 is smaller than an upper limit (f–N1), which is a difference between the upper limit f and the first workpiece feeding distance N1.

In step S380, the currently selected provisional value N4 is not compared with the upper limit f, but is compared with the difference (f–N1), for the reason explained below. That is, the provisional value N4 is the second workpiece feeding distance used for the second supplemental action. It is noted that both the first supplemental bending action and the second supplemental bending action take place at the respective supplemental bending positions (defined by the first and second workpiece feeding distances N1 and N4), which should be selected within the straight inlet end portion of the workpiece. The upper limit for the second workpiece feeding distance N4 is set to be f–N1 since the second supplemental bending position is selected to be nearer to the chuck 100 than the first supplemental bending position while the first supplemental bending position is selected to be nearer to the bending mechanism 52.

If an affirmative decision (YES) is obtained in step S380, the control flow goes back to step S310 to increment the provisional value N4. Steps S310–S380 are repeatedly implemented until the affirmative decision is obtained in step S350 or until a negative decision (NO) is obtained in step S380. If the affirmative decision is not obtained in step S350 during repeated implementation of steps S310–S380, it means that none of the combinations of the currently selected provisional values N1–N3, N5 and N6 with any provisional value N4 are acceptable. In this case, the negative decision (NO) is obtained in step S380, and the control flow goes to step S390 to determine whether the currently selected provisional value N3 is smaller than the upper limit θ. If an affirmative decision (YES) is obtained in step S390, the control flow goes back to step S300 to increment the provisional value N3. Steps S300–S390 are repeatedly implemented until the affirmative decision is obtained in step S350 or until a negative decision (NO) is obtained in step S390. If the affirmative decision is not obtained in step S350 during repeated implementation of steps S300–S390, it means that none of the combinations of the currently selected provisional values N1, N2 and N4–N6 with any provisional value N3 are acceptable. In this case, the negative decision (NO) is obtained in step S390, and the control flow goes to step S400 to determine whether the currently selected provisional value N2 is smaller than the upper limit ®. If an affirmative decision (YES) is obtained in step S400, the control flow goes back to step S290 to increment the provisional value N2. Steps S290–S400 are repeatedly implemented until the affirmative decision is obtained in step S350 or until a negative decision (NO) is obtained in step S400. If the affirmative decision is not obtained in step S350 during repeated implementation of steps S300–S390, it means that none of the combinations of the currently selected provisional values N1 and N3–N6 with any provisional value N2 are acceptable. In this case, the negative decision (NO) is obtained in step S400, and the control flow goes to step S410 to determine whether the currently selected provisional value N1 is smaller than the upper limit f. If an affirmative decision (YES) is obtained in step S410, the control flow goes back to step S280 to increment the provisional value N1. Steps S280–S410 are repeatedly implemented until the affirmative decision is obtained in step S350 or until a negative decision (NO) is obtained in step S410.

If the affirmative decision is not obtained in step S350 during repeated implementation of steps S280–S410, it means that none of the combinations of the currently selected provisional values N2–N6 with any provisional value N1 are acceptable. In this case, the negative decision is obtained in step S410, and the control flow goes to step S420 to activate a display device to inform the operator that the controller 46 is not able to achieve automatic determination of the supplemental bending parameters that permit the manufacture of the desired product from the initially bent workpiece. Thus, one cycle of execution of the supplemental bending information determining routine is completed.

It will be understood from the foregoing explanation of the present embodiment that the step SDI of the flow chart of FIG. 4 (steps 530–S420 of the flow charts of FIGS. 29–32) is one form of a step of determining the actual relative position between the opposite ends of an initially bent workpiece, and determining, on the basis of the determined actual relative position, a value of each of at least one supplemental bending parameter used for effecting a supplemental bending operation on the initially bent workpiece for reducing an error between the actual relative position and a nominal relative position between the opposite ends of a product to be obtained by the supplemental bending operation. It will also be understood that a portion of the controller 46 assigned to execute the step SDI or steps S30–S420 constitutes one form of relative position obtaining means for obtaining an actual relative position between the opposite ends of the initially bent workpiece, and a nominal relative position between the opposite ends of the product, and one form of supplemental bending information determining means for determining, on the basis of the actual and nominal relative positions, the value of each of at least one of a supplemental bending position (supplemental bending position along the x-axis and/or supplemental bending position about the x-axis) and a supplemental bending amount or angle.

There will be described other embodiments of the present invention.

In the first embodiment described above, the division number ND by which the variation range of each supplemental bending parameter is divided to determine a plurality of provisional values is a fixed or constant value. If the division number ND is excessively small and the number of the provisional values is excessively small, none of the provisional values are determined to be acceptable. To avoid this drawback, the division number ND should be comparatively large. Accordingly, the number of the provisional values to be examined tends to be unnecessarily large. In the light of this fact, a second embodiment is formulated such that the division number ND changes as needed, as indicated in FIGS. 33(*a*), 33(*b*) and 33(*c*), in an attempt to reduce the number of the provisional values to an extent possible. In the example of FIGS. 33(*a*)–33(*c*), the division number ND is selectable from among "3", "5" and "6".

The present second embodiment uses a supplemental bending information determining routine as illustrated in the flow chart of FIG. 34. This routine is initiated with step S600 to set the division number $ND_{(i)}$ to a predetermined initial value NDo stored in the ROM 202 of the controller 46. Step S600 is followed by step S610 to divide the variation range of the supplemental bending parameter in question by the initial division number NDo, to determine a plurality of provisional values of the parameter. Then, the control flow goes to step S620 to select the smallest one of the provisional values, as the current provisional value. Step S620 is followed by step S630 to calculate the corrected outlet end center vector and corrected outlet end normal line vector on the basis of the currently selected provisional value. Then, step S640 is implemented to determine whether the currently selected provisional value is acceptable, that is, whether the corrected vectors are held within predetermined tolerance ranges. If a negative decision (NO) is obtained in step S640, the control flow goes to step S650 to determine whether another provisional value is present or available. If an affirmative decision (YES) is obtained in step S650, the control flow goes to step S620 to increment the provisional value. Steps S620–S650 are repeatedly implemented until an affirmative decision (YES) is obtained in step S640 or until a negative decision (NO) is obtained in step S650. If none of the provisional value are found acceptable in step S640, that is, if the negative decision (NO) is obtained in step S650, the control flow goes to step S660 to change the division number ND.

The division number ND may be changed, for example, by adding a predetermined increment ΔND to the last division number $ND_{(i-1)}$ to thereby obtain the present division number $ND_{(i)}$, or in any other suitable way. In the present second embodiment, however, a fuzzy inference is utilized to change the division number ND.

Described in detail, the fuzzy inference uses fuzzy labels for an error D between the corrected vector and the nominal vector of the workpiece as described above, and for the division number ND. That is, the fuzzy inference uses a fuzzy label "B" indicating that the error D or division number ND is big, a fuzzy label "S" indicating that the error D or division number ND is small, and a fuzzy label "M" indicating that the error D or division number ND is medium. Further, membership functions as indicated in FIGS. 35(*a*), 35(*b*) and 35(*c*) are used for the division number ND. To effect the fuzzy inference, the following nine fuzzy rules are used:

1. if D=B and ND=B then ND=B
2. if D=M and ND=B then ND=M
3. if D=S and ND=B then ND=S
4. if D=B and ND=M then ND=B
5. if D=M and ND=M then ND=M
6. if D=S and ND=M then ND=S
7. if D=B and ND=S then ND=B
8. if D=M and ND=S then ND=M
9. if D=S and ND=S then ND=S If the fuzzy label for the last error $D_{(i-1)}$ and the fuzzy label for the last division number $ND_{(i-1)}$ are both B, the fuzzy rule 1 is satisfied, and the membership function (ND=B) indicated in FIG. 35(*c*) is selected. In this case, the fuzzy inference value (0 to 1) for the last division number $ND_{(i-1)}$ is determined according to the selected membership function. The determined fuzzy inference value is multiplied by a suitable value larger than "1", for example, multiplied by 10, to obtain a compensating coefficient $KC_{(i)}$. The present division number $ND_{(i)}$ is obtained by multiplying the last division number $ND_{(i-1)}$ by the compensating coefficient $KC_{(i)}$. That is, the division number $ND_{(i)}$ is changed or updated according to the following equation:

$$ND_{(i)}=KC_{(i)}\cdot ND_{(i-1)}$$

Step S660 is followed by step S670 to determine whether the present division number $ND_{(i)}$ is equal to or smaller than an upper limit $ND_{MAX}$. If an affirmative decision (YES) is obtained in step S670, the control flow goes to step S610 to divide the variation range of the supplemental bending parameter in question by the updated division number $ND_{(i)}$. Steps S610–S670 are repeatedly implemented until an affirmative decision (YES) is obtained in step S640 or until a negative decision (NO) is obtained in step S670. If none of the provisional values obtained in step S610 are acceptable, that is, if the negative decision (NO) is obtained in steps S650 and S660, the control flow goes to a group of steps for determining whether any combination of provisional values of two supplemental bending parameters is acceptable in the same manner as in the first embodiment, except for the variable division number ND.

It will be understood that the fuzzy rules used in the present second embodiment are formulated such that the compensating coefficient KC for determining the next division number ND increases with an increase in the error D, even if the last division number ND is the same (e.g., fuzzy label B as in the fuzzy rules 1–3). Accordingly, the division number ND increases with an increase in the error D. Therefore, the present arrangement is adapted such that the difference between the adjacent provisional values of each supplemental bending parameter is smaller when the error D is relatively large than when the error D is relatively small. In the present arrangement, the rate at which the difference between the adjacent provisional values is reduced is relatively high while the error D is relatively large, and the rate of reduction of the difference is made relatively low after the error D is reduced. The present arrangement is therefore effective to assure the determination of the acceptable provisional value (with the error D held within the tolerance range), while permitting high-speed or efficient determination of the acceptable provisional value.

The present second embodiment is adapted such that the provisional value of the supplemental bending parameter is incremented (increased in steps), and a determination is made as to whether each provisional value is acceptable, and such that the determination routine is terminated as soon as the provisional value under examination has been found acceptable, that is, as soon as the error corresponding to the provisional value falls within the tolerance range determined by the nominal value. However, the error within the tolerance range does not necessarily mean that the corrected vectors of the workpiece coincide with the nominal vectors. In some cases, the corrected vectors should coincide with the nominal vectors with accuracy as high as possible. In view of this requirement, the following modified arrangement is possible to determine the optimum provisional value.

In the modified arrangement, the provisional value is incremented, as in the above embodiments. However, a determination as to whether each provisional value is acceptable is not effected until the sets of the corrected vectors of the workpiece corresponding to all the provisional values have been estimated and stored in the RAM 204. The stored sets of corrected vectors are examined to detect one of the sets which is closest to the nominal vectors. The provisional value corresponding to the closest set of corrected vectors is determined to be the optimum value of the supplemental bending parameter in question.

However, the above modified arrangement requires the examination of a relatively large number of provisional values within the variation range of the parameter in question. This means a comparatively large memory capacity of the RAM 204 required to store the corrected vector values corresponding to the provisional values. Further, the estimation of the corrected vector values corresponding to all the provisional values requires a considerable data processing time, whereby it is difficult to improve the efficiency of determination of the optimum value of the parameter. For obtaining the optimum parameter value sufficiently close to the nominal value while reducing the required memory capacity of the RAM 204 and improving the data processing efficiency, the following alternative arrangement is possible.

In this alternative arrangement, the variation range of each supplemental bending parameter is divided by a predetermined initial division number NDo, to determine a plurality of provisional values which are sequentially examined in the same order as described above. That is, the provisional value is incremented. For each provisional value, the corrected outlet end center vector and the corrected outlet end normal line vector are estimated, and an overall error $D_T$ is obtained on the basis of the error angle $D_A$ between the corrected and nominal outlet end normal line vectors, and the error distance $D_P$ between the corrected and nominal outlet center positions. However, the overall error $D_T$ is preferably obtained by giving a heavier weight to the error distance $D_P$, the reduction of which more effectively contributes to preventing defective welding of the product in the form of the branch pipe 22 to the flange and main portions 10, 14 of the exhaust manifold, that the reduction of the error angle $D_A$. For preventing the defective welding, it is important to minimize the variation of the distance DE between the welding torch and the welding point as indicated in FIG. 7. For reducing this variation, the accuracy of the outlet end center position is more important than the angle of the outlet end face.

For example, the overall error $D_T$ may be determined according to the following equation:

$$D_T = w_1 \cdot D_A + w_2 \cdot D_P$$

where, $w_1$ and $w_2$: weights

The weights $w_1$ and $w_2$ are set to be equal to each other when it is desired to equivalently treat the error angle $D_A$ and error distance $D_P$. The weight $w_1$ is set to be larger than the weight $w_2$ when it is desired to give the error angle $D_A$ a heavier weight. The weight $w_2$ is set to be larger than the weight $w_1$ when it is desired to give the error distance $D_P$ a heavier weight. Although the overall error $D_T$ is obtained as the sum of the error angle $D_A$ and the error distance $D_P$ according to the above equation, the overall error $D_T$ may be obtained as a product of the error angle $D_A$ and the error distance $D_P$.

As the provisional value is incremented (increased in steps), the sign of the error D is reversed from a positive value to a negative value or vice versa when the provisional value exceeds a given value, and the absolute value of the error D continuously changes as indicated in the graph of FIG. 19. The continuous change of the error D with an increase of the provisional value may be utilized to relatively accurately estimate the tendency of change of the error D with the increase of the provisional value over the entirety of the variation range of the parameter in question, even where the number of the provisional values to be examined is relatively small.

In the light of the above consideration, the supplemental bending information determining routine according to a third embodiment is formulated as illustrated in the flow chart of FIG. 36. The routine is initiated with step S700 to divide the predetermined variation range of the appropriate parameter by the presently selected division number $ND_{(i)}$ to provide a plurality of provisional values of the parameter. In the first cycle of execution of the routine, the division number is the initial number NDo. Step S700 is followed by step S710 to select or increment the provisional value. Then, the control flow goes to step S720 to estimate the corrected outlet end center vector and the corrected outlet end normal line vector (hereinafter referred to as "corrected vectors"), on the basis of the provisional value selected in step S710. Step S730 is then implemented to calculate the error D on the basis of the corrected value, and step S740 is implemented to determine whether the sign of the error D has been reversed, that is, has changed from a negative value to a positive value or vice versa.

If a negative decision (NO) is obtained in step S740, the control flow goes to step S750 to determine whether there is left another provisional value. If an affirmative decision (YES) is obtained in step S750, the control flow goes back to step S710 to increment the provisional value. If a negative decision (NO) is obtained in step S750, the control flow goes to a group of steps for determining whether any combination of provisional values of two supplemental bending parameters is acceptable.

If an affirmative decision (YES) is obtained in step S740 during repeated implementation of steps S710–S750, the control flow goes to step S760 to count the number of the provisional values which correspond to the currently selected division number $ND_{(i)}$ and which permit the error D to fall within the predetermined tolerance range, and determine whether the counted number of the provisional values is larger than a predetermined threshold. If a negative decision (NO) is obtained in step S760, step S770 is implemented to increment the division number ND(i), and the control flow goes back to step S700 to first determine a plurality of new provisional values by dividing the variation range of the parameter by the currently selected division number $ND_{(i)}$, and then determine a narrowed or new variation range of the parameter on the basis of the "last provisional value" according to the previous division number ND, which value caused the reversal of the sign of the error D, as indicated in FIGS. 37(*a*), 37(*b*) and 37(*c*). Described more specifically, the previous division number ND provides a plurality of division areas each defined by the two adjacent previous provisional values, as indicated in FIG. 37(*a*). From among these division areas, there are selected three division areas, which consist of: the division area (hereinafter referred to as "last division area") whose upper limit is defined by the last provisional value; and the two division area which sandwich the last division area or which precede and follow the last division area, respectively, as also indicated in FIG. 37(*a*). Only the new provisional values which are located within the thus determined narrowed or new variation range of the parameter as indicated in FIG. 37(*b*) are sequentially used in step S710. If the division number ND is further incremented in step S770, the variation range is further narrowed as indicated in FIG. 37(*c*).

If an affirmative decision (YES) is obtained in step S760 during repeated execution of the routine of FIG. 36, the control flow goes to step S780 to determine, as the optimum value of the parameter, one of the provisional values within the tolerance, which corresponds to the corrected vectors that are closest to the nominal vectors.

The present third embodiment is adapted to use the last division area which caused the reversal of the sign of the error D according to the provisional values obtained by the last division number ND, but also the division areas which precede and follow the last division area, to narrow the variation range of the parameter as the division number ND is incremented, for determining the optimum value of the parameter. This arrangement prevents a failure to find out the optimum value, which would occur if only the last division area is used as the narrowed or new variation range in which the new provisional value is incremented. However, it is possible to use only the last division area according to the last division number ND.

The present embodiment is adapted to determine the optimum value of each of two or more supplemental bending parameters in combination, in the same manner as described above. However, it is possible to modify the present arrangement by: obtaining the error D for a relatively small number of provisional values for each parameter; obtaining the amount of change of the error D with respect to the amount of change of the provisional value, namely, the rate of change of the error D (rate at which the error D changes toward or away from the nominal value); selecting one of the combinations of the provisional values of all the parameters which permits the highest range of change of the error D; and dividing the division area of each parameter which includes the provisional value nearest to the nominal value, to further narrow the range of the parameter, for more accurately determine the optimum value of each parameter.

A fourth embodiment of the invention will be described.

In the second and third embodiments described above, the predetermined fixed variation range of the parameter in question is divided to determine a plurality of provisional values to be examined. In the fourth embodiment, the variation range of each parameter to be divided is changed. Described in detail, the currently established variation range is divided into a plurality of division areas to determine a plurality of provisional values. If these provisional values do not include a provisional value which permits the corresponding error to fall within the tolerance range, one of the division areas which is defined by the two adjacent provisional values and which is expected to include the optimum value of the parameter is selected as the new variation range of the parameter. This new variation range is divided into a plurality of division areas to determine a plurality of new provisional values to be examined.

The fourth embodiment will be described by reference to the flow chart of FIG. 39, in connection with an example illustrated in FIG. 40.

FIG. 40 schematically shows one specific case in which provisional values of a given parameter are determined in relation to variation ranges of the parameter. In this figure, a rectangular block indicates a range within which the provisional values of the parameter permit the corresponding corrected vectors to fall within the tolerance range. That is, this range corresponds to the tolerance range of the corrected vectors with respect to the nominal vectors.

The routine of FIG. 39 is initiated with step S801 to divide the initial variation range of the parameter by the initial division number NDo, to determine a plurality of first provisional values. In FIG. 40, these first provisional values are indicated at U11 through U14. Step S801 is followed by step S802 to set the smallest one of the determined first provisional values as the initial provisional value. In the example of FIG. 40, the provisional value U11 is selected in the first cycle of execution of the routine. Step S803 is then implemented to estimate the corrected vectors on the basis of the currently selected first provisional value. Step S803 is followed by step S804 to calculate the error D between the corrected vectors and the nominal vectors. Then, the control flow goes to step S805 to determine whether the sign of the error D has been reversed, that is, whether the currently selected first provisional value is larger than the optimum value which permits the actual vectors to coincide with the nominal vectors. If a negative decision (NO) is obtained, the control flow goes to step S806.

Step S806 is provided to determine whether there is left another first provisional value. If an affirmative decision (YES) is obtained in step S806, step S807 is implemented to update or increment the first provisional value. In the example of FIG. 40, the first provisional value U12 is selected as the current provisional value.

If an affirmative decision (YES) is obtained in step S805 during repeated implementation of steps S803–S807, the control flow goes to step S808 to determine whether the error D is sufficiently small. This determination may be made by determining whether the last provisional value which caused the reversal of the sign of the error D is within the predetermined tolerance range, or whether the provisional value immediately preceding the last provisional value is within the tolerance range. If a negative decision (NO) is obtained in step S808, the control flow goes to step S809 to update or narrow the variation range of the parameter, such that the narrowed variation range is the division area of the initial variation range which division area is defined by the above-identified last provisional value and the provisional value which immediately precedes the last provisional value. In the example of FIG. 40, the division area defined by the first provisional values U12 and U13 is determined as the narrowed or new variation range.

Step S809 is followed by step S810 to update the division number ND, and step S811 to divide the new variation range by the updated or currently selected division number ND, to determine a plurality of second provisional values. In the example of FIG. 40, the second provisional values are indicated at U21–U24.

In the example of FIG. 40, the division number updated in step S810 is the same in step S801, namely, "3". Even if the division number ND remains unchanged, the difference between the adjacent second provisional values (increment of the second provisional value) is made smaller than that of the first provisional values, since the variation range to be divided by the division number ND is narrowed. Unlike the second and third embodiments of FIGS. 33–38, the present fourth embodiment of FIGS. 39–40 does not require the division number ND to be incremented to reduce the difference between the adjacent provisional values. In the present embodiment, therefore, the division number ND used in step S810 is the same as the initial division number NDo used in step S801. However, the division number ND may be changed in relation to the amount of the error D, for instance, by fuzzy inference as explained above by reference to FIG. 35. In this case, however, the division number ND is determined by the fuzzy inference such that the determined division number ND is smaller when the error D is relatively large than when the error D is relatively small.

If the negative decision (NO) is still obtained in step S808 even after the affirmative decision (YES) is obtained in step S805 during repeated implementation steps S802–S807, steps S808–S811 are again implemented to determine a plurality of third provisional values, which are indicated at U31–U34 in FIG. 40.

If an affirmative decision (YES) is obtained in step S805 after the affirmative decision (YES) is obtained in step S805 during subsequent repeated implementation of steps S802–S807, the last provisional value which permits the error D to fall within the tolerance range is determined as the optimum value of the parameter in question.

In the present fourth embodiment, the RAM 204 is required to store only the set of provisional values corresponding to the last used division number ND, for determining the optimum value of each supplemental bending parameter. In other words, the provisional values corresponding to the previous division number or numbers ND are not required to be stored in the RAM 204, whereby the required memory capacity of the RAM 204 may be reduced, and the data processing efficiency may be easily increased.

In the fourth embodiment, the difference between the first two provisional values (U11 and U12 in the example of FIG. 40) is automatically determined by dividing the initial variation range by the initial division number NDo which is inputted by the operator. Namely, the operator indirectly determines the difference between the first two provisional values U11, U12. However, the operator may directly specify this difference independently of the initial variation range of the parameter.

Referring next to FIGS. 41–43, there will be described a fifth embodiment of this invention. In the fourth embodiment of FIGS. 39–40, the provisional value is increased with a predetermined constant increment until the sign of the error D is reversed, and the increment of the provisional value is reduced only after the sign of the error D is reversed. However, the present fifth embodiment is adapted such that the amount of increase of the next provisional value with respect to the present provisional value is determined each time the error D is calculated, as indicated in FIG. 41. This amount of increase is determined so as to increase with an increase in the present amount of error D. In this embodiment, the amount of increase of the present provisional value with respect to the preceding value is reduced as the provisional value approaches the optimum value of the parameter. This arrangement makes it possible to determine the required supplemental bending parameters with maximum efficiency while minimizing the number of the provisional values to be examined.

The supplemental bending information determining routine according to the fifth embodiment is illustrated in the flow chart of FIG. 42. A portion of the routine of FIG. 42 which is similar to the corresponding portion of FIG. 39 will be only briefly described.

The routine is initiated with step S901 to determine the initial provisional value, which may be the lower limit of the variation range of the parameter, which may be equal to "0" as in the example of FIG. 40. Step S901 is followed by step S902 to estimate the corrected vectors of the workpiece on the basis of the provisional value, and step S903 to calculate the error D of the corrected vectors with respect to the nominal vectors. Step S904 is then implemented to determine whether the present error $D_{(i)}$ is sufficiently small, that is, held within the tolerance range. If an affirmative decision (YES) is obtained in step S904, the provisional value in question is determined as the optimum value of the parameter, and the routine is terminated.

If a negative decision (NO) is obtained in step S904, the control flow goes to step S905 to determine the next division number $ND_{(i+1)}$.

The division number ND used in the routine of FIG. 42 has a significance different from that used in the second embodiment of FIGS. 33–35. In the fourth embodiment, the division number ND is incremented or updated to increase the number of the provisional values within the variation range so that the increment of the provisional values corresponding to the new division number is reduced as compared with that of the provisional values corresponding to the previous division number. In the present fifth embodiment, however, the division number ND is used to reduce the amount of increase of the next provisional value with respect to the present provisional value. In the present embodiment, the division number ND is used to determine the number of the provisional value, but is used only for the purpose of determining the amount of increase of the next provisional value with respect to the present provisional value.

Described more specifically, the division number ND in the present fifth embodiment is used to divide a predetermined constant reference amount of increase ΔLo. The product ΔLo/ND may be considered an amount of increase of each provisional value with respect to the previous value, as is apparent from the following description of step S906. The reference amount of increase ΔLo is selected by the operator within a certain permissible range.

For determining the next division number $ND_{(i+1)}$ in step S905, the ROM 202 of the controller 46 stores data representative of a predetermined relationship between the error D and the division number ND. The next division number $ND_{(i+1)}$ is determined on the basis of the calculated error D and according to the stored predetermined relationship. An example of the predetermined relationship is indicated in the graph of FIG. 43. This relationship is formulated such that the division number ND is equal to "1" while the error D is larger than a certain threshold, and increases as the error D decreases. Since the constant reference amount of increase ΔLo is divided by the updated division number ND, an increase in the division number ND with a decrease in the error D will result in a decrease in the amount of increase of each provisional value with respect to the previous or last value.

After the division number ND is determined in step S905, the control flow goes to step S906 to calculate the amount of increase $\Delta L_{(i+1)}$ by dividing the reference amount of increase ΔLo by the division number $ND_{(i+1)}$, and update the provisional value by adding the calculated amount of increase $\Delta Lo_{(i+1)}$, namely, ΔLo/ND to the previous or last provisional value. Then, step S907 is implemented to determine whether the updated provisional value is smaller than an upper limit of the variation range of the parameter. If an affirmative decision (YES) is obtained in step S907, the control flow goes back to step S902 to estimate the corrected vectors. If a negative decision (NO) is obtained in step S907 before the affirmative decision (YES) is obtained in step S904, the control flow goes to a group of steps for determining optimum values of two or more supplemental bending parameters in combination.

While the present invention has been described in its presently preferred embodiments, it is to be understood that the present invention may be otherwise embodied.

For example, although the illustrated embodiments are adapted to increment or gradually increase the provisional value to be examined for finding out the optimum value of each supplemental bending parameter, the provisional value may be decremented or gradually decreased.

In the modified arrangement of the second embodiment of FIGS. 33–35 described above, sets of the corrected vectors of the workpiece corresponding to all the provisional values have been estimated and stored in the RAM 204, and the stored sets of corrected vectors are examined to detect one of the sets which is closest to the nominal vectors. The provisional value corresponding to the closest set of corrected vectors is determined to be the optimum value of the supplemental bending parameter in question. This modified arrangement may be improved as described below, in view of a fact that a single bending action of the initially bent workpiece is advantageous over two supplemental bending actions on the workpiece, in terms of the time and cost, and the number of process steps of the supplemental bending operation. That is, the above modified arrangement may be improved such that not only the error between the corrected vectors and the nominal vectors, but also the number (1 or 2) of the supplemental bending actions are taken into account to determine the optimum value or values of the supplemental bending parameter or parameters.

To determine the optimum parameter value or values in the improved arrangement indicated above, it is possible to use, for example, an evaluating value which is a product of the error D, and a coefficient Kp which changes with the number of the supplemental bending actions, namely, which is larger when the number of the supplemental bending actions is equal to "2" than when the number is equal to "1". In this improved arrangement, the evaluating values corresponding to the sets of corrected vectors corresponding to all the provisional values are stored in the RAM 204, and the provisional value which corresponds to the smallest evaluating value is determined as the optimum value of each supplemental bending parameter.

It is to be understood that the present invention may be embodied with various other changes, modifications and improvements, which may occur to those skilled in the art, without departing from the spirit and scope of the invention defined in the following claims:

What is claimed is:

1. A method of effecting a supplemental bending operation on an initially bent workpiece having a centerline extending between opposite ends thereof and having been subjected to an initial bending operation at an initial bending position selected along the centerline, said supplemental bending operation being effected for correcting a relative position between the opposite ends of said initially bent workpiece, said method comprising the steps of:

determining an actual relative position between said opposite ends of said initially bent workpiece, and determining, on the basis of the determined actual relative position, a value of at least one supplemental bending parameter used for effecting said supplemental bending operation on said initially bent workpiece, for reducing an error between said actual relative position and a nominal relative position between opposite ends of a product to be obtained by said supplemental bending operation, said at least one supplemental bending parameter including one of a supplemental bending position and a supplemental bending amount when the other of said supplemental bending position and said supplemental bending amount has been determined as known, and both said supplemental bending position and said supplemental bending amount when neither of said supplemental bending position and said supplemental bending amount has been determined as known, said supplemental bending position being different from said initial bending position, said supplemental bending amount being an amount of bending of said workpiece by said supplemental bending operation at said supplemental bending position; and performing said supplemental bending operation at the determined supplemental bending position, so as to achieve the determined supplemental bending amount.

2. A method according to claim 1, wherein said step of determining a value of each of at least one supplemental bending parameter comprises:

determining a plurality of provisional values of each of said supplemental bending position and said supplemental bending amount; and obtaining an estimated relative position between the opposite ends of said product to be obtained by said supplemental bending operation, for each of a plurality of combinations of said provisional values of said supplemental bending position and amount, and selecting, as supplemental bending parameters, one of said plurality of combinations which permits an error between said estimated relative position and said nominal relative position to be smaller than a predetermined threshold.

3. A method according to claim 2, wherein said determining a plurality of provisional values comprises changing a difference between adjacent ones of said provisional values, for at least one of said supplemental bending position and amount, on the basis of an amount of said error between said estimated and nominal relative positions.

4. A method according to claim 2, wherein said determining a plurality of provisional values comprises:

determining a plurality of first provisional values of each of said supplemental bending position and amount, said first provisional values being different from each other by a predetermined value;

determining whether none of a plurality of first combinations of said first provisional values of said supplemental bending position and amount permits said error to be smaller than said predetermined threshold; and if none of said plurality of first combinations permits said error to be smaller than said predetermined threshold, selecting two values of said first provisional values of each of said supplemental bending position and amount which two values define an area which is expected to include a value that permits said error to be smaller than said predetermined threshold, and dividing said area into equal divisions to determine a plurality of second provisional values which are then considered to check if said error is smaller than said predetermined threshold.

5. A method according to claim 2, wherein said step of determining a plurality of provisional values comprises:

dividing a variation range of each of said supplemental bending position and amount by a first predetermined value to obtain a plurality of first provisional values;

determining whether none of a plurality of first combinations of said first provisional values of said supplemental bending position and amount permits said error to be smaller than said predetermined threshold; and if none of said plurality of first combinations permits said error to be smaller than said predetermined threshold, dividing said variation range by a second predetermined number larger than said first predetermined number, to thereby obtain a plurality of second provisional values which are then considered to check if said error is smaller than said predetermined threshold.

6. A method according to claim 5, wherein said step of obtaining an estimated relative position and selecting one of said plurality of combinations comprises:

selecting said plurality of first provisional values such that said first provisional values change in a predetermined first increment or decrement; and determining whether a sign of said error is reversed, wherein when said sign of said error is reversed, said plurality of second provisional values are determined such that said second provisional values change in a predetermined second increment or decrement which is smaller than said predetermined first increment or decrement, and wherein said step of obtaining an estimated relative position and selecting one of said plurality of combinations comprises:

checking only selected ones of said second provisional values which are close to one of said first provisional values which caused said sign of said error to be reversed; and determining whether any of said selected ones of said second provisional values permits said error to be smaller than said predetermined threshold and is acceptable.

7. A method according to claim 2, wherein said step of determining a plurality of provisional values comprises:

determining said error for each of said plurality of provisional values, and determining whether said error is smaller than said predetermined threshold;

if said error for a currently selected one of said plurality of provisional values is not smaller than said predetermined threshold, determining an amount of increase of a next selected one of said provisional values with respect to said currently selected one such that said amount of increase decreases with a decrease in an amount of said error for said currently selected one provisional value; and determining a sum of said currently selected provisional value and said amount of increase as said next selected provisional value.

8. A method according to claim 1, wherein said relative position between the opposite ends of said initially bent workpiece is defined in a three-dimensional coordinate system having an origin at a center of one of said opposite ends or at a position which has a constant relative relationship with said center, one of three axes of said coordinate system being aligned with a straight portion of said centerline of said workpiece which extends from said center, and wherein the other of said opposite ends is defined by at least one of a center vector which extends from said original of said coordinate system and terminates at a center of said other end, and a normal line vector which extends from said center of said other end over a predetermined length in a direction normal to a plane of a face of said other end.

9. A method according to claim 1, wherein said initially bent workpiece has a straight part at which said workpiece is held by a bending machine, and said at least one supplemental bending parameter consists of (i) a distance between said initial bending position and said supplemental bending position in a direction parallel to a straight portion of said centerline of said initially bent workpiece which corresponds to said straight part, (ii) an angle of rotation of said initially bent workpiece about said straight portion of said centerline relative to said bending apparatus, and (iii) an angle of bending of said initially bent workpiece by said supplemental bending operation at said supplemental bending position, said distance and said angle of rotation defining said supplemental bending position, while said angle of bending defining said supplemental bending amount.

10. A method according to claim 9, wherein said angle of bending is changed only if and after it is estimated that said error between said actual relative position and said nominal relative position cannot be reduced to a value smaller than a predetermined threshold by changing said distance and said angle of rotation.

11. A method according to claim 1, wherein said initially bent workpiece has a straight part at which said workpiece is held by a bending machine, and said supplemental bending operation comprises at least one supplemental bending action each of which is effected with said supplemental bending position selected along and within a straight portion of said centerline of the workpiece which corresponds to said straight part.

12. An apparatus for determining supplemental bending information for effecting a supplemental bending operation on an initially bent workpiece having a centerline extending between opposite ends thereof and having been subjected to an initial bending operation at an initial bending position selected along the centerline, the supplemental bending operation being effected for correcting a relative position between the opposite ends of said initially bent workpiece, said apparatus comprising:

relative position obtaining means for obtaining an actual relative position between said opposite ends of said initially bent workpiece; and supplemental bending information determining means for determining, on the basis of said actual relative position, a value of one of a supplemental bending position and a supplemental bending amount when the other of said supplemental bending position and said supplemental bending amount has been determined is known, and of both said supplemental bending position and said supplemental bending amount when neither of said supplemental bending position and said supplemental bending amount has been determined as known, said supplemental bending position being different from said initial bending position, and said supplemental bending amount being an amount of bending of said workpiece by said supplemental bending operation at said supplemental bending position.

13. An apparatus according to claim 12, wherein said relative position between the opposite ends of said initially bent workpiece is defined in a three-dimensional coordinate system having an origin at a center of one of said opposite ends or at a position which has a constant relative relationship with said center, one of three axes of said coordinate system being aligned with a straight portion of said centerline of said workpiece which extends from said center, and wherein the other of said opposite ends is defined by at least one of a center vector which extends from said original of said coordinate system and terminates at a center of said other end, and a normal line vector which extends from said center of said other end over a predetermined length in a direction normal to a plane of a face of said other end.

14. An apparatus according to claim 12, wherein said initially bent workpiece has a straight part at which said workpiece is held by a bending machine, said supplemental bending position being defined by a distance between said initial bending position and said supplemental bending position in a direction parallel to a straight portion of said centerline of said initially bent workpiece which corresponds to said straight part and an angle of rotation of said initially bent workpiece about said straight portion of said centerline, and said supplemental bending amount being defined by an angle of bending of said initially bent workpiece by said supplemental bending operation at said supplemental bending position.

15. An apparatus according to claim 14, wherein said angle of bending is changed only if and after it is estimated that said error between said actual relative position and said nominal relative position cannot be reduced to a value smaller than a predetermined threshold by changing said distance and said angle of rotation.

16. An apparatus according to claim 12, wherein said initially bent workpiece has a straight part at which said workpiece is held by a bending machine, said supplemental bending operation comprising at least one supplemental bending action each of which is effected with said supplemental bending position selected along and within a straight portion of said centerline of the workpiece which corresponds to said straight part.

17. An apparatus according to claim 12, wherein said supplemental bending information determining means comprises:

means for determining a plurality of provisional values of each of said supplemental bending position and said supplemental bending amount; and means for obtaining an estimated relative position between the opposite ends of said product to be obtained by supplemental bending operation, for each of a plurality of combinations of said provisional values of said supplemental bending position and amount, and selecting, as supplemental bending parameters, one of said plurality of combinations which permits an error between said estimated relative position and a nominal relative position to be smaller than a predetermined threshold, said nominal relative position being a position between opposite ends of a product to be obtained by said supplemental bending operation.

18. An apparatus according to claim 17, wherein said means for determining a plurality of provisional values comprises:

means for dividing a variation range of each of said supplemental bending position and amount by a first predetermined value to obtain a plurality of first provisional values;

means for determining whether none of a plurality of first combinations of said first provisional values of said supplemental bending position and amount permits said error to be smaller than said predetermined threshold; and means operable if none of said plurality of first combinations permits said error to be smaller than said predetermined threshold, for dividing said variation range by a second predetermined number larger than said first predetermined number, to thereby obtain a plurality of second provisional values which are then considered to check if said error is smaller than said predetermined threshold.

19. A method according to claim 18, wherein said means for obtaining an estimated relative position and selecting one of said plurality of combinations comprises:

means for selecting said plurality of first provisional values such that said first provisional values change in a predetermined first increment or decrement; and means for determining whether a sign of said error is reversed, wherein when said sign of said error is reversed, said plurality of second provisional values are determined such that said second provisional values change in a predetermined second increment or decrement which is smaller than said predetermined first increment or decrement, and wherein said means for obtaining an estimated relative position and selecting one of said plurality of combinations comprises:

means for checking only selected ones of said second provisional values which are close to one of said first provisional values which caused said sign of said error to be reversed; and means for determining whether any of said selected ones of said second provisional values permits said error to be smaller than said predetermined threshold and is acceptable.

* * * * *

UNITED STATES PATENT AND TRADEMARK OFFICE

CERTIFICATE OF CORRECTION

PATENT NO. : 5,634,362
DATED : June 3, 1997
INVENTOR(S) : TOMITA

It is certified that error appears in the above-indentified patent and that said Letters Patent is hereby corrected as shown below:

Claim 1, col. 40, line 18, delete "is" and insert --as--.

Signed and Sealed this

Twelfth Day of August, 1997

Bruce Lehman

*Attest:*

BRUCE LEHMAN

*Attesting Officer*

*Commissioner of Patents and Trademarks*